US008477123B2

(12) United States Patent
Tomohiro et al.

(10) Patent No.: US 8,477,123 B2
(45) Date of Patent: Jul. 2, 2013

(54) DISPLAY APPARATUS, DRIVING METHOD THEREOF AND ELECTRONIC EQUIPMENT INCLUDING A DRIVE CIRCUIT SELECTIVELY DRIVING SCAN LINES AND CAPACITOR LINES

(75) Inventors: Kazuhisa Tomohiro, Fukuoka (JP); Masaki Murase, Kanagawa (JP); Takayuki Nakanishi, Kanagawa (JP); Naoyuki Itakura, Kanagawa (JP); Yoshitoshi Kida, Camberley (GB)

(73) Assignee: Japan Display West, Inc., Aichi-ken (JP)

( * ) Notice: Subject to any disclaimer, the term of this patent is extended or adjusted under 35 U.S.C. 154(b) by 1349 days.

(21) Appl. No.: 12/230,099

(22) Filed: Aug. 22, 2008

(65) Prior Publication Data

US 2009/0058776 A1 Mar. 5, 2009

(30) Foreign Application Priority Data

Aug. 30, 2007 (JP) ..... 2007-224924

(51) Int. Cl.
*G09G 5/00* (2006.01)

(52) U.S. Cl.
USPC ..... 345/204; 345/690

(58) Field of Classification Search
USPC ..... 345/87–100, 204–215, 690
See application file for complete search history.

(56) References Cited

U.S. PATENT DOCUMENTS

| | | | | |
|---|---|---|---|---|
| 6,166,726 | A * | 12/2000 | Uchida et al. | 345/211 |
| 2002/0196208 | A1 * | 12/2002 | Nanno et al. | 345/55 |
| 2005/0156842 | A1 * | 7/2005 | Kato | 345/89 |

FOREIGN PATENT DOCUMENTS

| | | | |
|---|---|---|---|
| JP | 2-157815 | | 6/1990 |
| JP | 11-119746 | | 4/1999 |
| JP | 2000-298459 | | 10/2000 |
| JP | 2006-201734 | A | 8/2006 |
| JP | 2007-065076 | A | 3/2007 |

OTHER PUBLICATIONS

Japanese Office Action issued Mar. 21, 2012 for corresponding Japanese Application No. 2007-224924.

* cited by examiner

*Primary Examiner* — Rodney Amadiz
(74) *Attorney, Agent, or Firm* — Rader, Fishman & Grauer PLLC

(57) ABSTRACT

A display apparatus including: an effective pixel section having a plurality of pixel circuits arranged to form a matrix, each pixel circuit including a switching device through which pixel video data is written into the pixel circuit; a plurality of scan lines each provided for an individual one of rows of the pixel circuits arranged on the effective pixel section to control the conduction states of the switching devices; a plurality of capacitor lines each arranged for individual one of the rows connected to the pixel circuits; a plurality of signal lines each arranged for individual one of columns connected to the pixel circuits to propagate the pixel video data; a first driving circuit configured to selectively drive the scan lines and the capacitor lines; and a second driving circuit configured to drive the signal lines.

9 Claims, 64 Drawing Sheets

RELATED ART

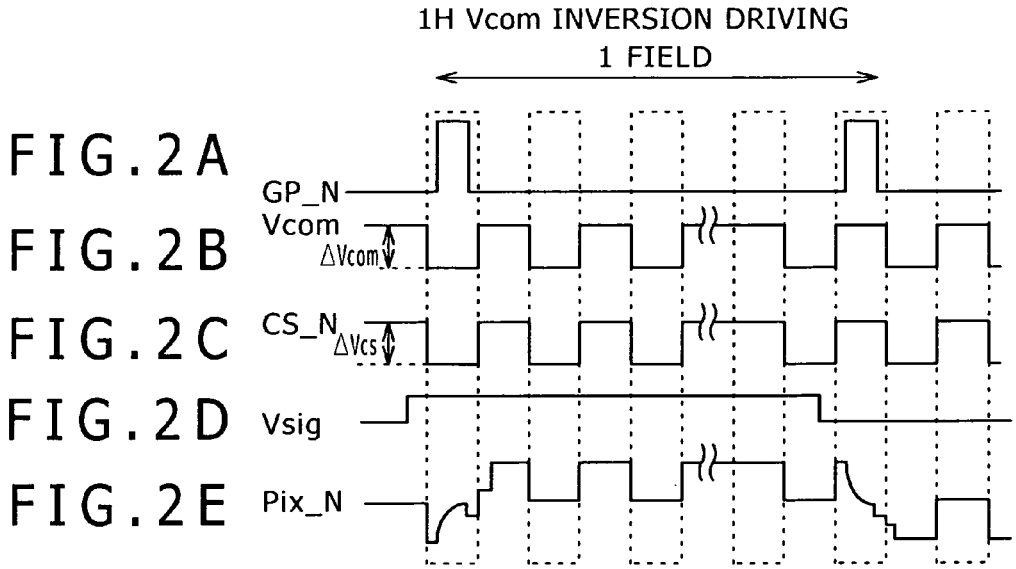
RELATED ART
FIG.3
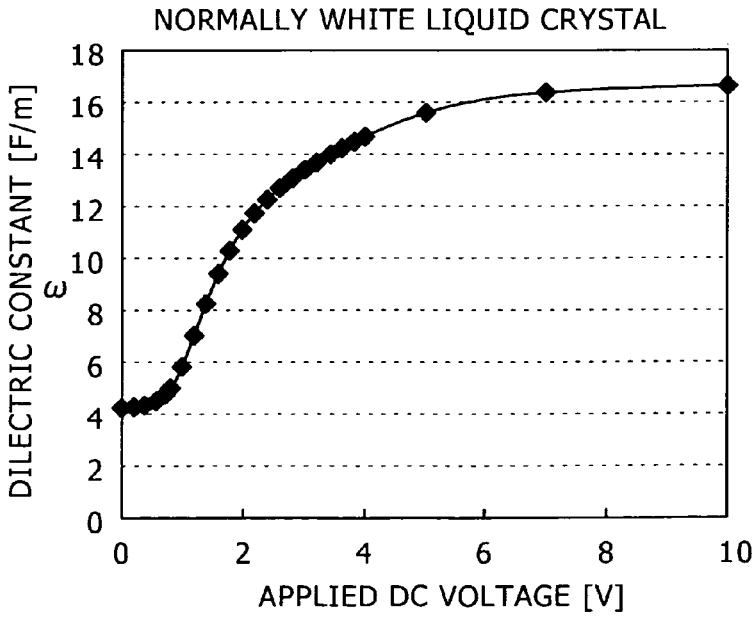
RELATED ART

FIG. 7A LSCS
FIG. 7B Gate DT
FIG. 7C GP1
FIG. 7D GP2
FIG. 7E GP3
FIG. 7F GP4
FIG. 7G GP5
FIG. 7H CS_DT
FIG. 7I CS_1
FIG. 7J CS_2
FIG. 7K CS_3
FIG. 7L CS_4

SOLID LINES--- GATE COUPLING WITH TR LEAK
DASHED LINES--- GATE COUPLING WITHOUT TR LEAK

FIG.25

| | VARIATION CAUSE 1 | VARIATION CAUSE 2 | VARIATION CAUSES (AT SCAN TIME) | SCAN-TIME ADJUSTMENT | AUTOMATIC ADJUSTMENT |
|---|---|---|---|---|---|
| EFFECTIVE PIXEL ELECTRIC-POTENTIAL VARIATION | COUPLING ON FALLING EDGE OF GATE LINE | | GATE-LINE VOLTAGE | ○ | ○ |
| | | | GATE-LINE TIME CONSTANT | ○ | ○ |
| | PIXEL Tr LEAK | Tr OFF LEAK | FREQUENCY (AT SCAN TIME) | ○ | ○ |
| | | | FREQUENCY (AT ACTUAL UTILIZATION TIME) (*1 | × | ○ |
| | | | TEMPERATURE (AT SCAN TIME) | ○ | ○ |
| | | | TEMPERATURE (AT UTILIZATION TIME) | × | ○ |
| | | | AGING | × | ○ |
| | | Tr OPTICAL LEAK | FREQUENCY (AT SCAN TIME) | ○ | ○ |
| | | | FREQUENCY (AT ACTUAL UTILIZATION TIME) (*1 | × | ○ |
| | | | TEMPERATURE (AT SCAN TIME) | ○ | ○ |
| | | | TEMPERATURE (AT UTILIZATION TIME) | × | ○ |
| | | | B/L LUMINANCE (AT SCAN TIME) | ○ | ○ |
| | | | B/L LUMINANCE (AT ACTUAL UTILIZATION TIME) (*2 | × | ○ |
| | | | EXTERNAL LIGHT LUMINANCE | × | ○ |

(*1: A CASE IN WHICH THE FRAME FREQUENCY IS CHANGED IN A LOW POWER CONSUMPTION MODE (A MODE FOR DISPLAYING THE PRESENT TIME ONLY)
(*2: A CASE IN WHICH THE BACKLIGHT LUMINANCE IS CHANGED IN ACCORDANCE WITH SETTING MADE BY AN ORDINARY USER

※EACH DRIVER CAN BE IMPLEMENTED BY PROVIDING A FUNCTION TO AN EXTERNAL IC IMPLEMENTED AS A COG AND A COF OR THE LIKE

FIG. 32
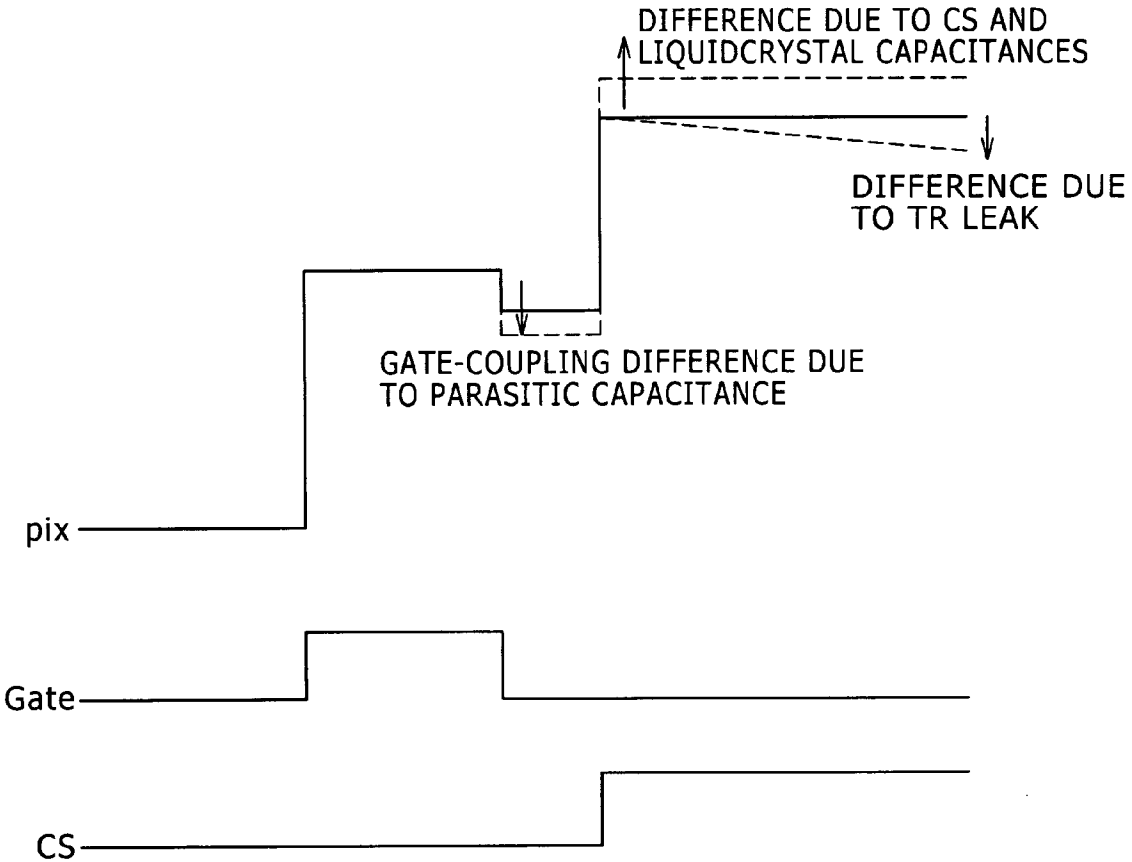
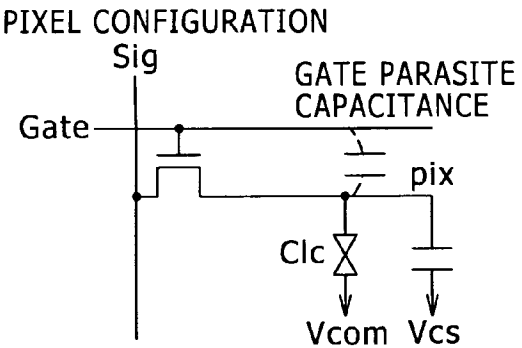

LIST OF CONSTANTS

| | | |
|---|---|---|
| Ccs | (pF) | 36 |
| Clc | (pF) | 11 |
| H/LpixC | (pF) | 47 |
| ADDED CAPACITANCE C | (pF) | 0 TO 6 |
| VH | (V) | 0 |
| VL | (V) | 3.35 |
| Vcs | (V) | 3.5 |

400A

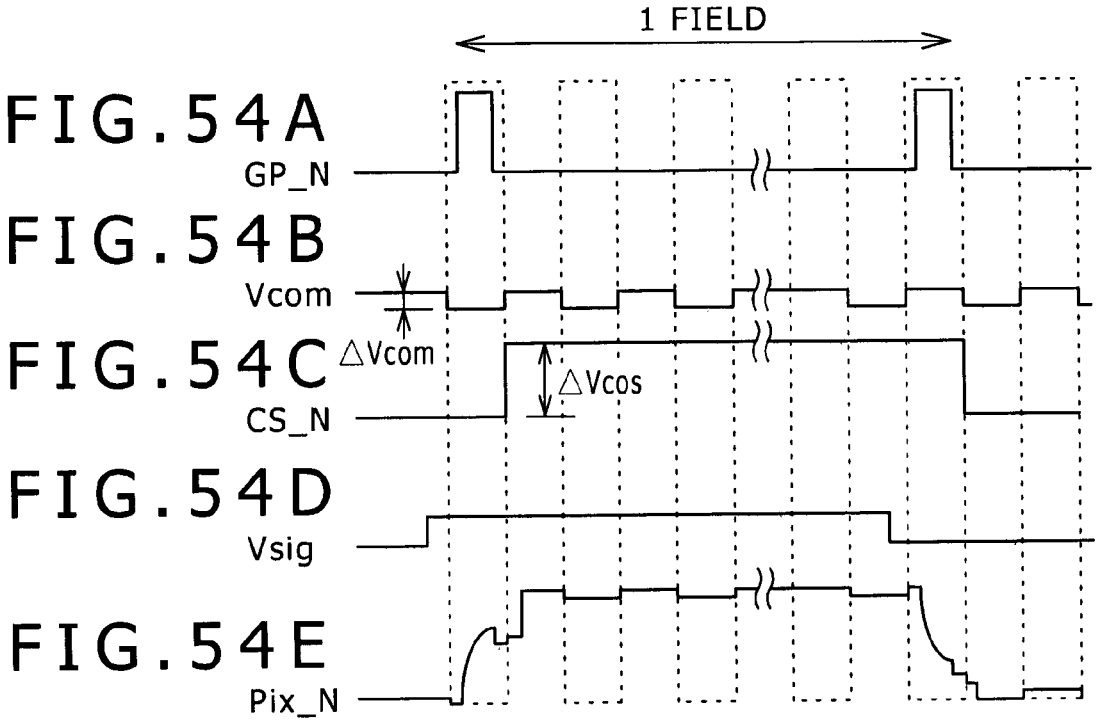
FIG.55
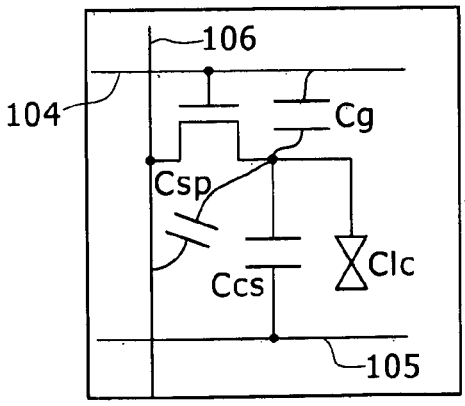

500

DISPLAY APPARATUS, DRIVING METHOD THEREOF AND ELECTRONIC EQUIPMENT INCLUDING A DRIVE CIRCUIT SELECTIVELY DRIVING SCAN LINES AND CAPACITOR LINES

CROSS REFERENCES TO RELATED APPLICATIONS

The present invention contains subject matter related to Japanese Patent Application JP 2007-224924 filed in the Japan Patent Office on Aug. 30, 2007, the entire contents of which being incorporated herein by reference.

BACKGROUND OF THE INVENTION

1. Field of the Invention

The present invention relates to an active-matrix display apparatus having display elements each included in one of pixel circuits arranged on a display area to form a matrix, a driving method to be adopted by the display apparatus and electronic equipment employing the display apparatus. In the following description, each of the display elements is also referred to as an electro-optical device.

2. Description of the Related Art

An example of the display apparatus is a liquid-crystal display apparatus employing liquid-crystal cells as display elements, each of which is referred to as an electro-optical device. The liquid-crystal display apparatus is characterized in that the display apparatus has a small thickness and a low power consumption. Various kinds of electronic equipment make use of such a liquid-crystal display apparatus, taking advantage of its characteristics. The electronic equipment includes a PDA (Personal Digital Assistant), a cell phone, a digital camera, a video camera and the display unit of a personal computer.

FIG. 1 is a block diagram showing a typical configuration of the liquid-crystal display apparatus 1 (see Japanese Patent laid-open No. Hei 11-119746 and Japanese Patent laid-open No. 2000-298459). As shown in FIG. 1, the liquid-crystal display apparatus 1 employs an effective pixel section 2, a vertical driving circuit (VDRV) 3 and a horizontal driving circuit (HDRV) 4.

In the effective pixel section 2, a plurality of pixel circuits 21 are arranged to form a matrix. Each of the pixel circuits 21 includes a thin-film transistor TFT21 functioning as a switching device, a liquid-crystal cell LC21 and a storage capacitor Cs21. The first pixel electrode of the liquid-crystal cell LC21 is connected to the drain electrode (or the source electrode) of the thin-film transistor TFT21. The drain electrode (or the source electrode) of the thin-film transistor TFT21 is also connected to one the first electrode of the storage capacitor Cs21.

Scan lines (or gate lines) 5-1 to **5-*m* are each provided for a row of the matrix and connected to the gate electrodes of the thin-film transistors TFT21 employed in the pixel circuits 21 provided on the row. The scan lines 5-1 to 5-*m* are arranged in the column direction. Signal lines 6-1 to 6-*n*** arranged in the row direction are each provided for a column of the matrix.

As described above, the gate electrodes of the thin-film transistors TFT21 employed in the pixel circuits 21 provided on a row are connected to a scan line (one of the scan lines 5-1 to **5-*m*) provided for the row. On the other hand, the source (or drain) electrodes of the thin-film transistors TFT21 employed in the pixel circuits 21 provided on a column are connected to a signal line (one of the signal lines 6-1 to 6-*n***) provided for the column.

In addition, in the case of an ordinary liquid-crystal display apparatus, a capacitor line Cs is provided separately. The storage capacitor Cs21 is connected between the capacitor line Cs and the first electrode of the liquid-crystal cell LC21. Pulses having the same phase as a common voltage Vcom are applied to the capacitor line Cs. In addition, the storage capacitor Cs21 of every pixel circuit 21 on the effective pixel section 2 is connected to the capacitor line Cs serving as a line common to all the storage capacitors Cs21.

On the other hand, the second pixel electrode of the liquid-crystal cell LC21 of every pixel circuit 21 is connected to a supply line 7 serving as a line common to all the liquid-crystal cells LC21. The supply line 7 provides the common voltage Vcom, which is a series of pulses with a polarity typically changing once every horizontal scan period. One horizontal scan period is referred to as 1H.

Each of the scan lines 5-1 to **5-*m* is driven by the vertical driving circuit 3 whereas each of the signal lines 6-1 to 6-*n* is driven by the horizontal driving circuit 4**.

The vertical driving circuit 3 scans the rows of the matrix in the vertical direction or the row-arrangement direction in one field period. In the scan operation, the vertical driving circuit 3 scans the rows sequentially in order to select a row at one time, that is, in order to select pixel circuits 21 provided on a selected row as pixel circuits connected to a gate line (one of the gate lines 5-1 to **5-*m*) provided for the selected row. To put it in detail, the vertical driving circuit 3 asserts a scan pulse GP1 on the gate line 5-1 in order to select pixel circuits 21 provided on the first row. Then, the vertical driving circuit 3 asserts a scan pulse GP2 on the gate line 5-2 in order to select pixel circuits 21 provided on the second row. Thereafter, the vertical driving circuit 3 sequentially asserts gate pulses GP3 . . . and GPm on the gate lines 5-3 . . . and 5-*m*** respectively in the same way.

FIGS. 2A to 2E show timing charts of signals generated in execution of the so-called 1H Vcom inversion driving method of the ordinary liquid-crystal display apparatus shown in FIG. 1. To be more specific, FIG. 2A shows the timing chart of the gate pulse GP_N, FIG. 2B shows the timing chart of the common voltage Vcom, FIG. 2C shows the timing chart of the capacitor signal CS_N, FIG. 2D shows the timing chart of the video signal Vsig and FIG. 2E shows the timing chart of the signal Pix_N applied to the liquid-crystal cell.

In addition, a capacitive coupling driving method is known as another driving method. In accordance with the capacitive coupling driving method, a voltage applied to the liquid-crystal cell is modulated by making use of a capacitive coupling effect from a capacitor line Cs (see Japanese patent laid-open No. Hei 2-157815).

SUMMARY OF THE INVENTION

The liquid-crystal display apparatus 1 shown in FIG. 1 has a configuration in which, synchronously with a master clock signal MCK received from an external source as a signal having a predetermined level, a DC-DC converter serving as a power-supply circuit shifts up the level of a voltage received from an external source in a voltage boosting operation in order to generate a driving voltage in a liquid-crystal display panel and supplies the driving voltage to predetermined circuits created on an insulation board.

Circuits inside the liquid-crystal display panel include a reference-voltage driving circuit for carrying out a driving operation to generate a voltage to be applied to a signal line as a voltage according to a gradation display.

If the received liquid-crystal voltage has a level in the range zero to 3.5 V, however, even though a dynamic range for the gradation display of the liquid-crystal cell can be obtained, the power consumption is large. That is to say, it is more difficult to make an effort to reduce the power consumption.

In addition, it is conceivable to simply reduce the voltage. If the voltage is simply reduced, however, there will be cases in which a sufficient dynamic range for the gradation display of the liquid-crystal cell cannot be obtained.

On top of that, in comparison with the 1H Vcom inversion driving method, the capacitive coupling driving method cited above has characteristic advantages such as an improved liquid-crystal response speed due to the so-called over drive operation, fewer audio noises generated in a Vcom frequency band and a capability of compensating the contrast in a high-definition display panel.

FIG. 3 is a diagram showing a relation between the dielectric constant $\epsilon$ of the liquid-crystal cell and the DC voltage applied to the liquid-crystal cell. If the capacitive coupling driving method disclosed in Japanese patent laid-open No. Hei 2-157815 is adopted in a liquid-crystal display apparatus employing liquid-crystal cells made of a liquid-crystal material having a characteristic like the one shown in FIG. 3, however, the display apparatus will raise a problem of large luminance variations due to effective pixel electric-potential variations caused by manufacturing process variations such as liquid-crystal gap variations/gate oxidation film thickness variations or due to liquid-crystal cell relative dielectric constant variations caused by environment temperature variations. The normally white material is a typical liquid-crystal material.

In addition, an effort to optimize the black luminance faces a problem of the white luminance becoming black, that is, a problem of the white luminance sinking.

An effective pixel electric potential ΔVpix applied to the liquid-crystal cell LC21 shown in FIG. 1 is expressed by the following equation:

[Eq. 1]

$$\Delta Vpix1 = Vsig + (Ccs/Ccs + Clc) * \Delta Vcs - Vcom \quad (1)$$

Notations used in Eq. (1) given above are explained by referring to FIG. 1 as follows. Notation ΔVpix1 denotes effective pixel electric-potential, notation Vsig denotes a video signal voltage, notation Ccs denotes the capacitance, notation Clc denotes the capacitance of the liquid-crystal, notation ΔVcs denotes the electric potential of a capacitor signal CS and notation Vcom denotes a common voltage.

As described above, an effort to optimize the black luminance faces a problem of the white luminance becoming black, that is, a problem of the white luminance sinking. The white luminance becomes black, that is, the white luminance sinks because of the term (Ccs/Ccs+Clc)*ΔVcs of Eq. (1). That is to say, the non-linear characteristic of the dielectric constant of the liquid-crystal cell has an effect on the electric potential appearing in the effective pixel electric-potential.

Addressing the problems described above, inventors of the present invention have innovated a liquid-crystal display apparatus capable of reducing the amount of power consumed in the liquid-crystal display panel as well as optimizing both the white luminance and the black luminance and innovated a driving method to be adopted by the display apparatus.

In accordance with a first aspect of the present invention, there is provided a display apparatus including:

an effective pixel section having a plurality of pixel circuits arranged to form a matrix, each pixel circuit including a switching device through which pixel video data is written into the pixel circuit;

a plurality of scan lines each provided for an individual one of rows of the pixel circuits arranged on the effective pixel section to control the conduction states of the switching devices;

a plurality of capacitor lines each arranged for individual one of the rows connected to the pixel circuits;

a plurality of signal lines each arranged for individual one of columns connected to the pixel circuits to propagate the pixel video data;

a first driving circuit configured to selectively drive the scan lines and the capacitor lines; and a second driving circuit configured to drive the signal lines, wherein the second driving circuit includes a voltage driving circuit having a voltage boosting function for carrying out a voltage boosting operation to boost an input voltage having a level with a dynamic range insufficient for a gradation expression;

the voltage driving circuit outputs a voltage obtained as a result of the voltage boosting operation or an unboosted voltage as a signal to one of the signal lines; and the voltage driving circuit has a select function for disabling the voltage boosting function for only gradations determined in advance and implementing the voltage boosting function to boost the input voltage to an output voltage according to the level of the input voltage for gradations other than the gradations determined in advance.

It is desirable to provide a configuration in which the voltage driving circuit disables the voltage boosting function only for the black side having large voltage variations.

It is also desirable to provide a configuration in which the voltage boosting function of the voltage driving circuit is based on a capacitive coupling effect and the voltage driving circuit does not make use of the capacitive coupling effect for gradation zero.

It is also desirable to provide a configuration in which:

a monitor circuit configured to detect an electric potential found as a midpoint of detected electric potentials appearing on positive-polarity and negative-polarity monitor pixels provided besides the effective pixel section, and corrects the center value of a common voltage signal with a level changing at predetermined time intervals on the basis of the detected potential midpoint, wherein each of the pixel circuits arranged in the effective pixel section, includes a display element having a first pixel electrode as well as a second pixel electrode, and a storage capacitor having a first electrode as well as a second electrode, in each of the pixel circuits, the first pixel electrode of the display element and the first electrode of the storage capacitor are connected to one terminal of the switching device;

in each of the pixel circuits, the second electrode of the storage capacitor is connected to the capacitor line provided for the individual row; and the common voltage with a level changing at time intervals determined in advance is supplied to the second pixel electrode of each of the display elements.

In accordance with a second aspect of the present invention, there is provided a driving method to be adopted in a display apparatus employing:

an effective pixel section having a plurality of pixel circuits arranged to form a matrix, each pixel circuit including a switching device through which pixel video data is written into the pixel circuit;

a plurality of scan lines each provided for an individual one of rows of the pixel circuits arranged on the effective pixel section to control the conduction states of the switching devices;

a plurality of capacitor lines each arranged for individual one of the rows connected to the pixel circuits;

a plurality of signal lines each arranged for individual one of columns connected to the pixel circuits to propagate the pixel video data;

a first driving circuit configured to selectively drive the scan lines and the capacitor lines; and a second driving circuit configured to drive the signal lines, whereby, in an operation to output a signal with a level according to a gradation expression to one of the signal lines, the second driving circuit receives an input voltage having a level with a dynamic range insufficient for the gradation expression, disables a voltage boosting function for only gradations determined in advance and boosts the input voltage to an output voltage according to the level of the input voltage for gradations other than the gradations determined in advance.

In accordance with a third aspect of the present invention, there is provided electronic equipment including a display apparatus employing:

an effective pixel section having a plurality of pixel circuits arranged to form a matrix, each pixel circuit including a switching device through which pixel video data is written into the pixel circuit;

a plurality of scan lines each provided for an individual one of rows of the pixel circuits arranged on the effective pixel section to control the conduction states of the switching devices;

a plurality of capacitor lines each arranged for individual one of the rows connected to the pixel circuits;

a plurality of signal lines each arranged for individual one of columns connected to the pixel circuits to propagate the pixel video data;

a first driving circuit configured to selectively drive the scan lines and the capacitor lines; and a second driving circuit configured to drive the signal lines, wherein the second driving circuit includes a voltage driving circuit having a voltage boosting function for carrying out a voltage boosting operation to boost an input voltage having a level with a dynamic range insufficient for a gradation expression, the voltage driving circuit outputs a voltage obtained as a result of the voltage boosting operation or an unboosted voltage as a signal to one of the signal lines, and the voltage driving circuit has a select function for disabling the voltage boosting function for only gradations determined in advance and implementing the voltage boosting function to boost the input voltage to an output voltage according to the level of the input voltage for gradations other than the gradations determined in advance.

In accordance with the present invention, in an operation carried out by the second driving circuit to output a signal with a level according to a gradation expression to a signal line, the voltage driving circuit receives an input voltage having a level with a dynamic range insufficient for the gradation expression. Then, the voltage driving circuit disables a voltage boosting function for only gradations determined in advance and boosts the input voltage to an output voltage according to the level of the input voltage for gradations other than the gradations determined in advance.

The embodiments of the present invention offers merits of a capability of reducing the amount of electric power consumed by the liquid-crystal display panel as well as a capability of optimizing both the white luminance and the black luminance.

BRIEF DESCRIPTION OF THE DRAWINGS

FIGS. 2A to 2E show timing charts of signals generated in execution of the so-called 1HVcom inversion driving method in the ordinary liquid-crystal display apparatus shown in FIG. 1;

FIG. 3 is a diagram showing a relation between the dielectric constant of a normally white liquid-crystal cell and a DC voltage applied to a liquid-crystal cell;

FIG. 17A is a diagram showing a typical configuration of a monitor pixel employed in a first monitor pixel section whereas

FIG. 22A is a diagram showing a relation between a gate pulse and the difference in electric potential between a pixel electric potential with the negative (−) polarity and a common voltage whereas

FIG. 24A is a diagram showing a state obtained as a result of a gate coupling effect and leak currents each flowing through a transistor employed in a pixel circuit in implementation of a driving method according to the embodiment for the negative (−) polarity whereas

FIG. 25 is a table showing causes of pixel electric-potential variations as causes, the effects of which can be eliminated by automatically adjusting the center value of the common voltage in accordance with the embodiment;

FIG. 28A is a diagram showing a plurality of monitor pixels typically laid out in the horizontal direction as pixel circuits simply connected to a common gate line whereas

FIG. 32 is a diagram showing the configuration of a pixel circuit as well as an explanatory diagram to be referred to in description of the fact that it is quite within the bounds of possibility that differences between an electric potential detected in a monitor pixel electric potential and an electric potential actually appearing in a display pixel circuit are generated due to variations in display panel surface such as variations in liquid-crystal cell gap and variations in interlayer insulation film even if the monitor pixel electric potential and the display pixel circuit are put in the same operating conditions;

FIG. 36A is a diagram showing a midpoint electric-potential detection system and/or a Sig write system which are implemented as an external IC such as a COG whereas FIG. 36B is a diagram showing a midpoint electric-potential detection system and/or a Sig write system which are implemented as an external IC such as a COF;

FIG. 43A is a diagram showing the waveform of an undeformed electric potential appearing in a pixel circuit in a normal operation to drive a liquid-crystal cell by making use of an AC voltage as the common voltage whereas

FIG. 51A is a diagram showing a layout model of an effective pixel circuit (also referred to as a display pixel circuit) according to the embodiment whereas

FIGS. 54A to 54E show the timing charts of main signals driving a liquid-crystal cell in the embodiment;

FIG. 55 is a diagram showing capacitances of a pixel circuit as capacitances used in Eq. 7;

DETAILED DESCRIPTION OF THE PREFERRED EMBODIMENTS

Preferred embodiments of the present invention are explained in detail by referring to diagrams as follows.

Figure 1:
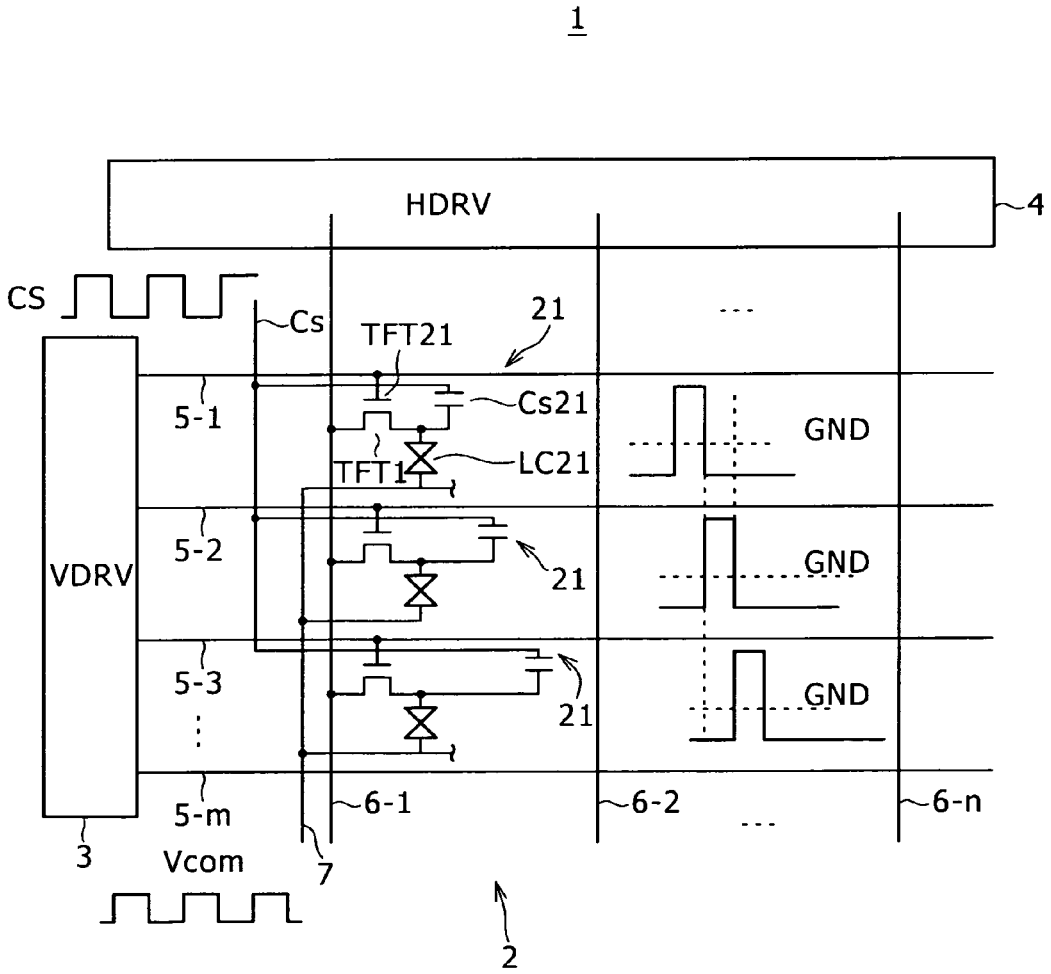
FIG. 1 is a block diagram showing a typical configuration of an ordinary liquid-crystal display apparatus.
Figure 4:
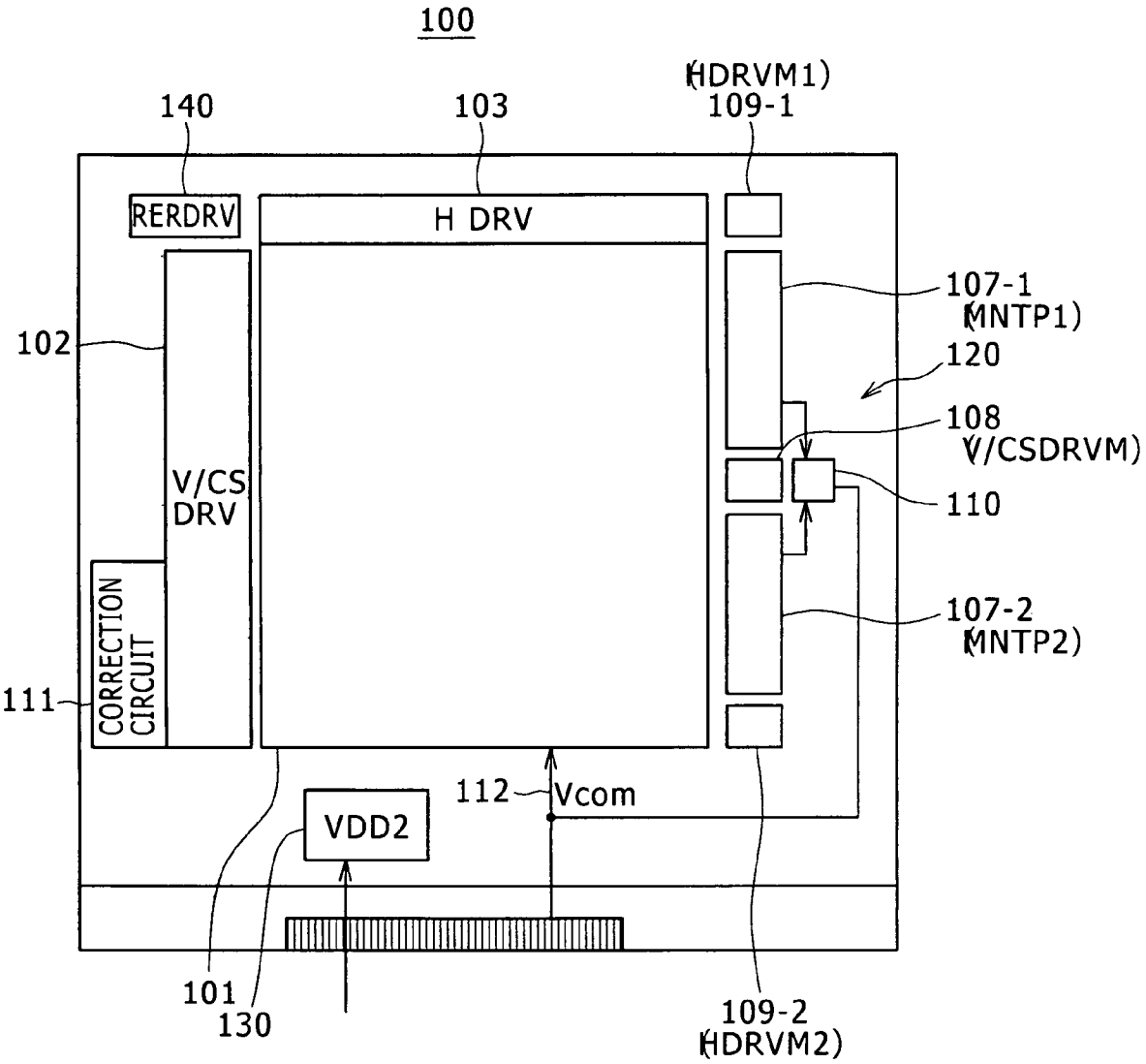
FIG. 4 is a diagram showing a typical configuration of an active-matrix display apparatus implemented by an embodiment of the present invention.
Figure 5:
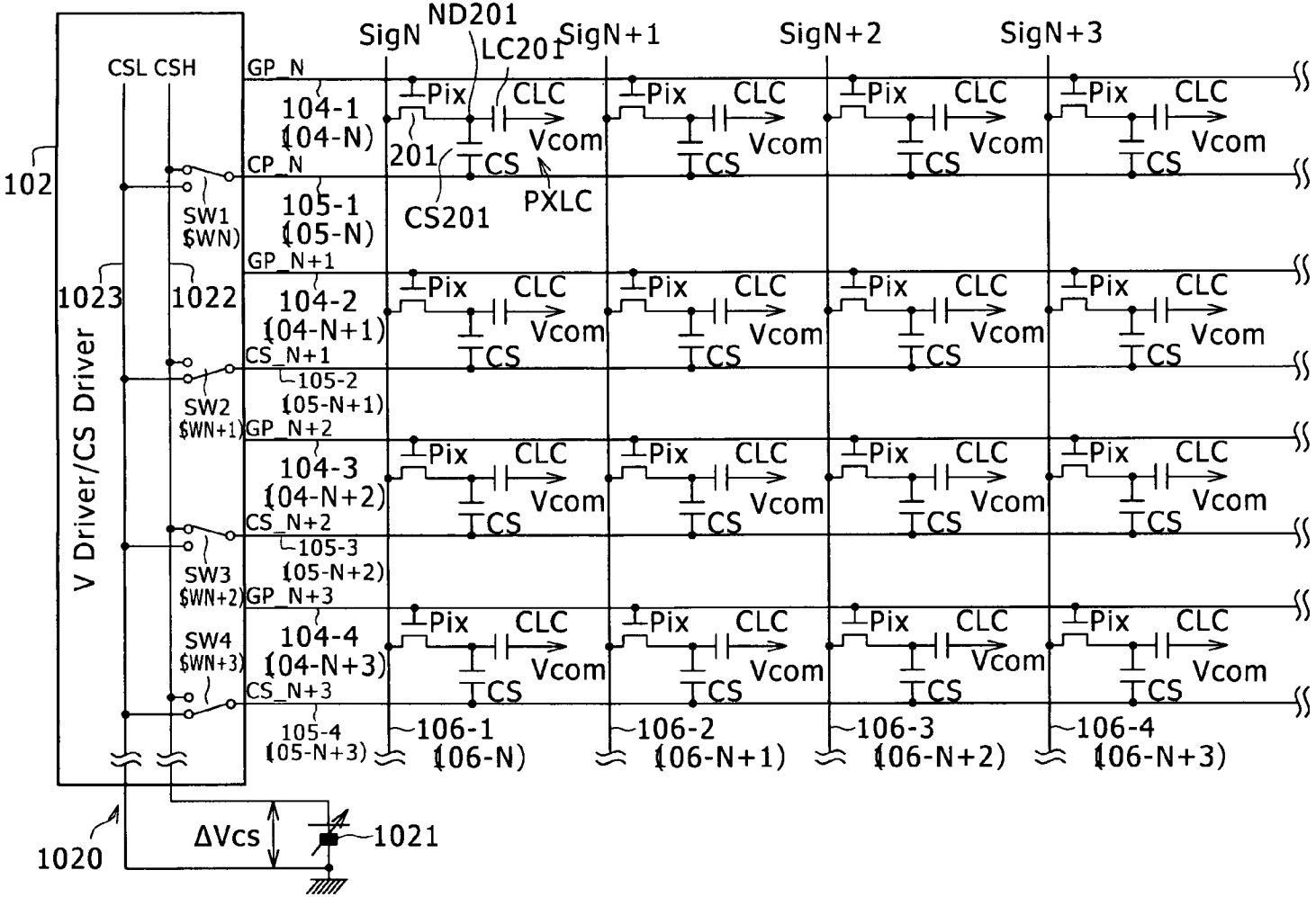
FIG. 5 is a circuit diagram showing a typical concrete configuration of an effective pixel section employed in the active-matrix display apparatus shown in FIG. 4.

FIG. 4 is a diagram showing a typical configuration of an active-matrix display apparatus 100 implemented by an embodiment of the present invention as a display apparatus employing, for example, a liquid-crystal cell as a display element (also referred to as an electro optical device) in each pixel circuit. FIG. 5 is a circuit diagram showing a typical concrete configuration of an effective pixel section 101 of the active-matrix display apparatus 100 shown in FIG. 4.

As shown in FIGS. 4 and 5, the active-matrix display apparatus 100 has main components including the effective pixel section 101, a vertical driving circuit (V/CSDRV) 102, a horizontal driving circuit (HDRV) 103, gate lines (each also referred to as a scan line) 104-1 to **104-*m*, capacitor lines 105-1 to 105-*m*, signal lines 106-1 to 106-*n*, a first monitor (dummy) pixel section (MNTP1) 107-1, a second monitor pixel section (MNTP2) 107-2, a vertical driving circuit (V/CSDRVM) 108 serving as a vertical driving circuit common to the first monitor pixel section 107-1 and the second monitor pixel section 107-2, a first monitor horizontal driving circuit (HDRVM1) 109-1 designed specially for the first monitor pixel section 107-1, a second monitor horizontal driving circuit (HDRVM2) 109-2 designed specially for the second monitor pixel section 107-2, a detection-result output circuit 110 and a correction circuit 111**. In the following description, the monitor pixel section is also referred to as a detection pixel section, a sensor pixel section or a dummy pixel section.

In this embodiment, a monitor circuit 120 provided at a location adjacent to the effective pixel section 101 (in FIG. 4, a location on the right side of the effective pixel section 101) includes the first monitor pixel section 107-1 having one monitor pixel or a plurality of monitor pixels, the second monitor pixel section 107-2 also having one monitor pixel or a plurality of monitor pixels, the vertical driving circuit (V/CSDRVM) 108 serving as a vertical driving circuit common to the first monitor pixel section 107-1 and the second monitor pixel section 107-2, the first monitor horizontal driving circuit (HDRVM1) 109-1 designed specially for the first monitor pixel section 107-1, the second monitor horizontal driving circuit (HDRVM2) 109-2 designed specially for the second monitor pixel section 107-2 and the detection-result output circuit 110.

In addition, the horizontal driving circuit 103 is provided at a location adjacent to the effective pixel section 101. In FIG. 4, the horizontal driving circuit 103 is provided a location above the effective pixel section 101. On the other hand, the vertical driving circuit 102 is provided at a location adjacent to the effective pixel section 101. In FIG. 4, the vertical driving circuit 102 is provided at a location on the left side of the effective pixel section 101.

The embodiment also has a power-supply circuit (VDD2) 130.

When the power-supply circuit 130 receives a liquid-crystal voltage VDD1 in the range zero to 3.5 V from an external source, the embodiment is capable of obtaining a dynamic range for a gradation display of the liquid-crystal cell. Since the magnitude of the consumed current increases, however, the liquid-crystal voltage VDD1 received from an external source is set at a level in the range zero to 2.9 V in order to reduce the magnitude of the consumed current.

Figure 6:
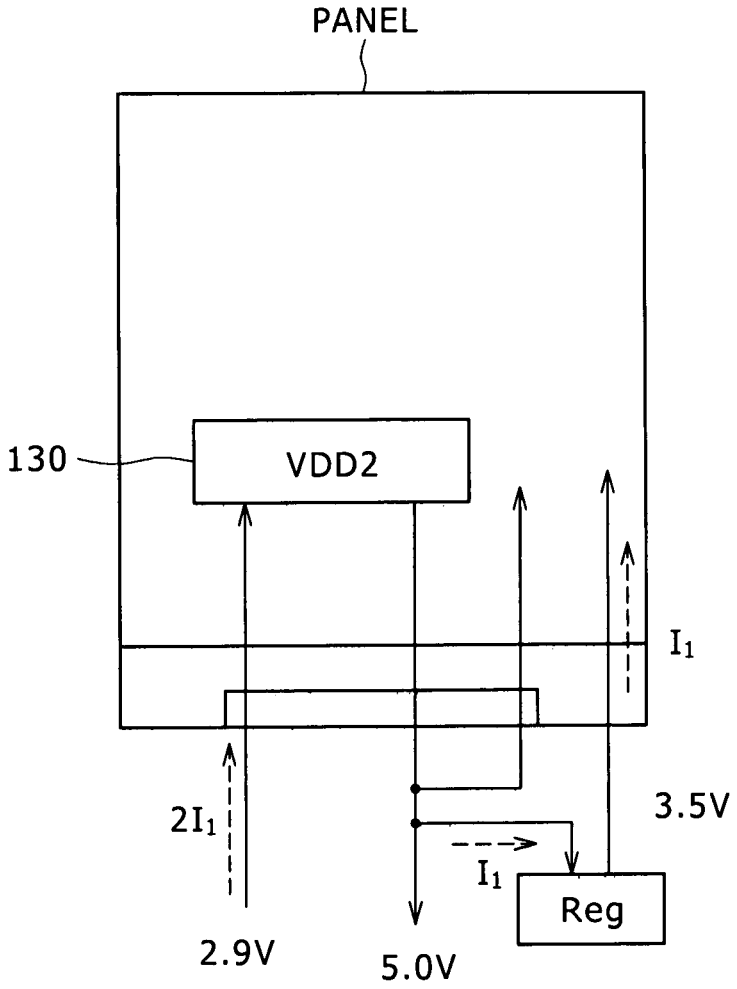
FIG. 6 is an explanatory diagram to be referred to in description of power supplies of the active-matrix display apparatus.

The power-supply circuit 130 includes a DC-DC converter which receives a liquid-crystal voltage VDD1 of, for example, 2.9 V from an external source as shown in FIG. 6, synchronize the liquid-crystal voltage VDD1 with a master clock signal MCK and/or a horizontal synchronization signal Hsync which are supplied from an interface circuit not shown in the figure. The power-supply circuit 130 boosts the liquid-crystal voltage VDD1 to a 5V-system panel voltage VDD2 of, for example, 5.zero V. The power-supply circuit 130 supplies the 5V-system panel voltage VDD2 to a variety of circuits in a liquid-crystal display panel serving as the active-matrix display apparatus 100. In addition, the power-supply circuit 130 also supplies the 5V-system panel voltage VDD2 of 5.zero V to a regulator outside the liquid-crystal display panel. This external regulator generates a 3.5V-system voltage for predetermined circuits inside the liquid-crystal display panel. The external regulator supplies the 3.5V-system voltage to the internal circuits which are determined in advance.

In addition, the power-supply circuit 130 also generates panel internal voltages of the negative polarity and supplies the negative panel internal voltages to predetermined circuits (such as an interface circuit) in the liquid-crystal display panel. Examples of the negative panel internal voltages are a voltage VSS2 of −1.9 V and a voltage VSS3 of −3.8 V.

On top of that, the power-supply circuit 130 also supplies a voltage in the range zero to 2.9 V to a reference-voltage driving circuit also referred to as a reference driver REFDRV 140. The reference driver 140 is a circuit for generating a voltage to be asserted on the signal lines 106-1 to **106-*n* by way of the horizontal driving circuit 103**.

The configuration of the reference driver 140 will be described later.

As will be described later in detail, the embodiment basically adopts a driving method for modulating a voltage applied to a liquid-crystal cell. In accordance with this driving method, after pixel video data from the signal lines 106-1 to **106-*n* has been written into pixel circuits, that is, after gate pulses supplied to the gate lines 104-1 to 104-*m* are pulled down, capacitor signals CS are applied from the capacitor lines 105-1 to 105-*m* to the liquid-crystal cells LC201 through coupling effects of the storage capacitors Cs201** to change electric potentials each appearing in a pixel circuit and, hence, modulate the voltages applied to liquid-crystal cells.

Then, in the course of an actual driving operation according to this driving method, a monitor circuit detects an electric potential found as a midpoint of detected electric potentials appearing on monitor pixel circuits PXLC of the first monitor pixel section 107-1 and the second monitor pixel section 107-2, which are provided besides the effective pixel section 101, as electric potentials having the positive and negative polarities and automatically corrects the center value of a common voltage Vcom on the basis of the detected electric-potential midpoint. The center value of the common voltage Vcom is corrected by feeding back the midpoint to the reference driver 140 in order to optimize the common voltage Vcom. The electric potential appearing on a monitor pixel circuit PXLC is an electric potential appearing on a connection node ND201 of the monitor pixel circuit PXLC.

In addition, as will be described later, the embodiment corrects a capacitor signal CS output by the CS driver in accordance with monitor pixel electric potentials detected from the first monitor pixel section 107-1 and the second monitor pixel section 107-2 in order to set the electric potential of each display pixel circuit PXLC in the effective pixel section 101 at a certain level.

The functions of the monitor circuit and a system for correcting the capacitor signal CS will be described in detail later.

As shown in FIG. 5, the effective pixel section 101 has a plurality of pixel circuits PXLC arranged to form an m×n matrix. It is to be noted that, in order to make the diagram of FIG. 5 simple, the pixel circuits PXLC are arranged to form a 4×4 matrix.

As shown in FIG. 5, each of the pixel circuits PXLC includes a thin-film transistor TFT201 functioning as a switching device, a liquid-crystal cell LC201 and a storage capacitor Cs201. The TFT is an abbreviation for the thin-film transistor. The first pixel electrode of the liquid-crystal cell LC201 is connected to the drain (or the source) of the thin-film transistor TFT201. The drain (or the source) of the thin-film transistor TFT201 is also connected to the first electrode of the storage capacitor Cs201.

It is to be noted that the point of connection between the drain electrode of the thin-film transistor TFT201, the first pixel electrode of the liquid-crystal cell LC201 and the first electrode of the storage capacitor Cs201 forms a node ND201.

Each of scan lines (each referred to as a gate line) 104-1 to **104-*m* and each of the capacitor lines 105-1 to 105-*m* are provided for a row of the matrix. The scan line 104 is connected to the gate electrode of the thin-film transistor TFT201 employed in each of the pixel circuits PXLC provided on the row. The scan lines 104-1 to 104-*m* and the capacitor lines 105-1 to 105-*m* are arranged in the column direction. On the other hand, signal lines 106-1 to 106-*n*** arranged in the row direction are each provided for a column of the matrix.

The gate electrodes of the thin-film transistors TFT201 employed in the pixel circuits PXLC provided on a row are connected to a scan line (one of the scan lines 104-1 to **104-*m***) provided for the row.

By the same token, the second electrodes of the storage capacitors Cs201 employed in the pixel circuits PXLC provided on a row are connected to a capacitor line (one of the capacitor lines 105-1 to **105-*m***) provided for the row.

On the other hand, the source (or drain) electrodes of the thin-film transistors TFT21 employed in the pixel circuits PXLC provided on a column are connected to a signal line (one of the signal lines 106-1 to **106-*n***) provided for the column.

The second pixel electrodes of the liquid-crystal cells LC201 employed in the pixel circuits PXLC are connected to a supply line 112 serving as a line common to all the liquid-crystal cells LC201. The supply line 112 is a line used for providing a common voltage Vcom, which is a series of pulses with a small amplitude and a polarity, for example, changing once every horizontal scan period. A horizontal scan period is referred to as 1H. The common voltage Vcom will be described in detail later.

Each of the gate lines 104-1 to **104-*m* is driven by a gate driver employed in the vertical driving circuit 102 shown in FIG. 4 whereas each of the capacitor lines 105-1 to 105-*m* is driven by a capacitor driver (also referred to as a CS driver) also employed in the vertical driving circuit 102. On the other hand, each of the signal lines 106-1 to 106-*n* is driven by the horizontal driving circuit 103**.

The vertical driving circuit 102 basically scans the rows of the matrix in the vertical direction or the row-arrangement direction in 1 field period. In the scan operation, the vertical driving circuit 102 scans the rows sequentially in order to select a row at one time, that is, in order to select pixel circuits PXLC provided on a selected row as pixel circuits connected to a gate line (one of the gate lines 104-1 to **104-*m***) provided for the selected row.

To put it in detail, the vertical driving circuit 102 asserts a gate pulse GP1 on the gate line 104-1 in order to select pixel circuits PXLC provided on the first row. Then, the vertical driving circuit 102 asserts a gate pulse GP2 on the gate line 104-2 in order to select pixel circuits PXLC provided on the second row. Thereafter, the vertical driving circuit 102 sequentially asserts gate pulses GP3 . . . and GPm on the gate lines 104-3 . . . and **104-*m*** respectively in the same way.

In addition, the capacitor lines 105-1 to **105-*m* are provided independently of each other for respectively the gate lines 104-1 to 104-*m* which are each provided for one of the rows of the matrix. The vertical driving circuit 102 also asserts capacitor signals CS1 to CSm on the capacitor lines 105-1 to 105-*m* respectively. Each of the capacitor signals CS1** to CSm is set selectively at a first level CSH such as a voltage in the range 3 to 4 V or a second level CSL such as zero V.

Figure 7:
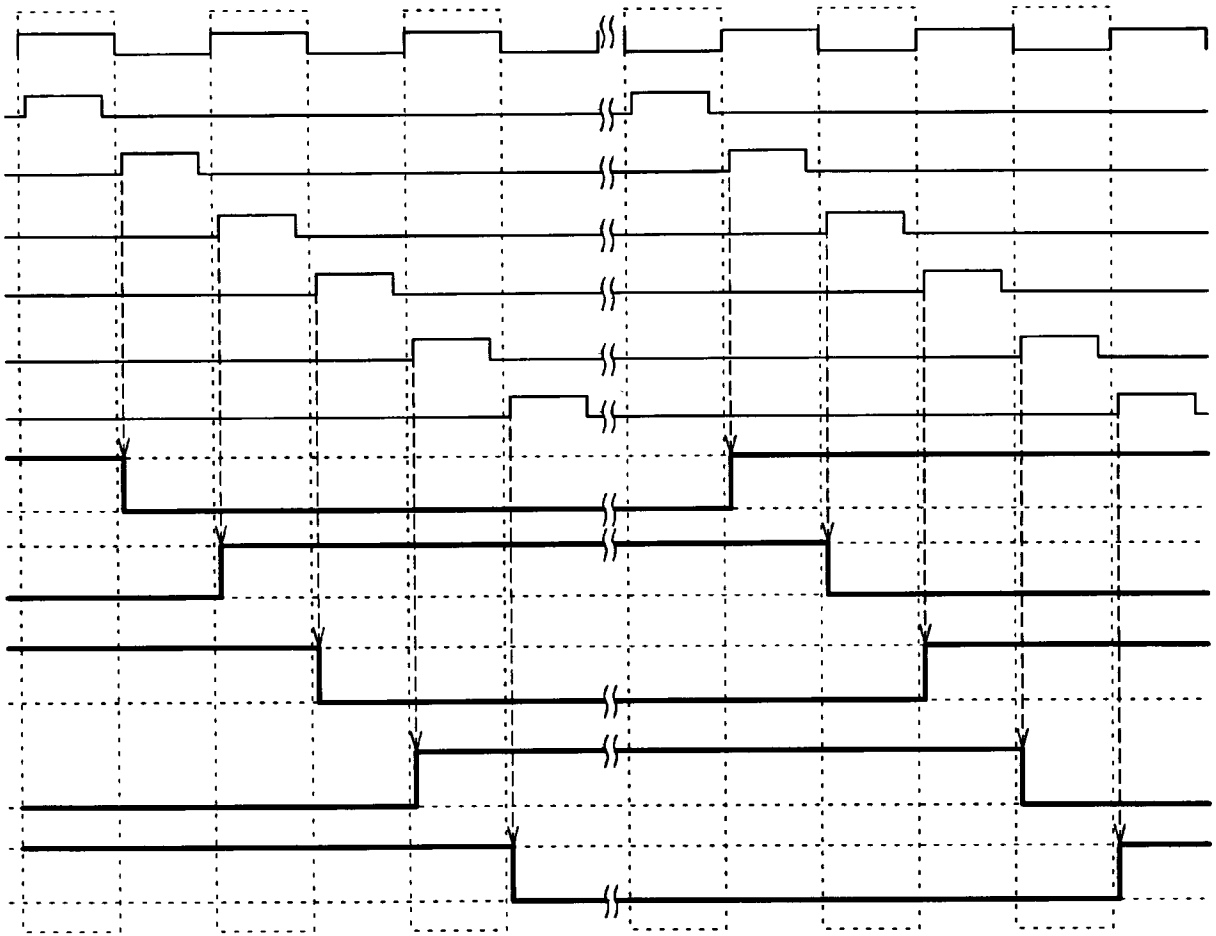
FIGS. 7A to 7L show typical timing charts of gate pulses generated by a vertical driving circuit according to the embodiment as pulses each appearing on a gate line and capacitor signals each asserted by the vertical driving circuit on a capacitor line.

FIGS. 7A to 7L show typical timing charts of the gate pulses GP1 to GPm generated by the vertical driving circuit 102 as pulses appearing on the gate lines 104-1 to **104-*m* respectively and the capacitor signals CS1 to CSm asserted by the vertical driving circuit 102 on the capacitor lines 105-1 to 105-*m* respectively. To be more specific, FIG. 7A shows a typical timing chart of a signal LSCS supplied to the vertical driving circuit 102 as a signal used for recognizing the polarity, FIG. 7B shows a typical timing chart of a pulse Gate_DT asserted on a dummy gate line shown in none of the figures as a gate line outside an area in which the gate lines 104-1 to 104-*m* are provided, FIGS. 7C to 7G show respectively typical timing charts of gate pulses GP1, GP2, GP3, GP4 and GP5 asserted on respectively the gate lines 104-1, 104-2, 104-3, 104-4 and 104-5 shown in FIG. 5, FIG. 7H shows a typical timing chart of a pulse CS_DT asserted on a dummy capacitor line shown in none of the figures as a capacitor line outside an area in which the capacitor lines 105-1 to 105-*m* are provided and FIGS. 7I to 7L show respectively typical timing charts of capacitor pulses CS_1, CS_2, CS_3 and CS_4 and asserted on respectively the capacitor lines 105-1, 105-2, 105-3 and 105-4 shown in FIG. 5**.

The vertical driving circuit 102 drives the gate lines 104-1 to **104-*m* and the capacitor lines 105-1 to 105-*m* sequentially, starting, for example, from the first gate line 104-1 and the first capacitor line 105-1 respectively. After a gate pulse GP is asserted on a gate line (one of the gate lines 104-1 to 104-*m*) in order to write a video signal into a pixel circuit PXLC connected to the gate line, with the timing of the rising edge of a gate pulse asserted on the next gate line 104, the level of the capacitor signal (one of the capacitor signals CS1 to CSm) conveyed by the capacitor line (one of the capacitor lines 105-1 to 105-*m*) connected to the pixel circuit PXLC to supply the capacitor signal to the pixel circuit PXLC is changed from the first level CSH to the second level CSL or vice versa. The capacitor signals CS1 to CSm conveyed by the capacitor lines 105-1 to 105-*m*** are set at the first level CSH or the second level CSL in an alternate way described as follows.

For example, when the vertical driving circuit 102 supplies the capacitor signal CS1 set at the first level CSH to the pixel circuit PXLC through the first capacitor line 105-1, the vertical driving circuit 102 then supplies the capacitor signal cS2 set at the second level CSL to the pixel circuit PXLC through the second capacitor line 105-2, the capacitor signal cS3 set at the first level CSH to the pixel circuit PXLC through the third capacitor line 105-3 and the capacitor signal cS4 set at the second level CSL to the pixel circuit PXLC through the fourth capacitor line 105-4 subsequently. In the same way, the vertical driving circuit 102 thereafter sets the capacitor signals CS5 to CSm at the first level CSH or the second level CSL alternately and supplies the capacitor signals CS5 to CSm to the pixel circuit PXLC through the capacitor lines 105-5 to **105-*m*** respectively.

When the vertical driving circuit 102 supplies the capacitor signal CS1 set at the second level CSL to the pixel circuit PXLC through the first capacitor line 105-1, on the other hand, the vertical driving circuit 102 then supplies the capacitor signal CS2 set at the first level CSH to the pixel circuit PXLC through the second capacitor line 105-2, the capacitor signal CS3 set at the second level CSL to the pixel circuit PXLC through the third capacitor line 105-3 and the capacitor signal CS4 set at the first level CSH to the pixel circuit PXLC through the fourth capacitor line 105-4 subsequently. In the same way, the vertical driving circuit 102 thereafter sets the capacitor signals CS5 to CSm at the first level CSH or the second level CSL alternately and supplies the capacitor signals CS5 to CSm to the pixel circuit PXLC through the capacitor lines 105-5 to **105-*m*** respectively.

In this embodiment, after the falling edge of a gate pulse GP asserted on a specific one of the gate lines 104-1 to **104-*m*, that is, after a video signal is written into a pixel circuit PXLC connected to the specific gate line 104, the capacitor lines 105-1 to 105-*m* are driven as described above, resulting in a capacitive coupling effect of the storage capacitor Cs201 employed in each of the pixel circuits PXLC and, in each of the pixel circuits PXLC, an electric potential appearing on the node ND201 is changed due to the capacitive coupling effect in order to modulate a voltage applied to the liquid-crystal cell LC201**.

Then, in the course of an actual driving operation according to this driving method, as will be described later, the monitor circuit detects an electric potential found as a midpoint of detected electric potentials appearing on monitor pixel circuits PXLC of the first monitor pixel section 107-1 and the second monitor pixel section 107-2, which are provided besides the effective pixel section 101, as electric potentials having the positive and negative polarities and automatically corrects the center value of a common voltage Vcom on the basis of the detected electric-potential midpoint. The center value of the common voltage Vcom is corrected by feeding back the midpoint to the reference driver 140 in order to optimize the common voltage Vcom. The electric potential appearing on a monitor pixel circuit PXLC is an electric potential appearing on the connection node ND201 of the monitor pixel circuit PXLC.

In addition, as will be described later, the embodiment corrects the capacitor signal CS output by the CS driver in accordance with monitor pixel electric potentials detected from the first monitor pixel section 107-1 and the second monitor pixel section 107-2 in order to set the electric potential of each pixel circuit PXLC in the effective pixel section 101 at a certain level. FIG. 5 also shows a model of a typical level select output section of a CS driver 1020 employed in the vertical driving circuit 102.

As shown in the figure, the CS driver 1020 includes a variable power supply 1021, a first-level supply line 1022, a second-level supply line 1023 and switches SW1 to SWm for selectively connecting the first-level supply line 1022 or the second-level supply line 1023 to the capacitor lines 105-1 to 105-*m* respectively. The first-level supply line 1022 which is connected to the positive terminal of the variable power supply 1021 is a line for conveying a voltage of the first level CSH. On the other hand, the second-level supply line 1023 which is connected to the negative terminal of the variable power supply 1021 is a line for conveying a voltage of the second level CSL. The switches SW1 to SWm selectively connect the first-level supply line 1022 or the second-level supply line 1023 to the capacitor lines 105-1 to 105-*m* respectively at a time in order to supply the capacitor signal CS set at the first or second level CSH or CSL to the pixel circuits PXLC on a row connected to the capacitor line 105.

Notation ΔVcs shown in FIG. 5 denotes the difference between the first level CSH and the second level CSL. In the following description, this difference is also referred to as a CS electric potential ΔVcs.

As will be described later in detail, each of the CS electric potential ΔVcs and an amplitude ΔVcom is set at such a value that both the black luminance and the white luminance can be optimized. The amplitude ΔVcom is the amplitude of the AC common voltage Vcom having a small amplitude.

As will be described later, for example, in the case of a white display, each of the CS electric potential ΔVcs and the amplitude ΔVcom is set at such a value that an effective pixel electric potential ΔVpix_W applied to the liquid-crystal does not exceed 0.5 V.

The vertical driving circuit 102 includes a set of vertical shift registers VSR. That is to say, the vertical driving circuit 102 employs a plurality of aforementioned vertical shift registers VSR. Each of the vertical shift registers VSR is provided for one of gate buffers connected to the gate lines 104-1 to 104-*m* each provided for one of the rows composing the pixel circuit matrix. Each of the vertical shift registers VSR receives a vertical start pulse VST generated by a clock generator not shown in the figure as a pulse serving as a command to start a vertical scan operation and a vertical clock signal VCK generated by the clock generator as a clock signal serving as the reference of the vertical scan operation. It is to be noted that, in place of the vertical clock signal VCK, vertical clock signals VCK and VCKX having phases opposite to each other can be used.

For example, a vertical shift register VSR starts a shift operation with the timing of the vertical start pulse VST synchronously with the vertical clock signal VCK in order to supply pulses to a gate buffer associated with the vertical shift register VSR.

In addition, the vertical start pulse VST can also be supplied to the vertical shift registers VSR sequentially from a component above or below the effective pixel section 101.

Thus, on the basis of the vertical start pulse VST and the vertical clock signal VCK, the shift registers VSR employed in the vertical driving circuit 102 sequentially supply gate pulses to the gate lines 104-1 to 104-*m* by way of the gate buffers as pulses for driving the gate lines 104-1 to 104-*m*.

On the basis of a horizontal start pulse HST serving as a command to start a horizontal scan operation and a horizontal clock signal HCK serving as the reference signal of a horizontal scan operation, the horizontal driving circuit 103 sequentially samples the input video signal Vsig every 1H or for each horizontal scan period H in order to write the input video signal Vsig at one time into the pixel circuits PXLC on a row, which is selected by the vertical driving circuit 102, through the signal lines 106-1 to 106-*n*. It is to be noted that, in place of the horizontal clock HCK, vertical clocks HCK and HCKX having phases opposite to each other can be used.

The level of the video signal Vsig is set by the reference driver 140 as a voltage corresponding to a gradation level.

The configuration of the reference driver 140 according to the embodiment as well as its functions are explained as follows.

Figure 8:
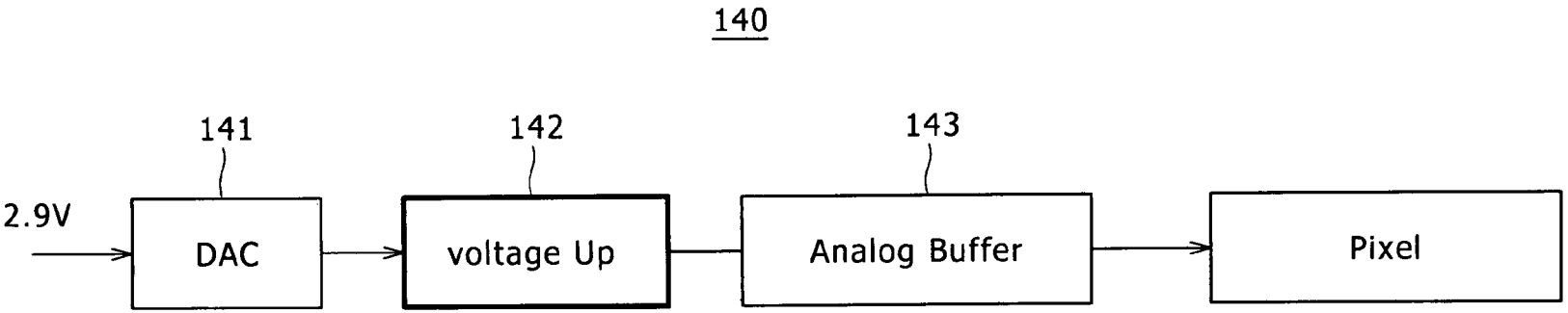
FIG. 8 is a block diagram showing the basic configuration of a reference driver according to the embodiment.

FIG. 8 is a block diagram showing the basic configuration of the reference driver 140 according to the embodiment.

The reference driver 140 shown in the block diagram of FIG. 8 employs a digital-to-analog converter (DAC) 141, a voltage boosting section 142 and an analog buffer 143.

Figure 9:
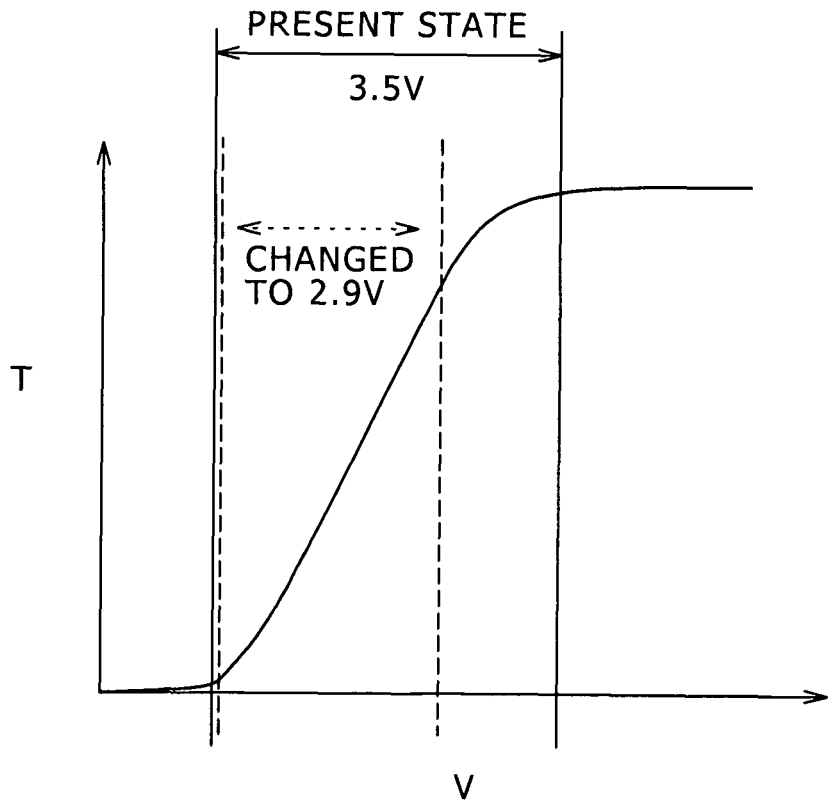
FIG. 9 is an explanatory diagram to be referred to in description of a dynamic range.

The reference driver 140 receives a voltage in the range zero to 2.9 V from the power-supply circuit 130. Thus, in comparison with an input voltage of 3.5 V, the reduced dynamic range causes the gradation expression to fall as shown in a diagram of FIG. 9. For this reason, a sufficient dynamic range is assured by adoption of a method described as follows.

Figure 10A:
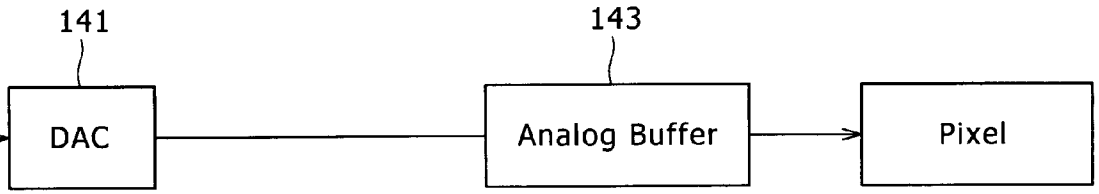
FIGS. 10A and 10B are each a diagram showing a process of sustaining the gradation expression of the reference driver according to the embodiment.
Figure 10B:
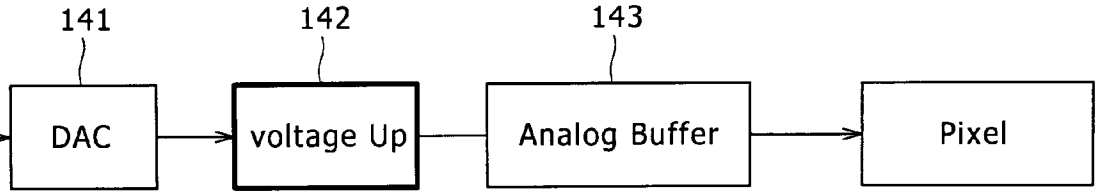

Each of FIGS. 10A and 10B is a diagram showing a process of sustaining the gradation expression of the reference driver 140 according to the embodiment.

In this embodiment, an operation to drive only the black side having large voltage changes is varied in order to increase the dynamic range. That is to say, a voltage boosting operation based on the capacitive coupling effect is not carried out only in the case of gradation zero. Let us assume for example that the gradation expression is implemented by making use of 64 gradations represented by 8 bits. In this case, the function of the voltage boosting section 142 is disabled only for gradation zero as shown in FIG. 10A. However, the function of the voltage boosting section 142 is enabled for gradations one to 63 as shown in FIG. 10B.

In this case, as the reference voltage Vref, a voltage of zero V is supplied to the reference driver 140 in the case of gradation zero, a voltage of zero V is supplied to the reference driver 140 in the case of gradation one and a voltage of 2.9 V is supplied to the reference driver 140 in the case of gradation 63. Thus, the dynamic range D-range is 2.9 V. As a result, in the case of gradation zero, an input voltage of zero V is supplied to an analog buffer 143 employed in the reference driver 140, in the case of gradation 1, an input voltage of 0.72 V is supplied to the analog buffer 143 and, in the case of gradation 63, an input voltage of 3.69 V is supplied to the analog buffer 143. Thus, the dynamic range D-range is 3.69 V.

As described above, in this embodiment, even if the input voltage received from the power-supply circuit 130 is 2.9 V, a dynamic range exceeding the voltage of the power supply circuit 130 can be assured.

That is to say, the dynamic range can be assured even for low voltages generated by the power-supply circuit 130.

Figure 11:
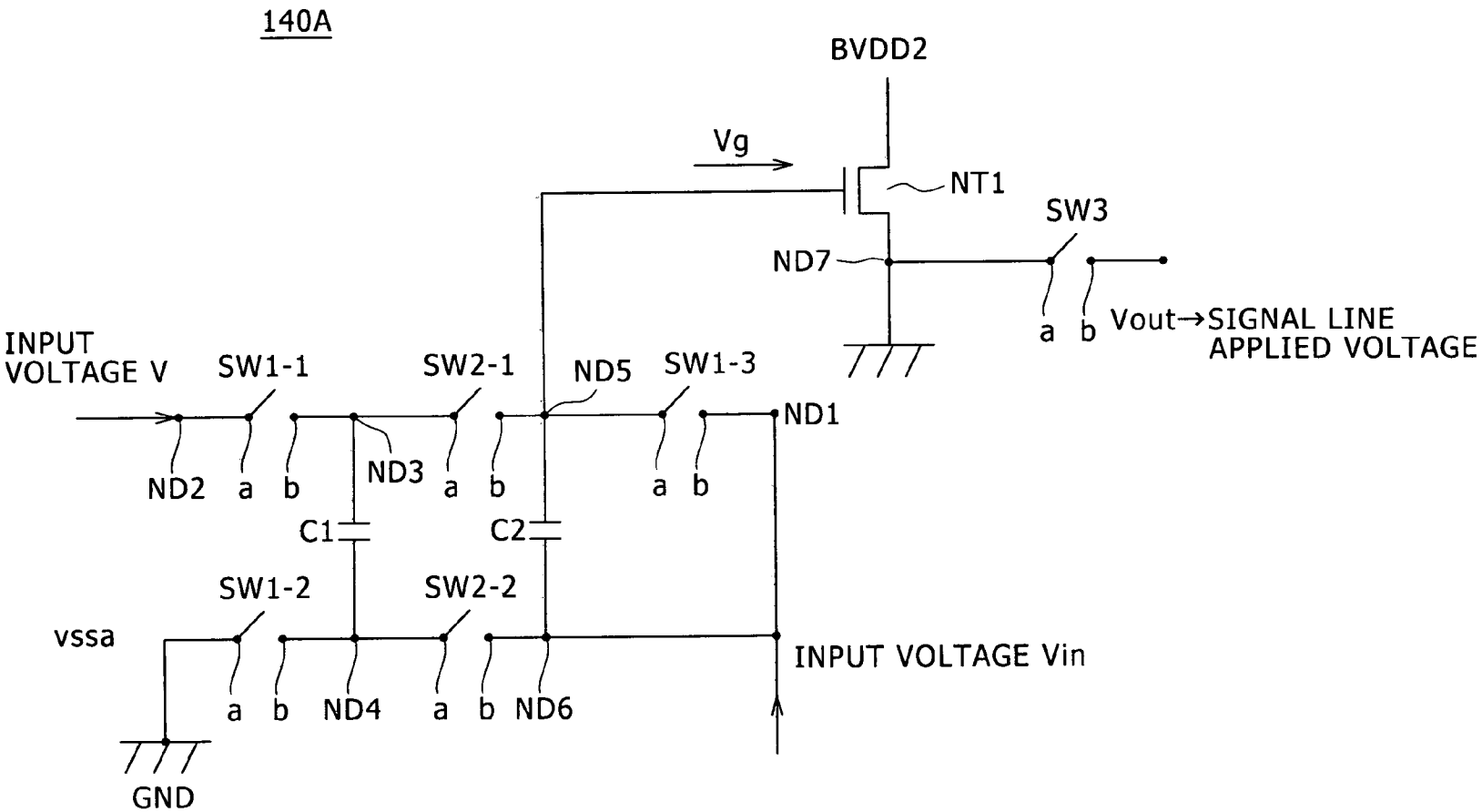
FIG. 11 is a diagram showing a basic equivalent circuit of the reference driver according to the embodiment.

FIG. 11 is a diagram showing a basic equivalent circuit of the reference driver 140A according to the embodiment.

Figure 12:
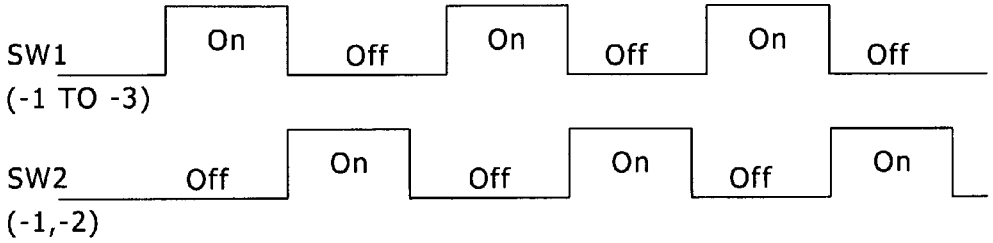
FIG. 12 shows timing charts of operations of switches employed in the reference driver shown in FIG. 11.
Figure 13A:
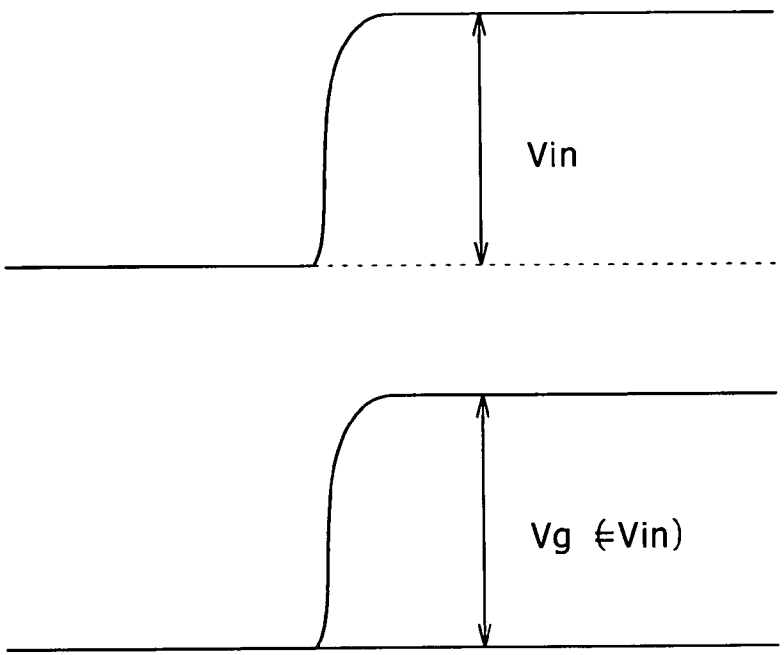
FIGS. 13A and 13B show timing charts of signals generated with and without a voltage boosting operation.
Figure 13B:
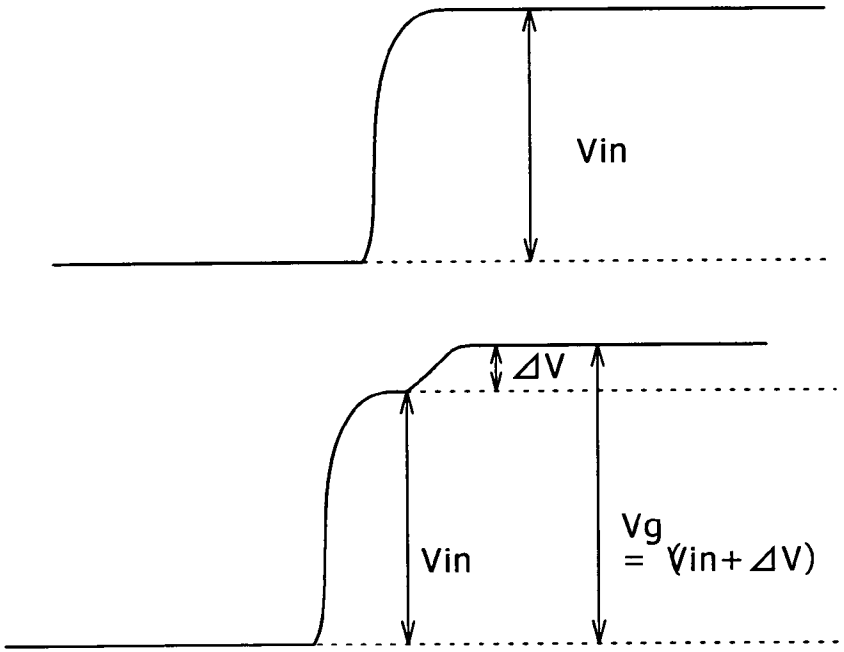

FIG. 12 shows timing charts of operations of switches employed in the reference driver 140A shown in FIG. 11. FIG. 13A is a diagram showing the waveform of a voltage generated without carrying out a voltage boosting operation whereas FIG. 13B is a diagram showing the waveform of the voltage generated by carrying out the voltage boosting operation.

The reference driver 140A employs switches SW1-1 to SW1-3, switches SW2-1 and SW2-2, an output-side switch SW3, a charging capacitor C1, a charge-pump capacitor C2, an NMOS (n-channel MOS) transistor NT1 forming a source follower as well as nodes ND1 to ND7. The switches SW1-1 to SW1-3 are put in a turned-on state with the same timings. By the same token, the switches SW2-1 and SW2-2 are put in a turned-on state with the same timings.

An input voltage Vin in the range zero to 2.9 V is supplied to the node ND1 whereas an input voltage V is supplied to the node ND2. The active contact point a of the switch SW1-1 is connected to the node ND2 whereas the passive contact point b of the switch SW1-1 is connected to the node ND3.

The active contact point a of the switch SW1-2 is connected to a reference electric potential such as the electric potential of the ground GND whereas the passive contact point b of the switch SW1-2 is connected to the node ND4.

The active contact point a of the switch SW1-3 is connected to the node ND5 whereas the passive contact point b of the switch SW1-3 is connected to the node ND1.

The active contact point a of the switch SW2-1 is connected to the node ND3 whereas the passive contact point b of the switch SW2-1 is connected to the node ND5.

The active contact point a of the switch SW2-2 is connected to the node ND4 whereas the passive contact point b of the switch SW2-2 is connected to the node ND6.

The first electrode of the charging capacitor C1 is connected to the node ND3 whereas the second electrode of the charging capacitor C1 is connected to the node ND4.

The first electrode of the charge-pump capacitor C2 is connected to the node ND5 whereas the second electrode of the charge-pump capacitor C2 is connected to the node ND6.

The drain electrode of the NMOS transistor NT1 is connected to a line supplying a power-supply voltage BVDD2, the source electrode of the NMOS transistor NT1 is connected to the GND electric potential through the node ND7 serving as the point of connection and the gate electrode of the NMOS transistor NT1 is connected to the node ND5.

This reference driver 140A is configured as a driving circuit allowing the input voltage thereof to be reduced and allowing its power consumption to be lowered.

If the reduced input voltage is output as a driving voltage as it is, however, a voltage applied to the liquid-crystal cell is also unavoidably low so that the desired dynamic range cannot be assured. In order for the reference driver 140A to be capable of assuring the desired dynamic range, a voltage boosting circuit is used to boost the input voltage so that it is possible to prevent the desired dynamic range from being lost.

Thus, the voltage boosting circuit employed in the reference driver 140A shown in FIG. 11 is used to assure that the voltage applied to the liquid-crystal cell has a sufficient dynamic range.

In the reference driver 140A, the switches SW1-1 to SW1-3 as well as the switches SW2-1 and SW2-2 are used in operations to accumulate electric charge in the charging capacitor C1 and the charge-pump capacitor C2 so as to boost the input voltage.

In the operations, during a period in which the switches SW1-1 to SW1-3 are in a turned-on state, the switches SW2-1 and SW2-2 are in a turned-off state. During a period in which the switches SW1-1 to SW1-3 are in a turned-off state, on the other hand, the switches SW2-1 and SW2-2 are in a turned-on state.

During the period in which the switches SW1-1 to SW1-3 are in a turned-on state, an electric charge Q is accumulated in the charging capacitor C1 in order to generate a bottom increasing voltage ΔV. During this period, the input voltage Vin is supplied to the electrode of the NMOS transistor NT1 as a gate voltage Vg.

When the period in which the switches SW1-1 to SW1-3 are in a turned-on state ends, the switches SW2-1 and SW2-2 are put in a turned-on state causing the charging capacitor C1 and the charge-pump capacitor C2 to exhibit a capacitive coupling effect. As a result, the bottom raising voltage ΔV is generated.

Let notation Q denote the amount of electric charge accumulated in the charging capacitor C1 whereas notation Q' denote the amount of electric charge accumulated in a compound capacitor consisting of the charging capacitor C1 and the charge-pump capacitor C2. In this case, the following equations hold true.

[Eqs. 2]

$$Q=C1*V\text{in}$$

$$Q'=(C1+C2)*\Delta V\ldots \quad (2)$$

In the above equations, notation Vin denotes the input voltage, notation ΔV denotes the bottom raising voltage, notation C1 denotes the capacitance of the charging capacitor C1 used for electrical charging and notation C2 denotes the capacitance of the charge-pump capacitor C2.

In accordance with the electric-charge conservation law, the equation Q=Q' holds true. Thus, from the 2 equations of Eqs. (2), the bottom raising voltage ΔV can be expressed as follows.

[Eq. 3]

$$\Delta V=V\text{in}*C1/(C1+C2) \quad (3)$$

The sum of the bottom raising voltage ΔV and the input voltage V is applied to the gate electrode of the source-follower NMOS transistor NT1 as a gate voltage Vg which is expressed as follows:

[Eq. 4]

$$Vg=V\text{in}+\Delta V \quad (4)$$

It is to be noted that the input voltage Vin is supplied to the reference driver 140A all the time without regards to the states of the switches SW1-1 to SW1-3 as well as SW2-1 and SW2-2. Thus, the input voltage Vin is output by the reference driver 140A as an output voltage Vout generated by the NMOS transistor NT1 so that the dynamic range is narrowed.

In order to solve the above problem, it is necessary to control the switch SW3 by putting the switch SW3 in a turned-off state when the source voltage of the NMOS transistor NT1 is equal to the input voltage Vin, that is, when the switches SW1 to SW3 are in a turned-on state, so that the output voltage Vout does not become equal to the input voltage Vin or the dynamic range is not narrowed.

In addition, the bottom raising voltage ΔV is a parameter used for adjusting a voltage applied to the liquid-crystal cell. As is obvious from Eq. (3), the magnitude of the bottom raising voltage ΔV is determined by the ratio of the capacitance C1 to the sum of the capacitances C1 and C2.

If the bottom raising voltage ΔV is set at an excessively large value, however, differences observed in expression of gradations as differences in voltage between the gradations inevitably increase so that it is necessary to pay attention to a problem of a poor color hue caused by the large differences.

By employing the reference driver 140A, however, a high voltage can be applied to the liquid-crystal cell even if the voltage generated by the power-supply circuit 130 is low. Thus, the dynamic range can be prevented from becoming narrow. That is to say, the power consumption is expected to decrease.

Figure 14:
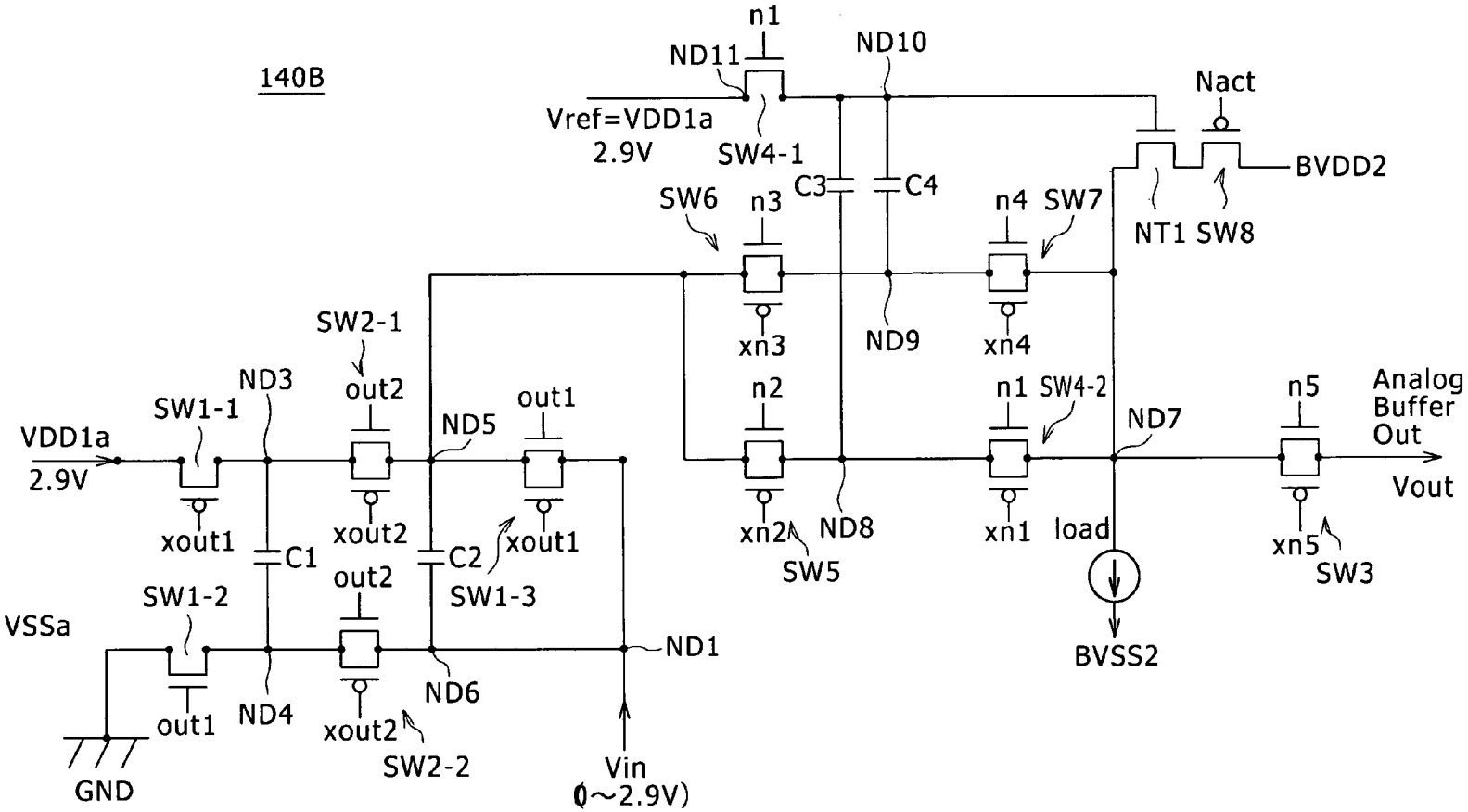
FIG. 14 is a circuit diagram showing a concrete typical configuration of another reference driver according to the embodiment.

FIG. 14 is a circuit diagram showing a concrete typical configuration of another reference driver 140B according to the embodiment.

Figure 15:
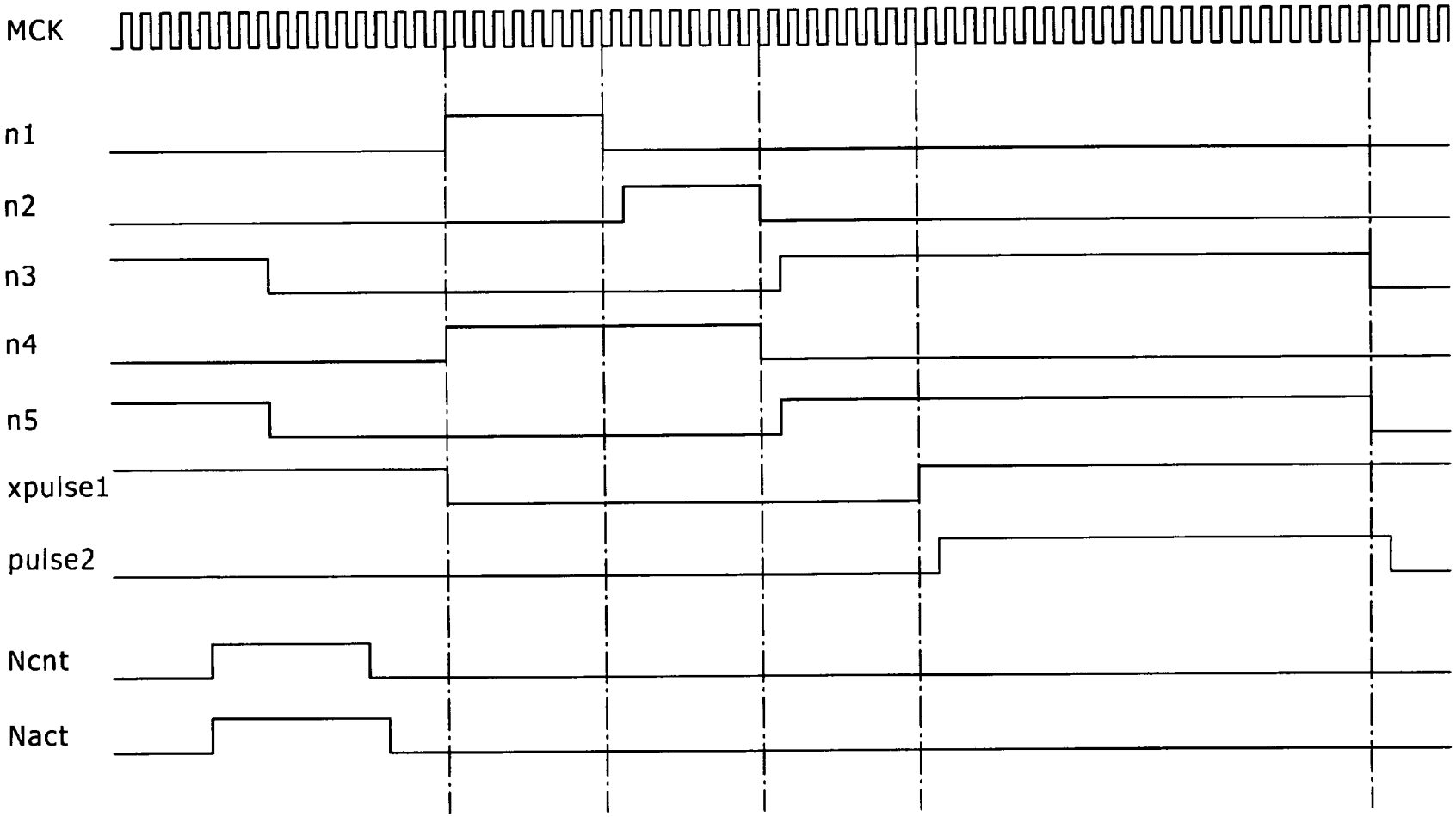
FIG. 15 shows timing charts of operations of switches employed in the reference driver shown in FIG. 14 and signals generated in the reference driver.

FIG. 15 shows timing charts of operations of switches.

In the reference driver 140B shown in the circuit diagram of FIG. 14, configuration elements identical with their respective counterparts employed in the equivalent circuit shown in the circuit diagram of FIG. 11 are denoted by the same reference numerals as the respective counterparts in order to make the explanation of the reference driver 140B easy to understand.

The reference driver 140B shown in the circuit diagram of FIG. 14 includes additional circuits such as an offset cancel circuit besides the configuration elements employed in the equivalent circuit shown in the circuit diagram of FIG. 11. In addition, the reference driver 140B also has switches SW4-1, SW4-2 and SW5 to SW8, capacitors C3 and C4, a current source I1 as well as nodes ND8 to ND11.

The switch SW1-1 is a PMOS transistor which is put in a turned-on or turned-off state in accordance with the existence of a pulse xout1 applied to the gate electrode of the transistor.

The switch SW1-2 is a PnMOS transistor which is put in a turned-on or turned-off state in accordance with the existence of a pulse out1 applied to the gate electrode of the transistor. The pulse out1 is the inverted pulse of the pulse xout1.

The switch SW1-3 includes an NMOS transistor and a PMOS transistor which together serve as a transfer gate. The sources of the NMOS transistor and the PMOS transistor are connected to each other whereas the drains of the NMOS transistor and the PMOS transistor are also connected to each other. The PMOS transistor is put in a turned-on or turned-off state in accordance with the existence of the pulse xout1 applied to the gate electrode of the transistor. On the other hand, the NMOS transistor is put in a turned-on or turned-off state in accordance with the existence of the pulse out1 applied to the gate electrode of the transistor.

By the same token, the switch SW2-1 includes an NMOS transistor and a PMOS transistor which together serve as a transfer gate. The sources of the NMOS transistor and the PMOS transistor are connected to each other whereas the drains of the NMOS transistor and the PMOS transistor are also connected to each other. The PMOS transistor is put in a turned-on or turned-off state in accordance with the existence of a pulse xout2 applied to the gate electrode of the transistor. On the other hand, the NMOS transistor is put in a turned-on or turned-off state in accordance with the existence of a pulse out2 applied to the gate electrode of the transistor. The pulse out2 is the inverted pulse of the pulse xout2.

By the same token, the switch SW2-2 includes an NMOS transistor and a PMOS transistor which together serve as a transfer gate. The sources of the NMOS transistor and the PMOS transistor are connected to each other whereas the drains of the NMOS transistor and the PMOS transistor are also connected to each other. The PMOS transistor is put in a turned-on or turned-off state in accordance with the existence of the pulse xout2 applied to the gate electrode of the transistor. On the other hand, the NMOS transistor is put in a turned-on or turned-off state in accordance with the existence of the pulse out2 applied to the gate electrode of the transistor.

Figure 16:
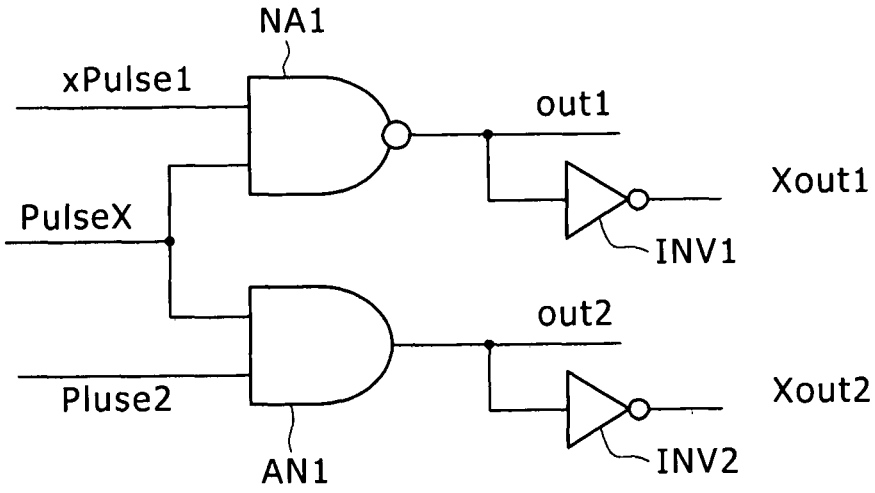
FIG. 16 is a diagram showing a typical configuration of a pulse generation circuit for generating pulses used for controlling the turned-on and turned-off states of the switches employed in the reference driver shown in FIG. 14.

FIG. 16 is a diagram showing a typical configuration of a pulse generation circuit for generating the pulses. The pulse generation circuit employs a 2-input NAND gate NA1, a 2-input AND gate AN1 as well as inventers INV1 and INV2.

The first input terminal of the 2-input NAND gate NA1 receives a signal xPulse1 whereas the second input terminal of the 2-input NAND gate NA1 receives a signal PulseX.

By the same token, the first input terminal of the 2-input AND gate AN1 receives a signal Pulse2 whereas the second input terminal of the 2-input AND gate AN1 receives the signal PulseX. The 2-input AND gate AN1 outputs the pulse out2. The 2-input AND gate AN1 also outputs the pulse xout2 by way of the inverter INV2.

The signal PulseX can be set at a high or low level. The signal PulseX is set at a high level in order to carry out a voltage boosting operation but set at a low level in order to carry out a normal operation.

The switch SW4-1 is an NMOS transistor connected between the nodes ND11 and ND10. A pulse n1 is supplied to the gate electrode of the NMOS transistor to control the turned-on and turned-off states of the transistor.

The switch SW4-2 includes an NMOS transistor and a PMOS transistor which together serve as a transfer gate. The sources of the NMOS transistor and the PMOS transistor are connected to each other whereas the drains of the NMOS transistor and the PMOS transistor are also connected to each other. The switch SW4-2 is connected between the nodes ND7 and ND8. The PMOS transistor is put in a turned-on or turned-off state in accordance with the existence of a pulse xn1 applied to the gate electrode of the transistor. On the other hand, the NMOS transistor is put in a turned-on or turned-off state in accordance with the existence of the pulse n1 applied to the gate electrode of the transistor. The pulse xn1 is the inverted pulse of the pulse n1.

The switch SW5 includes an NMOS transistor and a PMOS transistor which together serve as a transfer gate. The sources of the NMOS transistor and the PMOS transistor are connected to each other whereas the drains of the NMOS transistor and the PMOS transistor are also connected to each other. The switch SW5 is connected between the nodes ND5 and ND8. The PMOS transistor is put in a turned-on or turned-off state in accordance with the existence of a pulse xn2 applied to the gate electrode of the transistor. On the other hand, the NMOS transistor is put in a turned-on or turned-off state in accordance with the existence of a pulse n2 applied to the gate electrode of the transistor. The pulse n2 is the inverted pulse of the pulse xn2.

The switch SW6 includes an NMOS transistor and a PMOS transistor which together serve as a transfer gate. The sources of the NMOS transistor and the PMOS transistor are connected to each other whereas the drains of the NMOS transistor and the PMOS transistor are also connected to each other. The switch SW6 is connected between the nodes ND5 and ND9. The PMOS transistor is put in a turned-on or turned-off state in accordance with the existence of a pulse xn3 applied to the gate electrode of the transistor. On the other hand, the NMOS transistor is put in a turned-on or turned-off state in accordance with the existence of a pulse n3 applied to the gate electrode of the transistor. The pulse xn3 is the inverted pulse of the pulse n3.

The switch SW7 includes an NMOS transistor and a PMOS transistor which together serve as a transfer gate. The sources of the NMOS transistor and the PMOS transistor are connected to each other whereas the drains of the NMOS transistor and the PMOS transistor are also connected to each other. The switch SW7 is connected between the nodes ND7 and ND9. The PMOS transistor is put in a turned-on or turned-off state in accordance with the existence of a pulse xn4 applied to the gate electrode of the transistor. On the other hand, the NMOS transistor is put in a turned-on or turned-off state in accordance with the existence of a pulse n4 applied to the gate electrode of the transistor. The pulse xn4 is the inverted pulse of the pulse n4.

The switch SW8 is a PMOS transistor. The drain electrode of the switch SW8 is connected to the drain electrode of the NMOS transistor NT1 serving as a source follower. The source electrode of the switch SW8 is connected to a line supplying a power-supply voltage BVDD2. A signal Nact is supplied to the gate electrode of the switch SW8 to control the turned-on and turned-off states of the switch.

The first electrode of the offset cancellation capacitor C3 is connected to the node ND10 whereas the second electrode of the offset cancellation capacitor C3 is connected to the node ND8. On the other hand, the first electrode of the capacitor C4 is connected to the node ND10 whereas the second electrode of the capacitor C4 is connected to the node ND9.

The current source I1 is connected to the node ND7 which is wired to the source electrode of the NMOS transistor NT1.

At a time t1, the signal xPulse1 is changed from a high level to a low level whereas the signal Pulse2 is at a low level. Thus, the pulse out1 set at a high level and the pulse xout1 set at a low level are supplied to the switches SW1-1 to SW1-3. On the other hand, the pulse out2 set at a low level and the pulse xout1 set at a high level are supplied to the switches SW2-1 and SW2-2.

As a result, each of the switches SW1-1 to SW1-3 is put in a turned-on state whereas each of the switches SW2-1 and SW2-2 is put in a turned-off state, causing an electric charge Q to be accumulated in the charging capacitor C1.

In addition, at the time t1, each of the pulses n1 and n4 is changed from a low level to a high level in order to put each of the switches SW4-1, SW4-2 and SW7 in a turned-off state. In this state, the reference voltage Vref is applied to the offset cancellation capacitor C3 and the capacitor C4 whereas a voltage determined in advance is applied between the gate and source of the NMOS transistor NT1. Thus, an offset cancellation process is carried out on the threshold voltage of the NMOS transistor NT1.

Then, at a time t2, the pulse n1 is changed from a high level to a low level, putting each of the switches SW4-1 and SW4-2 in a turned-on state. Afterwards, with a timing determined in advance, the pulse n2 is changed to a high level in order to put the switch SW5 in a turned-on state. Thus, the input voltage Vin is propagated to the switches SW1-3 and SW5, the node ND8 and the offset cancellation capacitor C3 to be finally supplied to the node ND7 by way of the capacitor C4 and the switch SW7.

Then, at a time t3, the pulses n2 and n4 are changed from a high level to a low level in order to put each of the switches SW5 and SW7 in a turned-off state.

At the time t3, the offset cancellation process is ended.

Then, with a timing determined in advance, each of the pulses n3 and n5 is changed to a high level in order to put each of the switches SW6 and SW3 in a turned-on state.

In this state, at a time t4, the signal xPulse1 is changed from a low level to a high level. Afterwards, with a timing determined in advance, the signal Pulse2 is changed from a low level to a high level. As a result, each of the switches SW1-1 to SW1-3 is put in a turned-off state. Then, each of the switches SW2-1 and SW2-2 is put in a turned-on state. Thus, the charging capacitor C1 and the charge-pump capacitor C2 produce a capacitive coupling effect. As a result, the bottom raising voltage ΔV is generated. This mechanism is what has been explained with reference to the equivalent circuit.

In this reference driver 140, if an input voltage with a dynamic range insufficient for a gradation display is received, only the driving operation on the black side with large variations in voltage is changed. That is to say, in the case of gradation zero, the function of the voltage boosting section 142 is disabled. In the case of gradations one to 63, on the other hand, the function of the voltage boosting section 142 is enabled. Thus, the power consumption can be reduced and a dynamic range sufficient for a gradation display can be obtained.

In the case of a driving operation in the 3.5 V system, the power consumption is reduced from 7.5 mW to about 5.5 mW, or a power-consumption decrease of about 33.3% is obtained.

Next, functions and configuration of the monitor circuit 120 are explained.

As described earlier, the monitor circuit 120 provided at a location adjacent to the effective pixel section 101 (in FIG. 4, a location on the right side of the effective pixel section 101) includes the first monitor pixel section 107-1 having one monitor pixel or a plurality of monitor pixels, the second monitor pixel section 107-2 also having one monitor pixel or a plurality of monitor pixels, the vertical driving circuit (V/CSDRVM) 108 serving as a vertical driving circuit common to the first monitor pixel section 107-1 and the second monitor pixel section 107-2, the first monitor horizontal driving circuit (HDRVM1) 109-1 designed specially for the first monitor pixel section 107-1, the second monitor horizontal driving circuit (HDRVM2) 109-2 designed specially for the first monitor pixel section 107-1 and the detection-result output circuit 110.

The configuration of a monitor (dummy) pixel circuit or each of monitor (dummy) pixel circuits included in the first monitor pixel section 107-1 and the second monitor pixel section 107-2 is basically identical with the configuration of each of pixel circuits included in the effective pixel section 101.

Figure 17A:
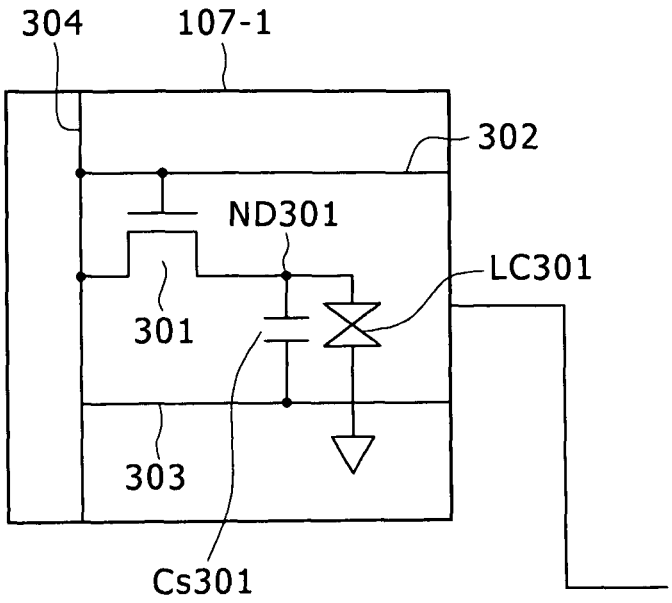
Figure 17B:
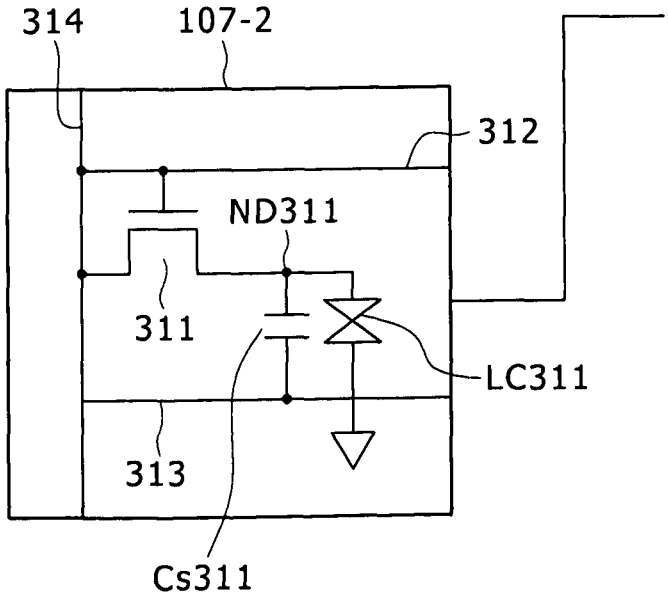
FIG. 17B is a diagram showing a typical configuration of a monitor pixel employed in a second monitor pixel section.

FIG. 17A is a diagram showing a typical configuration of the first monitor pixel circuit PXLCM1 included in the first monitor pixel section 107-1 whereas FIG. 17B is a diagram showing a typical configuration of the second monitor pixel circuit PXLCM2 included in the second monitor pixel section 107-2.

As shown in FIG. 17A, the first monitor pixel circuit PXLCM1 included in the first monitor pixel section 107-1 employs a thin-film transistor TFT301 serving as a switching device, a liquid-crystal cell LC301 and a storage capacitor Cs301. The first pixel electrode of the liquid-crystal cell LC301 is connected to the drain electrode (or the source electrode) of the thin-film transistor TFT301. The first electrode of the storage capacitor Cs301 is also connected to the drain electrode (or the source electrode) of the thin-film transistor TFT301.

It is to be noted that the first pixel electrode of the liquid-crystal cell LC301, the drain electrode (or the source electrode) of the thin-film transistor TFT301 and the first electrode of the storage capacitor Cs301 form a node ND301.

The gate electrode of the thin-film transistor TFT301 employed in the first monitor pixel circuit PXLCM1 is connected to a gate line 302 common to all first pixel circuits PXLCM1 provided on a row.

The second electrode of the storage capacitor Cs301 employed in the first monitor pixel circuit PXLCM1 is connected to a capacitor line 303 common to all first pixel circuits PXLCM1 provided on a row.

The source electrode (or the drain electrode) of the thin-film transistor TFT301 employed in the first monitor pixel circuit PXLCM1 is connected to a signal line 304.

The second electrode of the liquid-crystal cell LC301 employed in the first monitor pixel circuit PXLCM1 is connected to a supply line 112 for conveying for example the common voltage Vcom with a small amplitude and a polarity inverted every horizontal scan period. In the following description, a horizontal scan period is referred to as 1H. The supply line 112 is a line common to all first monitor pixel circuits PXLCM1.

The gate line 302 is driven by a gate driver employed in the monitor vertical driving circuit 108 whereas the capacitor line 303 is driven by a capacitor driver (or a CS driver) also employed in the monitor vertical driving circuit 108. The signal line 304 is driven by a first monitor horizontal driving circuit 109-1.

As shown in FIG. 17B, the second monitor pixel circuit PXLCM2 included in the second monitor pixel section 107-2 employs a thin-film transistor TFT311 serving as a switching device, a liquid-crystal cell LC311 and a storage capacitor Cs311. The first pixel electrode of the liquid-crystal cell LC311 is connected to the drain electrode (or the source electrode) of the thin-film transistor TFT311. The first electrode of the storage capacitor Cs311 is also connected to the drain electrode (or the source electrode) of the thin-film transistor TFT311.

It is to be noted that the first pixel electrode of the liquid-crystal cell LC311, the drain electrode (or the source electrode) of the thin-film transistor TFT311 and the first electrode of the storage capacitor Cs311 form a node ND311.

The gate electrode of the thin-film transistor TFT311 employed in the second monitor pixel circuit PXLCM2 is connected to a gate line 312 common to all second pixel circuits PXLCM2 provided on a row.

The second electrode of the storage capacitor Cs311 employed in the second monitor pixel circuit PXLCM2 is connected to a capacitor line 313 common to all second pixel circuits PXLCM2 provided on a row.

The source electrode (or the drain electrode) of the thin-film transistor TFT311 employed in the second monitor pixel circuit PXLCM2 is connected to a signal line 314.

The second electrode of the liquid-crystal cell LC311 employed in the second monitor pixel circuit PXLCM2 is connected to the aforementioned supply line 112 for conveying for example the common voltage Vcom with a small amplitude and a polarity inverted every horizontal scan period. In the following description, a horizontal scan period is referred to as 1H.

The gate line 312 is driven by a gate driver employed in the monitor vertical driving circuit 108 whereas the capacitor line 313 is driven by a capacitor driver (or a CS driver) also employed in the monitor vertical driving circuit 108. The signal line 314 is driven by a second monitor horizontal driving circuit 109-2.

In the typical configuration shown in FIG. 4, the monitor vertical driving circuit 108 is a circuit common to the first monitor pixel section 107-1 and the second monitor pixel section 107-2. The basic function of the monitor vertical driving circuit 108 is identical with the function of the vertical driving circuit 102 for driving the effective pixel section 101.

By the same token, the basic functions of the first monitor horizontal driving circuit 109-1 and the second monitor horizontal driving circuit 109-2 are each identical with the function of the horizontal driving circuit 103 for driving the effective pixel section 101.

When the first monitor pixel circuit PXLCM1 employed in the first monitor pixel section 107-1 is driven as a pixel circuit having a positive polarity, the second monitor pixel circuit PXLCM2 employed in the second monitor pixel section 107-2 is driven as a pixel circuit having a negative polarity. When the first monitor pixel circuit PXLCM1 employed in the first monitor pixel section 107-1 is driven as a pixel circuit having a negative polarity, on the other hand, the second monitor pixel circuit PXLCM2 employed in the second monitor pixel section 107-2 is driven as a pixel circuit having a positive polarity.

The method for driving the effective pixel section 101 in accordance with this embodiment is basically a method whereby, after the falling edge of a gate pulse GP asserted on a specific one of the gate lines 104-1 to **104-*m*, that is, after pixel video data from a signal line (that is, one of the signal lines 106-1 to 106-*n*) is written into a pixel circuit PXLC connected to the specific gate line 104, the capacitor lines 105-1 to 105-*m* each connected independently for one of the rows are driven as described above, resulting in a capacitive coupling effect of the storage capacitor Cs201 employed in each of the pixel circuits PXLC and, in each of the pixel circuits PXLC, an electric potential appearing on the node ND201 is changed due to the capacitive coupling effect in order to modulate a voltage applied to the liquid-crystal cell LC201**.

While a driving operation is being carried out in accordance with the driving method, the detection-result output circuit 110 employed in the monitor circuit 120 detects a midpoint of the electric potentials of the monitor pixel electric potentials having positive and negative polarities as a midpoint of the electric potential. The monitor pixel electric potentials having positive and negative polarities are the first monitor pixel circuit PXLCM1 driven as a pixel circuit having a positive or negative polarity and the second monitor pixel circuit PXLCM2 driven as a pixel circuit having a negative or positive polarity. The electric potential of the first monitor pixel circuit PXLCM1 is an electric potential appearing on the node ND301 whereas the electric potential of the second monitor pixel circuit PXLCM2 is an electric potential appearing on the node ND311.

The monitor circuit 120 then outputs a midpoint of the electric potential from an output circuit 125 employed in the detection-result output circuit 110 in order to adjust the center value of the common voltage Vcom.

Figure 18:
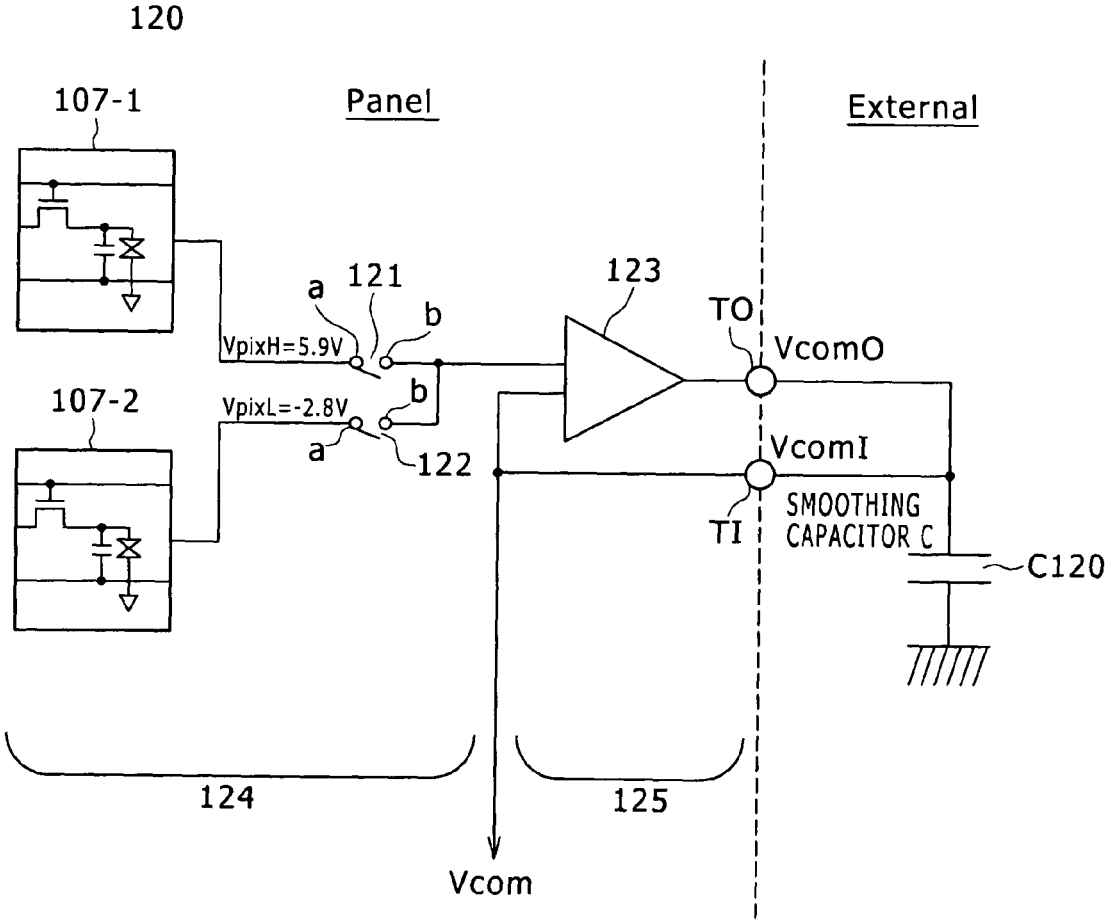
FIG. 18 is a diagram referred to in description of the basic concept of a monitor circuit according to the embodiment.

FIG. 18 is a diagram referred to in description of the basic concept of the monitor circuit 120 according to the embodiment. The monitor circuit 120 is shown in FIG. 18 as a circuit not including the monitor vertical driving circuit 108, the first monitor horizontal driving circuit 109-1 and the second monitor horizontal driving circuit 109-2 only to make the diagram simple.

In addition, in the monitor circuit 120 shown in FIG. 18, as an example, the first monitor pixel section 107-1 is driven as a pixel circuit having a positive polarity whereas the second monitor pixel section 107-2 is driven as a pixel circuit having a negative polarity.

The detection-result output circuit 110 included in the monitor circuit 120 shown in FIG. 18 employs switches 121 and 122 as well as a comparison-result output section 123.

A smoothing capacitor C120 outside the liquid-crystal display panel is connected to an output terminal TO and an input terminal TI, which face the outside of the liquid-crystal display panel. In this case, by the liquid-crystal display panel, the active-matrix display apparatus 100 shown in FIG. 4 is meant. The smoothing capacitor C120 is a capacitor for smoothing the common voltage Vcom.

The first monitor pixel section 107-1, the second monitor pixel section 107-2 as well as the switches 121 and 122, which are employed in the monitor circuit 120, form a midpoint electric-potential detection circuit 124. On the other hand, the comparison-result output section 123 functions as the output circuit 125 cited above.

The active contact point a of the switch 121 is connected to a terminal supplying an electric potential detected by the first monitor pixel section 107-1 whereas the passive contact point b of the switch 121 is connected to the first input terminal of the comparison-result output section 123.

By the same token, the active contact point a of the switch 122 is connected to a terminal supplying an electric potential detected by the second monitor pixel section 107-2 whereas the passive contact point b of the switch 122 is also connected to the first input terminal of the comparison-result output section 123.

That is to say, the passive contact points b of the switches 121 and 122 are both connected to the first input terminal of the comparison-result output section 123 through a connection point which serves as a node ND121.

The second input terminal of the comparison-result output section 123 is connected to a connection point serving as a node ND122 between the input terminal TI and the line 112 supplying the common voltage Vcom. The comparison-result output section 123 supplies the common voltage Vcom having the center value thereof adjusted to the output terminal TO.

Figure 19:
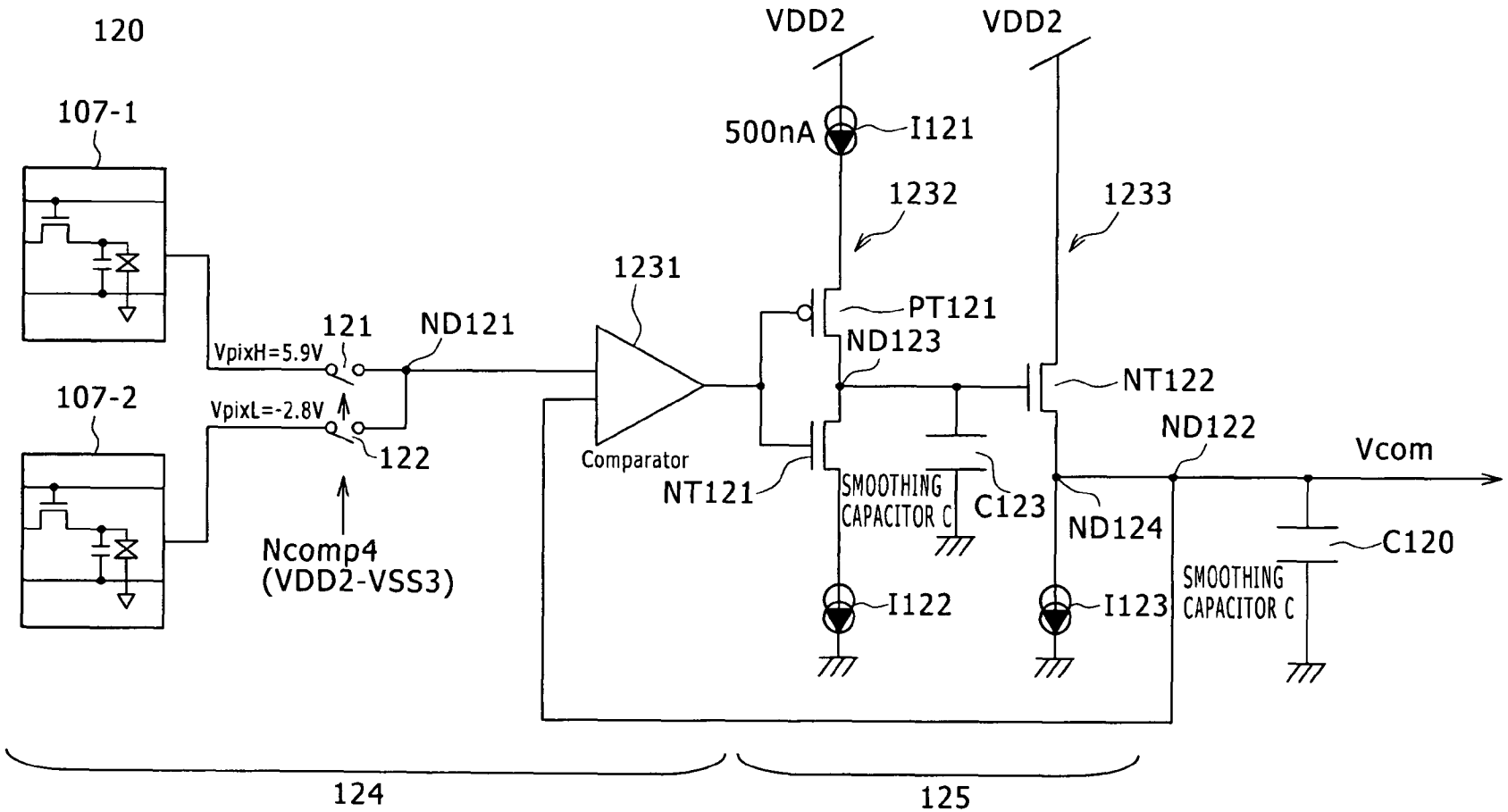
FIG. 19 is a diagram showing a concrete typical configuration of a comparison output section employed in the monitor circuit shown in FIG. 18 as the monitor circuit according to the embodiment.

FIG. 19 is a diagram showing a concrete typical configuration of the comparison output section 123 employed in the monitor circuit 120 according to the embodiment.

The comparison-result output section 123 shown in FIG. 19 employs a comparator 1231, a constant-current-source having inverter 1232, a source follower 1233 and a smoothing capacitor C123.

The comparator 1231 is a component for comparing a midpoint electric potential VMHL appearing at the node ND121 with the output of the source follower 1233 and outputting an electric-potential difference representing the result of the comparison to the constant-current-source having inverter 1232.

The constant-current-source having inverter 1232 has a constant current source I121, a constant current source I122, a PMOS (p-channel MOS) PT121 and an NMOS (n-channel MOS) NT121.

Both the gate electrode of the PMOS transistor PT121 and the gate electrode of the NMOS transistor NT121 are connected to the output of the comparator 1231. The drain electrode of the PMOS transistor PT121 and the drain electrode of the NMOS transistor NT121, which are connected to each other, are wired to the input of the source follower 1233 through a node ND123 serving as a point of connection.

The source of the PMOS transistor PT121 is wired to the constant current source I121 which is connected to a 5V-system panel voltage VDD2.

On the other hand, the source of the NMOS transistor NT121 is wired to the constant current source I122 which is connected to a reference electric potential VSS such as the electric potential of the ground GND.

The constant-current-source having inverter 1232 functions as a CMOS inverter including the constant current source I121 on the power-supply electric-potential side and the constant current source I122 on the reference electric-potential side. The constant current source I121 supplies a constant current having a typical magnitude of 500 nA to the PMOS transistor PT121. On the other hand, the constant current source I122 draws a constant current having a typical magnitude of 500 nA from the NMOS transistor NT121.

The source follower 1233 employs a NMOS transistor NT122 and a constant current source I123.

The gate electrode of the NMOS transistor NT122 is connected to the node ND123 serving as the output node of the constant-current-source having inverter 1232. The drain of the NMOS transistor NT122 is wired to the 5V-system panel voltage VDD2. On the other hand, the source of the NMOS transistor NT122 is wired to a constant current source I123 through a connection point which serves as a node ND124. The node ND124 is connected to a node ND122 which is a connection point between the second input terminal of the comparator 1231 and the output terminal TO.

The constant current source I123 is connected to the reference electric potential VSS such as the electric potential of the ground GND.

In the configurations described above, the comparison-result output section 123 automatically adjusts the center value of the common voltage Vcom so as to follow the midpoint electric potential VMHL detected by the midpoint electric-potential detection circuit 124.

Figure 20:
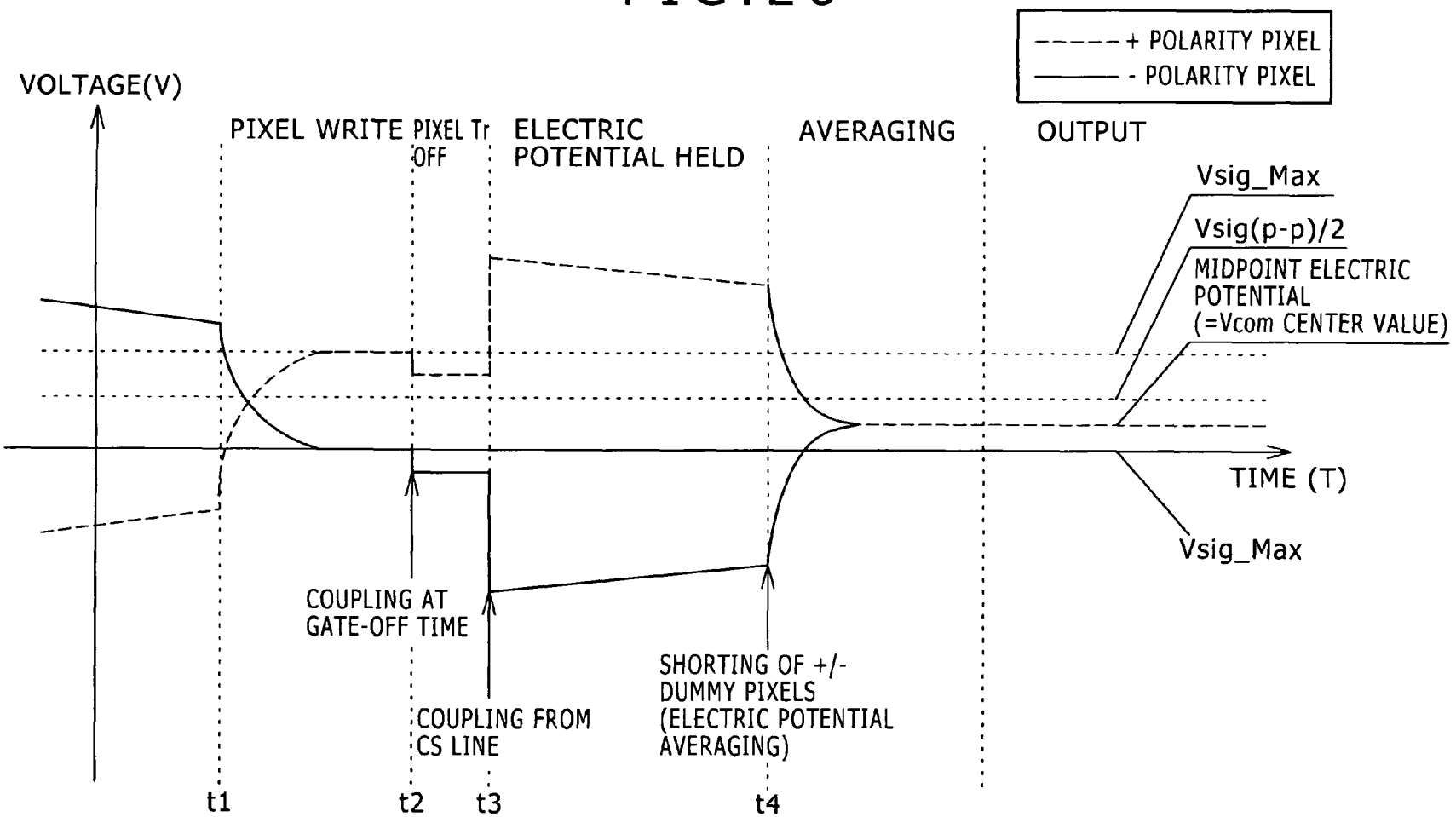
FIG. 20 is a diagram showing the waveforms of signals appearing along the time axis during processing carried out by adoption of a driving method according to the embodiment.

FIG. 20 is a diagram showing the waveforms of signals appearing along the time axis during processing carried out by adoption of the driving method according to the embodiment.

As shown in FIG. 20, at a time t1, pixel video data from signal lines 106-1 to **106-*n* is written into pixel circuits PXLC. Then, at a later time t2 after the lapse of a time period determined in advance since the time t1, gate pulses asserted on the gate lines 104-1 to 104-*n* are pulled down in order to put the transistor TFT201** employed in each of the pixel circuits PXLC in a turned-off state.

Thereafter, at a time t3, the capacitor lines 105-1 to **105-*m* each connected independently for one of the rows are driven, resulting in a capacitive coupling effect of the storage capacitor Cs201 employed in each of the pixel circuits PXLC and, in each of the pixel circuits PXLC, an electric potential appearing on the node ND201 is changed due to the capacitive coupling effect in order to modulate a voltage applied to the liquid-crystal cell LC201**.

After the two electric potentials generated by the first monitor pixel section 107-1 and the second monitor pixel section 107-2 respectively are sustained for a time period determined in advance, each of the switches 121 and 122 employed in the midpoint electric-potential detection circuit 124 is put in a turned-on state at a time t4 in order to short detection lines, which convey the two electric potentials, to each other at the node ND121. As a result, a midpoint electric potential appears at the node ND121.

In the typical configuration shown in each of the diagrams of FIGS. 18 and 19, the positive-polarity pixel electric potential VpixH generated in the first monitor pixel circuit PXLCM1 of the first monitor pixel section 107-1 including pixel circuits each having the positive polarity is 5.9 V whereas the negative-polarity pixel electric potential VpixL generated in the second monitor pixel circuit PXLCM1 of the second monitor pixel section 107-2 including pixel circuits each having the negative polarity is −2.8 V.

Thus, the detected midpoint electric potential VMHL has a magnitude of 1.55 V and is supplied from the midpoint electric-potential detection circuit 124 to the comparison-result output section 123 at the time t4.

The comparison-result output section 123 automatically adjusts the center value of the common voltage Vcom so as to follow the midpoint electric potential VMHL detected by the midpoint electric-potential detection circuit 124.

The following description explains the reason why a system for automatically adjusting the center value of the common voltage Vcom is provided in the active-matrix display apparatus 100 serving as a liquid-crystal display panel.

If the center value of the common voltage Vcom is not adjusted, there will be raised a problem that flickers are generated on the display screen. In addition, since the voltage applied to the liquid-crystal cell for a positive polarity is different from the voltage applied to the liquid-crystal cell for a negative polarity, a burn-in problem is raised.

As solutions to these problems, in an inspection process carried out at a shipping time at the factory, it is necessary to adjust the center value of the common voltage Vcom before the product is shipped from the factory. It is thus necessary to separately provide an adjustment circuit for the inspection process and, as a result, cumbersome-labor hours are required.

In addition, even if the center value of the common voltage Vcom is adjusted in the inspection process, after the active-matrix display apparatus 100 serving as the liquid-crystal display panel is shipped, the center value of the common voltage Vcom may be shifted from an optimum value due to the temperature of an environment in which the liquid-crystal display panel serving as the active-matrix display apparatus 100 is used, the driving method, the driving frequency, the backlight (B/L) luminance, the luminance of incoming light and a continuous usage.

Since the active-matrix display apparatus 100 includes a system for automatically adjusting the center value of the common voltage Vcom in the liquid-crystal display panel, therefore, the inspection process requiring the cumbersome-labor hours is not needed. Thus, even if the center value of the common voltage Vcom is shifted from an optimum value due to the temperature of an environment in which the liquid-crystal display panel serving as the active-matrix display apparatus 100 is used, the driving method, the driving frequency, the backlight (B/L) luminance or the luminance of incoming light, the system for automatically adjusting the center value of the common voltage Vcom is capable of sustaining the center value of the common voltage Vcom at a value optimum for the environment. As a result, the active-matrix display apparatus 100 offers a merit of the capability of appropriately preventing flickers from being generated on the display screen.

In addition, the electric potential appearing in a display pixel circuit employed in the effective pixel section 101 changes due a capacitive coupling effect occurring on the falling edge of a gate line connected to the pixel circuit or a leak current flowing through the thin-film transistor TFT201 employed in the pixel circuit. As a result, the optimum center value of the common voltage Vcom needs to be changed too. In the case of this embodiment, however, the center value of the common voltage Vcom is always adjusted to an optimum value so that it is possible to avoid an effect of the changes of the electric potential appearing in the effective pixel circuit on the quality of the displayed picture.

The following description explains a mechanism of the changes of the electric potential appearing in the effective pixel circuit.

Figure 21:
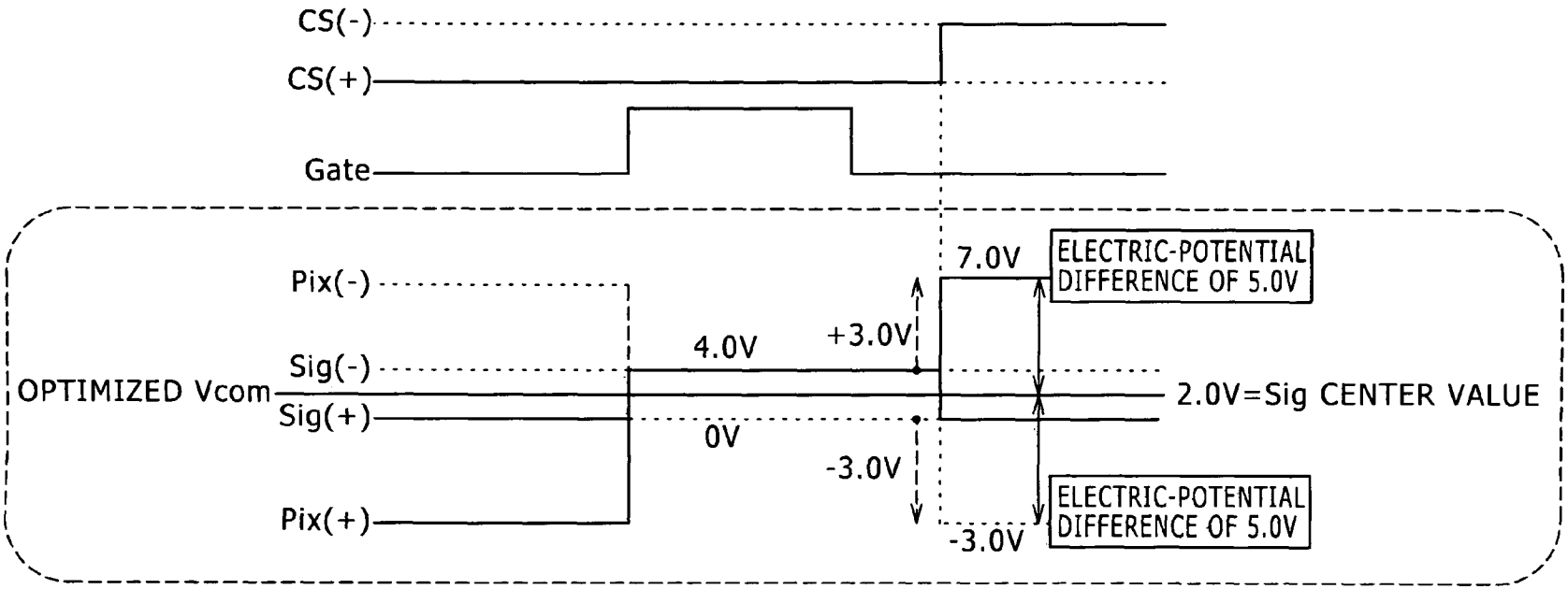
FIG. 21 is a diagram showing an ideal state obtained as a result of execution of the driving method according to the embodiment.

FIG. 21 is a diagram showing an ideal state obtained as a result of execution of the driving method according to the embodiment. It is to be noted that, in order to make the following description easy to understand, the values of voltages and other quantities shown in FIG. 21 may be different from those for the actual driving operation.

As shown in FIG. 21, in the ideal state, the electric potential appearing in a pixel circuit is vibrating at an amplitude symmetrical with respect to the center value of the video signal Sig.

If the difference in electric potential between the pixel electric potential Pix with the positive (+) polarity and the common voltage Vcom and the difference in electric potential between the pixel electric potential Pix with the negative (−) polarity and the common voltage Vcom are uniform, no differences in luminance are generated and, hence, no flickers are seen on the display screen.

That is to say, if the difference in electric potential between the pixel electric potential Pix with the positive (+) polarity and the common voltage Vcom is equal to the difference in electric potential between the pixel electric potential Pix with the negative (−) polarity and the common voltage Vcom, the center value of the video signal Sig should be equal to the optimum common voltage Vcom.

In a pixel circuit, however, the actual optimum common voltage Vcom is lower than the center value of the video signal Sig. This difference is considered to be a difference caused by a capacitive coupling effect occurring on the falling edge of a gate line connected to the pixel circuit or a leak current flowing through the thin-film transistor TFT201 employed in the pixel circuit.

<Gate Coupling>

Figure 22A:
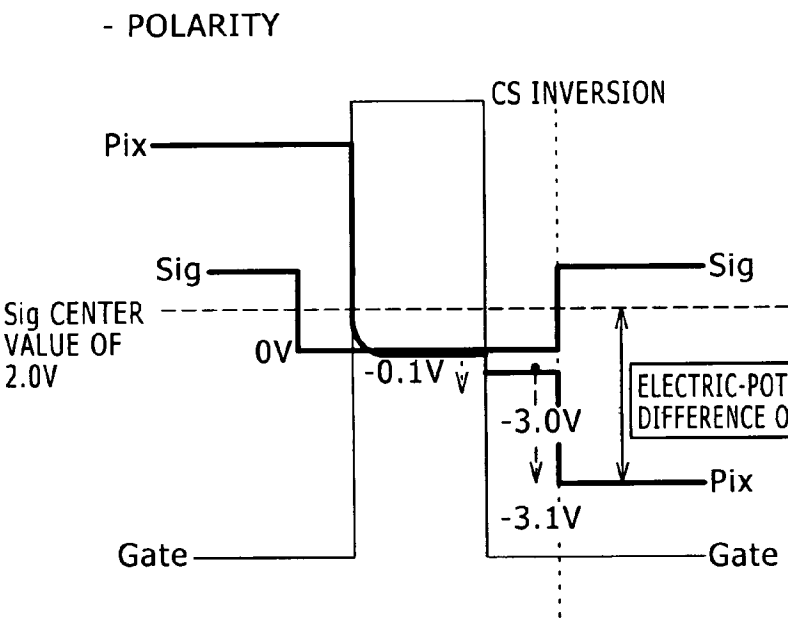
Figure 22B:
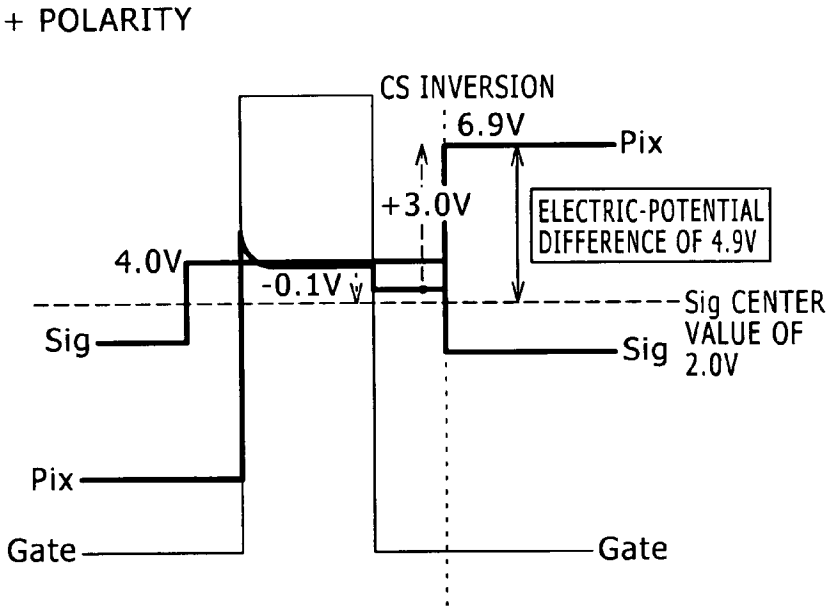
FIG. 22B is a diagram showing a relation between a gate pulse and the difference in electric potential between a pixel electric potential with the positive (+) polarity and the common voltage.

FIG. 22A is a diagram showing a relation between the gate pulse and the difference in electric potential between the pixel electric potential Pix with the negative (−) polarity and the common voltage Vcom whereas FIG. 22B is a diagram showing a relation between the gate pulse and the difference in electric potential between the pixel electric potential Pix with the positive (+) polarity.

The capacitive coupling effect caused by the gate electrode of the thin-film transistor TFT201 as a capacitive coupling effect oriented in the + direction is cancelled due to the fact that the thin-film transistor TFT201 is in a turned-on period. However, the capacitive coupling effect caused by the gate electrode of the thin-film transistor TFT201 as a capacitive coupling effect oriented in the − direction is not cancelled, causing the electric potential appearing in the pixel circuit to drop.

Thus, if the center value of the video signal Sig is equal to the common voltage Vcom (Vcom=Sig), the difference in electric potential between the pixel electric potential Pix with the positive (+) polarity and the common voltage Vcom is not equal to the difference in electric potential between the pixel electric potential Pix with the negative (−) polarity and the common voltage Vcom.

<Leak Currents of the Pixel Circuit Transistor>

Figure 23:
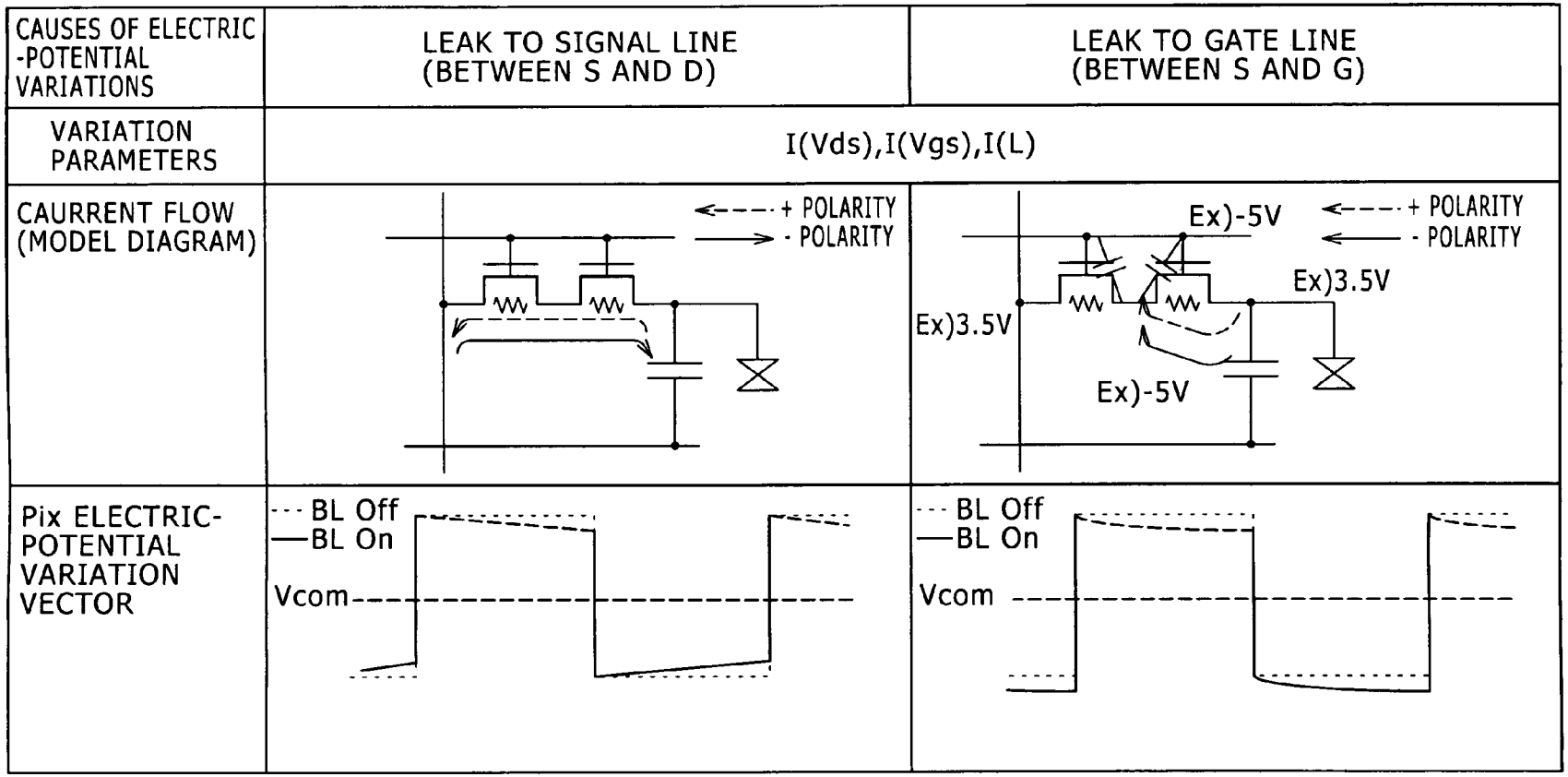
FIG. 23 is a diagram showing models of causes of leak currents each flowing through a transistor employed in a pixel circuit.

FIG. 23 is a diagram showing models of causes of leak currents each flowing through a TFT (thin-film transistor) employed in a pixel circuit.

A leak current flowing through a pixel circuit transistor can be a leak current flowing to a signal line or a leak current caused by electrical charging and discharging processes as a leak current flowing to a gate line. The leak current flowing to a signal line is a leak current flowing between the S (source) and D (drain) electrodes of the TFT serving as the pixel circuit transistor whereas the leak current flowing to a gate line is a leak current flowing between the S (source) and G (gate) electrodes of the TFT.

In the following description, the leak current flowing between the S (source) and D (drain) electrodes of the TFT is referred to as an S-D leak current whereas the leak current flowing between the S (source) and G (gate) electrodes of the TFT is referred to as an S-G leak current.

As a resultant result of a combination of the S-D and S-G leak currents, the pixel electric potential also referred to as an electric potential Pix drops. Thus, the pixel electric potential (or the electric potential Pix) is affected by causes such as a current increase caused by light as an increase in current Ioff and holding-periods variations caused by frequency changes.

Figure 24A:
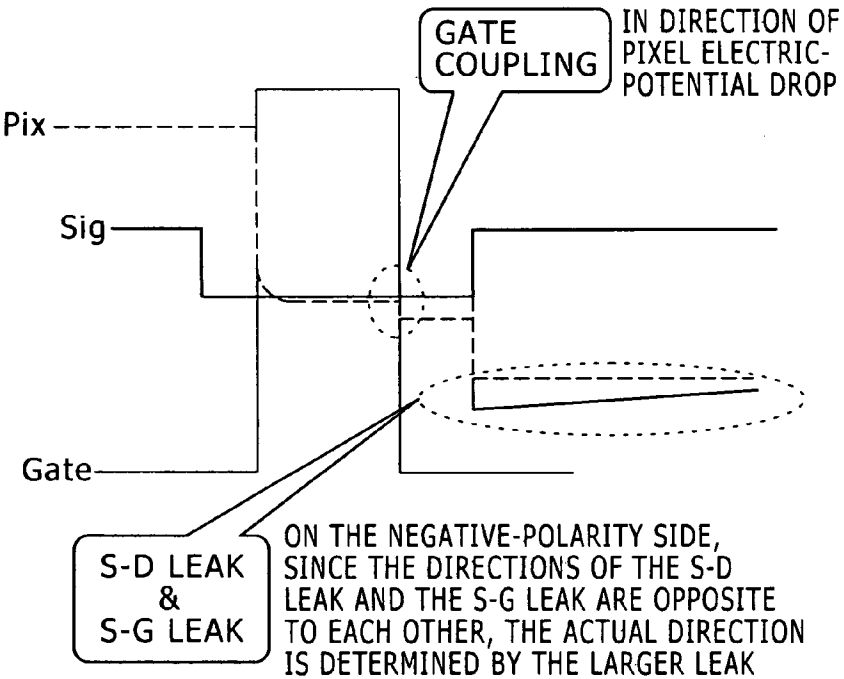
Figure 24B:
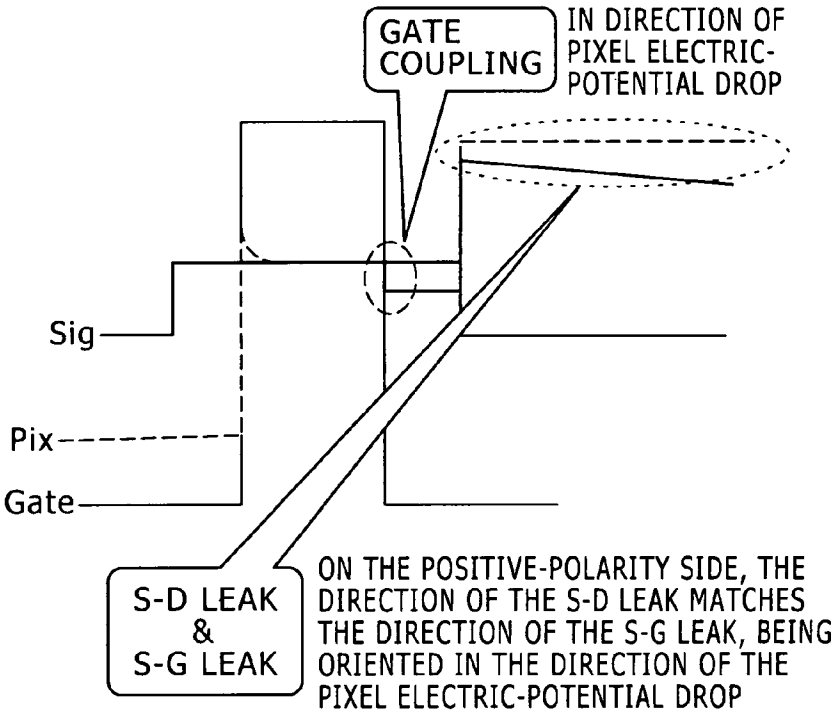
FIG. 24B is a diagram showing a state obtained as a result of a gate coupling effect and leak currents each flowing through a transistor employed in a pixel circuit in implementation of a driving method according to the embodiment for the positive (+) polarity.

FIG. 24A is a diagram showing a state obtained as a result of a gate coupling effect and leak currents each flowing through a transistor employed in a pixel circuit in implementation of a driving method according to the embodiment for the negative (−) polarity whereas FIG. 24B is a diagram showing a state obtained as a result of a gate coupling effect and leak currents each flowing through a transistor employed in a pixel circuit in implementation of a driving method according to the embodiment for the positive (+) polarity.

In each of the diagrams of FIGS. 24A and 24B, the dashed lines show the waveforms of signals obtained as a result of no gate coupling effect and no leak currents flowing through the transistor employed in the pixel circuit whereas the solid lines show the waveforms of signals obtained as a result of a gate coupling effect and leak currents each flowing through the transistor employed in the pixel circuit.

On the negative-polarity side, the direction of the S-D leak current is opposite to the direction of the S-G leak current. Thus, the actual direction is determined by the larger one of the S-D leak current and the S-G leak current.

On the positive-polarity side, on the other hand, the direction of the S-D leak current matches the direction of the S-G leak current, being oriented in the direction of a drop in pixel electric potential.

As described above, the gate coupling effect and the leak currents each flowing through a transistor employed in a pixel circuit cause the electric potential appearing in the pixel electric to drop so that the optimum common voltage Vcom is shifted in the downward direction.

In this embodiment, the center value of the common voltage Vcom is automatically adjusted as described above so that it is possible to eliminate effects of variations in effective pixel electric potential on the quality of the picture.

FIG. 25 is a table showing causes of variations in pixel electric potential as causes, the effects of which can be eliminated by automatically adjusting the center value of the common voltage Vcom in accordance with the embodiment. For the purpose of comparison, the table also shows causes of variations in pixel electric potential as causes, the effects of which can be eliminated by carrying out an inspection process. In the table of FIG. 25, a circle symbol indicates a cause, the effect of which can be eliminated. On the other hand, an X symbol indicates a cause, the effect of which cannot be eliminated.

The effects of specific causes of variations in pixel electric potential cannot be eliminated by merely carrying out an inspection process. By automatically adjusting the center value of the common voltage Vcom in accordance with the embodiment, however, it is possible to eliminate the effects of the specific causes of variations in pixel electric potential. The specific causes of variations in pixel electric potential are driving-frequency variations occurring at an actual utilization time, environment temperature variations also occurring at the actual utilization time and aging. The variations in driving frequency, the variations in environment temperature and the aging are caused by off leak currents flowing through the transistor employed in the pixel circuit and cannot be eliminated by merely carrying out an inspection process.

By the same token, the effects of other specific causes of variations in pixel electric potential cannot be eliminated by merely carrying out an inspection process. By automatically adjusting the center value of the common voltage Vcom in accordance with the embodiment, however, it is possible to eliminate the effects of the other specific causes of variations in pixel electric potential. The other specific causes of variations in pixel electric potential are driving-frequency variations occurring at an actual utilization time, environment-temperature variations also occurring at the actual utilization time, backlight-luminance variations also occurring at the actual utilization time and variations in external-light luminance. The variations in driving frequency, the variations in environment temperature, the variations in backlight luminance and the variations in external-light luminance are caused by optical leak currents flowing through the transistor employed in the pixel circuit and cannot be eliminated by merely carrying out an inspection process.

The automatic adjustment of the center value of the common voltage Vcom has been described above. The following description explains layouts of pixel circuits composing the first and second monitor pixel sections 107-1 and 107-2 according to the embodiment.

As described previously, in accordance with the embodiment, the monitor circuit 120 provided at a location adjacent to the effective pixel section 101 (in FIG. 4, a location on the right side of the effective pixel section 101) includes the first monitor pixel section 107-1 having one monitor pixel or a plurality of monitor pixels, the second monitor pixel section 107-2 also having one monitor pixel or a plurality of monitor pixels, the vertical driving circuit (V/CSDRVM) 108 serving as a vertical driving circuit common to the first monitor pixel section 107-1 and the second monitor pixel section 107-2, the first monitor horizontal driving circuit (HDRVM1) 109-1 designed specially for the first monitor pixel section 107-1, the second monitor horizontal driving circuit (HDRVM2) 109-2 designed specially for the second monitor pixel section 107-2 and the detection-result output circuit 110.

The reason for having the above layout at a location on the right side of the effective pixel section 101 is explained as follows.

Figure 26:
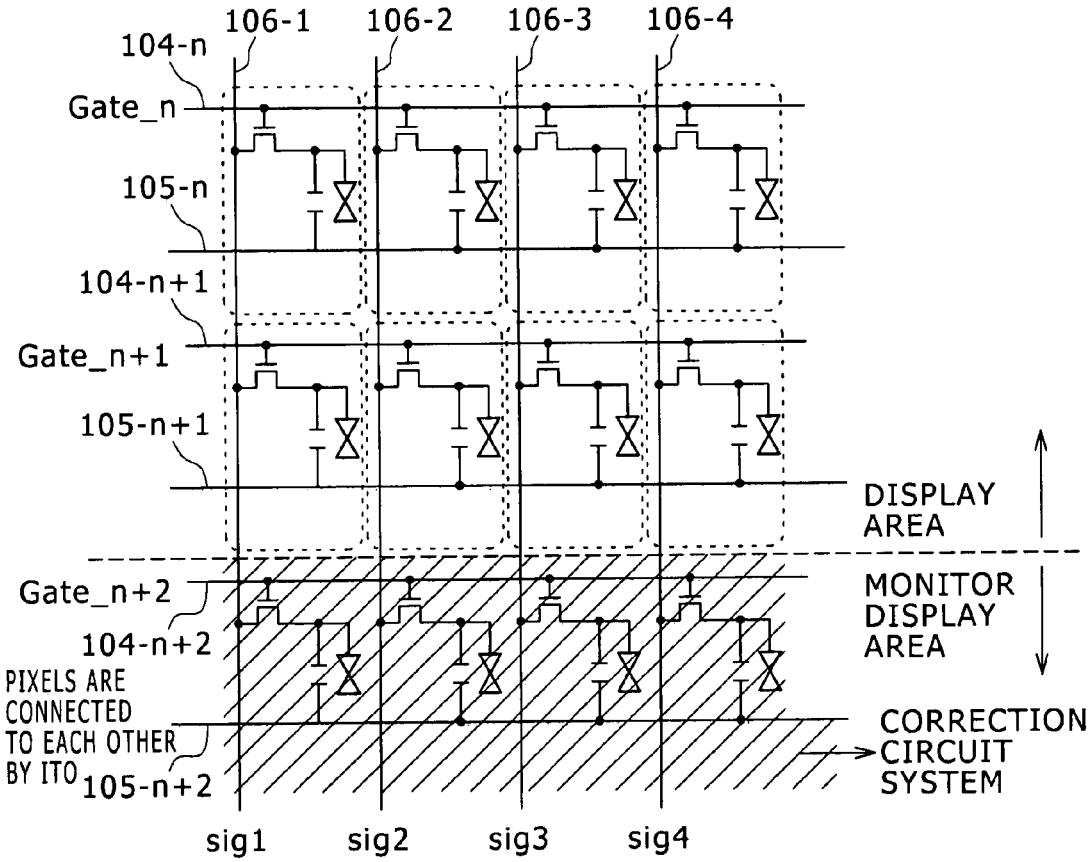
FIG. 26 is a diagram showing monitor pixel as a portion which is included in an effective pixel section as a portion consisting of typically one detection pixel or a plurality of detection pixels.

As shown in FIG. 26, a monitor pixel electric potential or a plurality of monitor pixels are created as a portion of the effective pixel section 101. For example, the monitor pixel electric potential is created as a pixel circuit of the effective pixel section 101 or the monitor pixel electric potentials are created as a row of the effective pixel section 101. In this configuration, in the same way as the effective pixel section 101, the monitor pixel electric potentials are connected to the gate, capacitor and signal lines which are driven by the vertical driving circuit 102 and the horizontal driving circuit 103.

In the case of this configuration, however, each of the monitor pixel electric potentials requires an electric potential similar to that required by each of the effective pixel circuits. Thus, since the configuration of the monitor pixel section cannot be changed much, the monitor pixel section must be placed at a location above or below the available-pixel section (or the available display area) and the monitor pixel section must be oriented in the horizontal direction.

In addition, since the same driving signals (or the same control signals) as the display pixel circuits (or the effective pixel circuits) are used, the freedom of making use of the control signals is low. On top of that, since the signal lines are also shared with the available display area, this configuration raises a problem that a capacitive coupling effect generated by each of the signal lines cannot be ignored.

In accordance with the embodiment, after an operation to write data into a monitor pixel electric potential is carried out, an electric-potential detection process can be performed in the middle of one frame period so as to accomplish an optimum correction operation.

Figure 27:
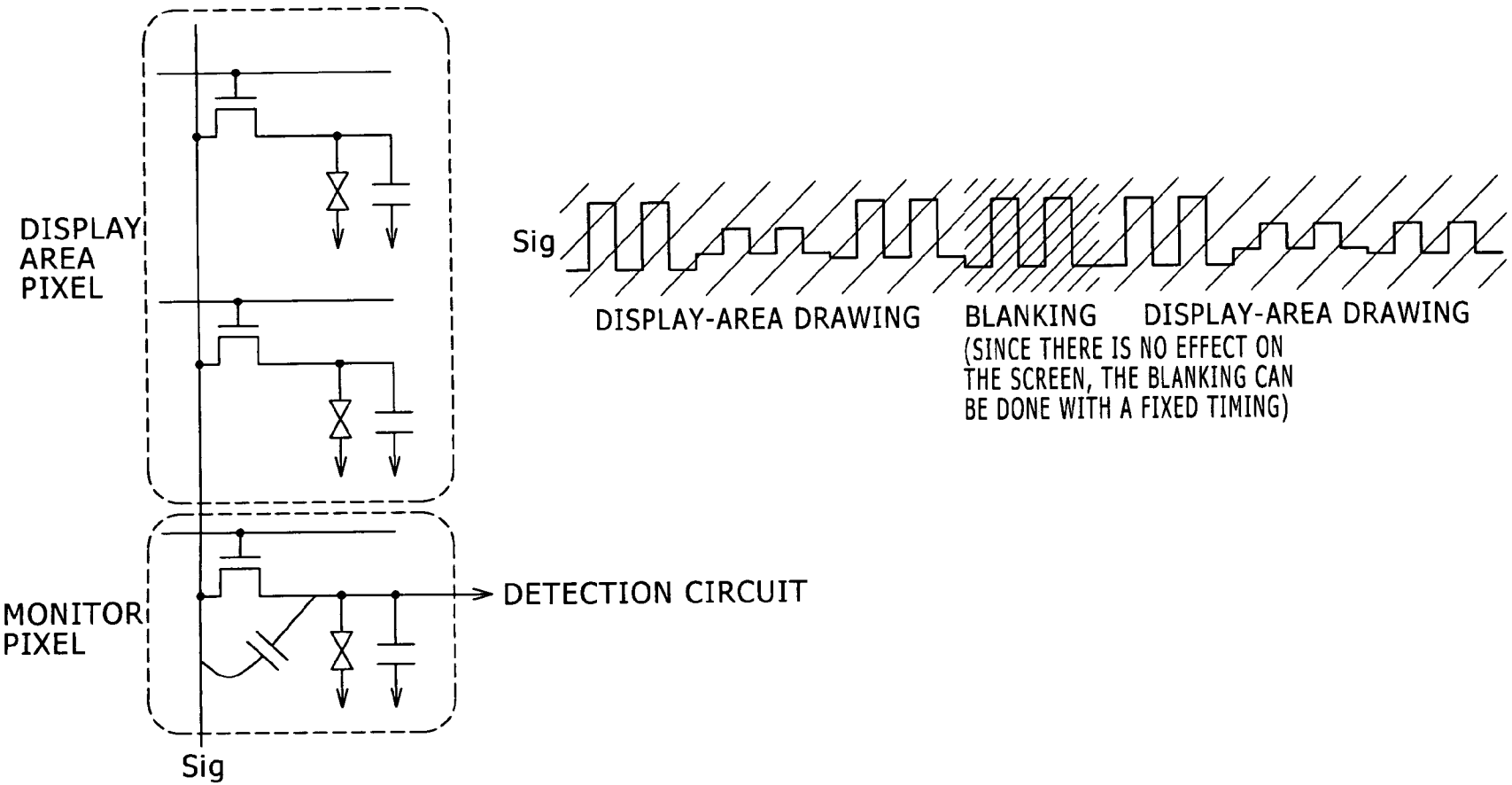
FIG. 27 is an explanatory diagram to be referred to in description of a typical case in which an electric potential appearing in a monitor pixel electric potential changes due to an effect of a signal line supplying a video signal to a display pixel circuit as a signal varying in the middle of a frame.

As shown in FIG. 27, however, affected by signal line voltage variations due to display pixel circuits each receiving the video signal from the signal line in the middle of one frame period, the electric potential of the monitor pixel electric potential also inevitably changes. Thus, the correction operation must be carried out in the blanking period of the video signal.

In addition, it is also difficult to lay out monitor pixel electric potentials for both polarities, i. e., the positive and negative polarities, as pixel circuits required for a system for automatically adjusting the center value of the common voltage Vcom described above.

In order to solve the problems described above, the monitor circuit 120 is created independently of the effective pixel section 101 at a location adjacent to the effective pixel section 101 as a circuit employing the first monitor pixel section 107-1, the second monitor pixel section 107-2, the vertical driving circuit 108, the first monitor horizontal driving circuit 109-1 and the second monitor horizontal driving circuit 109-2.

Figure 28A:
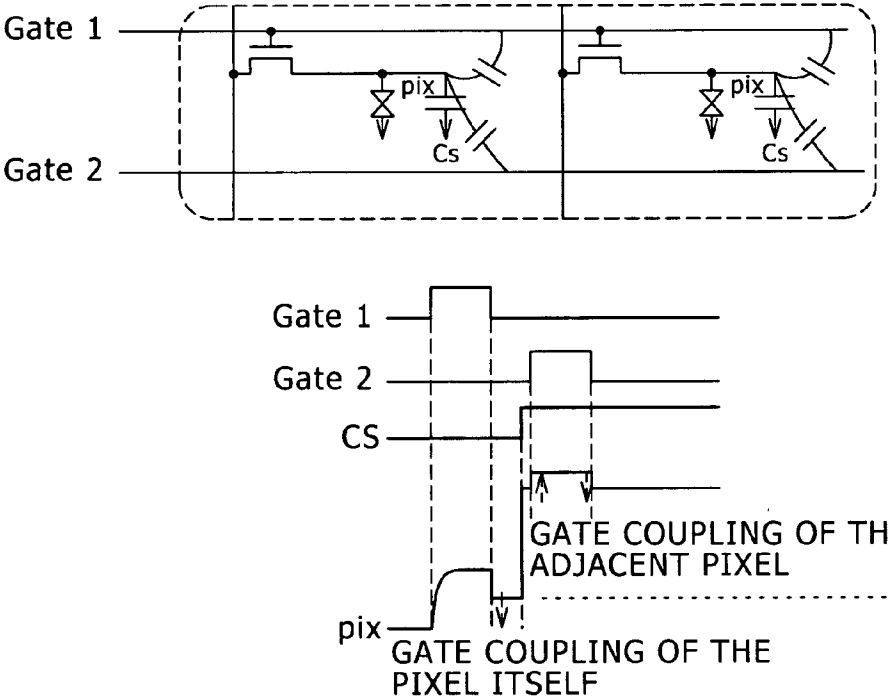
Figure 28B:
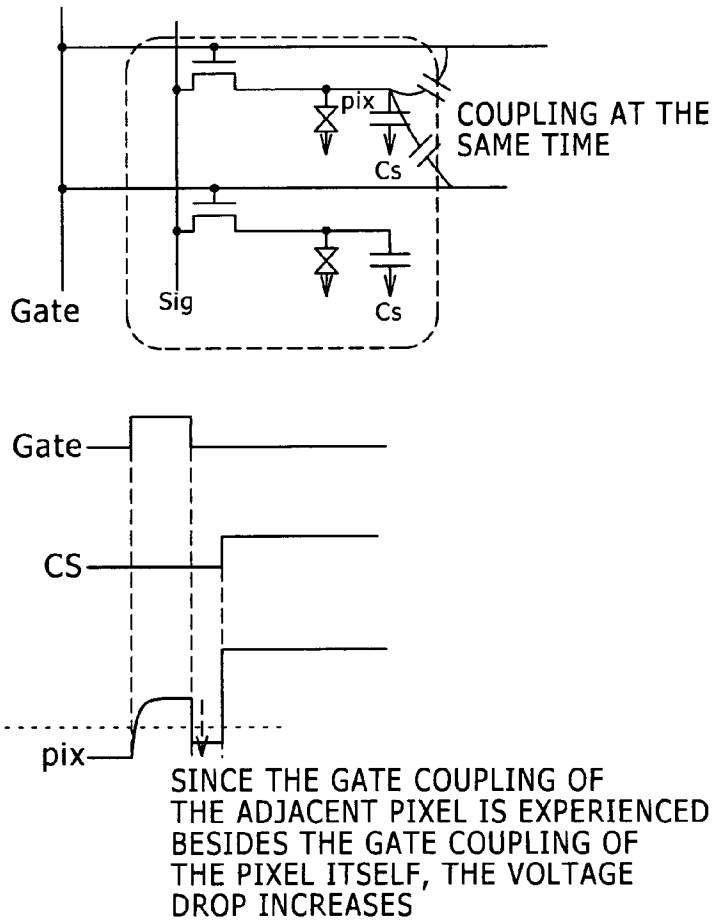
FIG. 28B is a diagram showing a plurality of monitor pixels typically laid out in the vertical direction as pixel circuits simply connected to a common gate line.

In addition, in the case of a configuration in which the monitor pixel section includes a plurality of monitor pixels, if gate lines are merely shared by a plurality of monitor pixels as shown in FIGS. 28A and 28B, the amount of gate coupling varies unavoidably.

In a configuration shown in FIG. 28A, the layout of the monitor pixels is oriented in the horizontal direction, and the monitor pixels share the gate lines. In this case, any particular pixel circuit is affected by a gate coupling effect of a pixel circuit adjacent to the particular one.

In a configuration shown in FIG. 28B, on the other hand, the layout of the monitor pixel electric potentials is oriented in the vertical direction, and the monitor pixel electric potentials share the gate lines. In this case, any particular pixel circuit is affected by not only a gate coupling effect of the particular pixel circuit itself, but also a gate coupling effect of a pixel circuit adjacent to the particular one at the same time. Thus, the drop of the electric potential appearing in the pixel circuit is large.

In order to solve the problems described above, in the case of the embodiment, the gate lines are provided so as to form the so-called nesting layout as described below. It is thus desirable to provide a configuration in which any particular monitor pixel is affected by only a gate coupling effect of a line connected to the particular pixel circuit itself even if the layout of the monitor pixels is oriented in the vertical direction.

Figure 29:
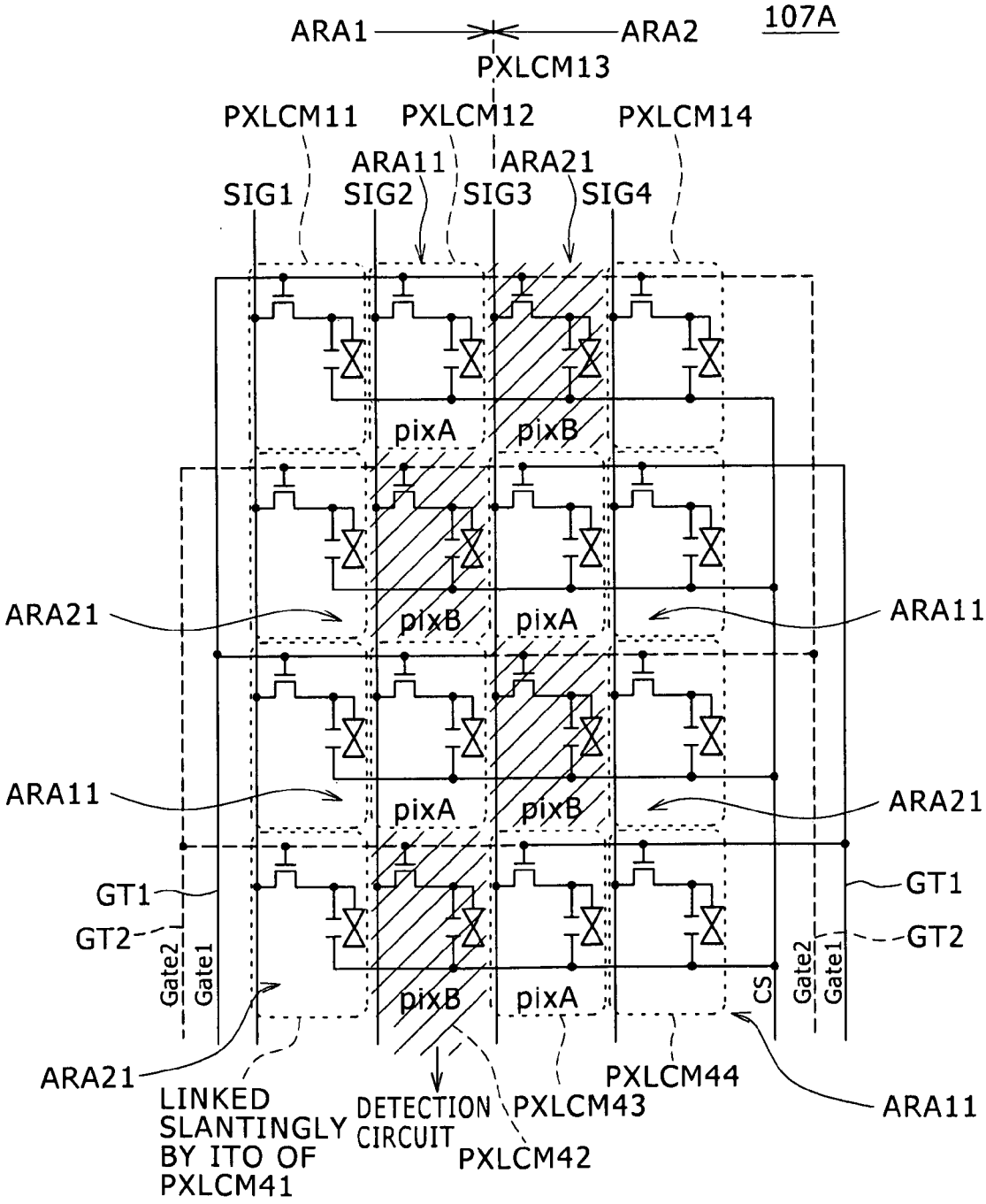
FIG. 29 is a diagram showing a typical layout of pixel circuits in a monitor pixel section according to the embodiment.
Figure 30:
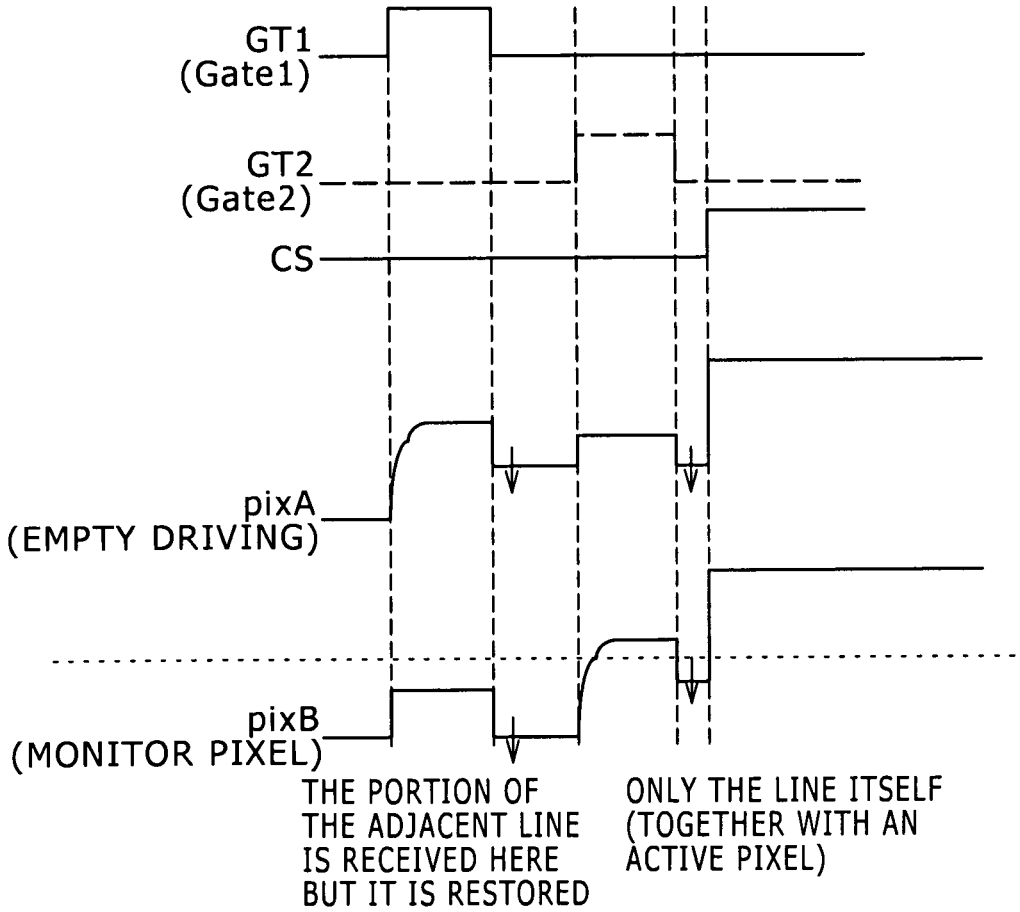
FIG. 30 is a diagram showing the waveforms of driving signals appearing in the monitor pixel section shown in FIG. 29.

FIG. 29 is a diagram showing a typical layout of pixel circuits in a monitor pixel section 107A according to the embodiment. FIG. 30 is a diagram showing the waveforms of driving signals appearing in the monitor pixel section 107A shown in FIG. 29.

The monitor pixel section 107A shown in FIG. 29 is a typical monitor pixel section in which 16 monitor pixel circuits PXLCM11 to PXLCM44 are laid out to form a 4×4 matrix. However, the number of monitor pixels forming the matrix is by no means limited to 16. That is to say, the matrix can be an n×n matrix where notation n denotes any integer other than 4.

The matrix of pixel circuits composing the monitor pixel section 107A is divided by a line parallel to the columns into 2 areas, namely, ARA1 and ARA2.

On each row of the pixel matrix, there are an area ARA11 for a first monitor pixel circuit not used in actual monitoring and an area ARA21 for a second monitor pixel circuit used in actual monitoring. In FIG. 29, the first monitor pixel circuit is denoted by notation pixA whereas the second monitor pixel circuit is denoted by notation pixB. The areas ARA11 and ARA21 are laid out alternately in the column direction in each of the two areas ARA1 and ARA2. Thus, the first monitor pixel circuits pixA form a zigzag line in the column direction in the pixel circuit matrix. By the same token, the second monitor pixel circuits pixB form a zigzag line in the column direction in the pixel circuit matrix.

As shown in FIG. 29, each of the first monitor pixel circuit pixA and the second monitor pixel circuit pixB, which are employed in the monitor pixel section 107A, employs a thin-film transistor TFT321 functioning as a switching device, a liquid-crystal cell LC321 and a storage capacitor Cs321. The first pixel electrode of the liquid-crystal cell LC321 is connected to the drain electrode (or the source electrode) of the thin-film transistor TFT321. The drain electrode of the thin-film transistor TFT321 is also connected to the first electrode of the storage capacitor Cs321. It is to be noted that the point of connection between the drain electrode of the thin-film transistor TFT321, the first electrode of the liquid-crystal cell LC201 and the first electrode of the storage capacitor Cs321 forms a node ND321.

The monitor pixel section 107A shown in FIG. 29 makes use of 2 gate lines, i. e., a first gate line GT1 and a second gate line GT2. The first gate line GT1 is connected to the gate electrode of the thin-film transistor TFT321 employed in the first monitor pixel circuit pixA in the first monitor pixel area ARA11 whereas the second gate line GT2 is connected to the gate electrode of the thin-film transistor TFT321 employed in the second monitor pixel circuit pixB in the second monitor pixel area ARA21.

The node ND321 of the second monitor pixel circuit pixB is connected to a conductive wire such as an ITO wire. The node ND321 of the second monitor pixel circuit PXLCM42 located at the intersection of the fourth row and the second column is connected to the detection-result output circuit 110.

As actual monitor pixel electric potentials, the typical configuration shown in FIG. 29 employs monitor pixel circuits PXLCM13, PXLCM22, PXLCM33 and PXLCM42.

The second electrode of the storage capacitor Cs321 of each of the first monitor pixel circuit pixA and the second monitor pixel circuit pixB is connected a capacitor line L321 which is a line common to all pixel circuits on a row.

In addition, the source electrode (or the drain electrode) of the thin-film transistor TFT321 employed in each of the first monitor pixel circuit pixA and the second monitor pixel circuit pixB which are located on the same column is connected to a signal line provided for the column. Signal lines provided for the first to fourth columns are signal lines L322-1 to L322-4 respectively.

The second pixel electrode of the liquid-crystal cell LC321 employed in each of the first monitor pixel circuit pixA and the second monitor pixel circuit pixB is connected to a line for supplying typically the common voltage VCOM (Vcom) with a small amplitude and a polarity inverted every horizontal scan period as a signal common to all pixel circuits. In the following description, a horizontal scan period is referred to as 1H.

As shown in timing charts of FIG. 30, first of all, the first gate line GT1 is driven to a high level in order to put the first monitor pixel circuit pixA in an empty driving state. With the first monitor pixel circuit pixA put in an empty driving state, the second monitor pixel circuit pixB adjacent to the first monitor pixel circuit pixA is affected by the gate coupling effect of the first monitor pixel circuit pixA. With the timing of the falling edge of the first gate line GT1, however, the second monitor pixel circuit pixB is restored to the original state thereof.

Next, the second gate line GT2 is driven to a high level in order to put the second monitor pixel circuit pixB in a real driving state. With the second monitor pixel circuit pixB put in a real driving state, the second monitor pixel circuit pixB experiences only the gate coupling effect generated by itself and is by no means affected by the gate coupling effect generated by the first monitor pixel circuit pixA adjacent to the second monitor pixel circuit pixB. Thus, the magnitude of an electric-potential drop experienced by the pixel circuit can be made the same as the drop of the pixel circuit PXLC employed in the effective pixel section 101.

As described above, in this embodiment, by providing the gate lines so as to form the so-called nesting layout, the gate coupling effect generated by a monitor pixel is a capacitive coupling effect caused by only the gate line connected to the monitor pixel itself.

The monitor pixel section shown in FIG. 29 can be used as either of the first monitor pixel section 107-1 and the second monitor pixel section 107-2 which are employed in the active-matrix display apparatus 100 shown in FIG. 4.

As described above, this embodiment has a configuration in which the monitor circuit 120 is created independently of the effective pixel section 101 at a location adjacent to the effective pixel section 101 as a circuit employing the first monitor pixel section 107-1, the second monitor pixel section 107-2, the vertical driving circuit 108, the first monitor horizontal driving circuit 109-1 and the second monitor horizontal driving circuit 109-2. In addition, the gate lines are provided so as to form the so-called nesting layout. Thus, the embodiment offers a merit of a higher degree of freedom with which the liquid-crystal display panel is designed.

As a result, it is easier to lay out the configuration circuits of the monitor circuit 120, that is, easier to lay out the first monitor pixel section 107-1, the second monitor pixel section 107-2, the vertical driving circuit 108, the first monitor horizontal driving circuit 109-1 and the second monitor horizontal driving circuit 109-2.

It is possible to lay out all configuration circuits of the monitor circuit 120 independently of the effective pixel section 101 at a location adjacent to (or, in FIG. 4, on the right side of) the effective pixel section 101 as shown in FIG. 4. In addition, the layout of the configuration circuits can be designed into a variety of shapes.

Figure 31A:
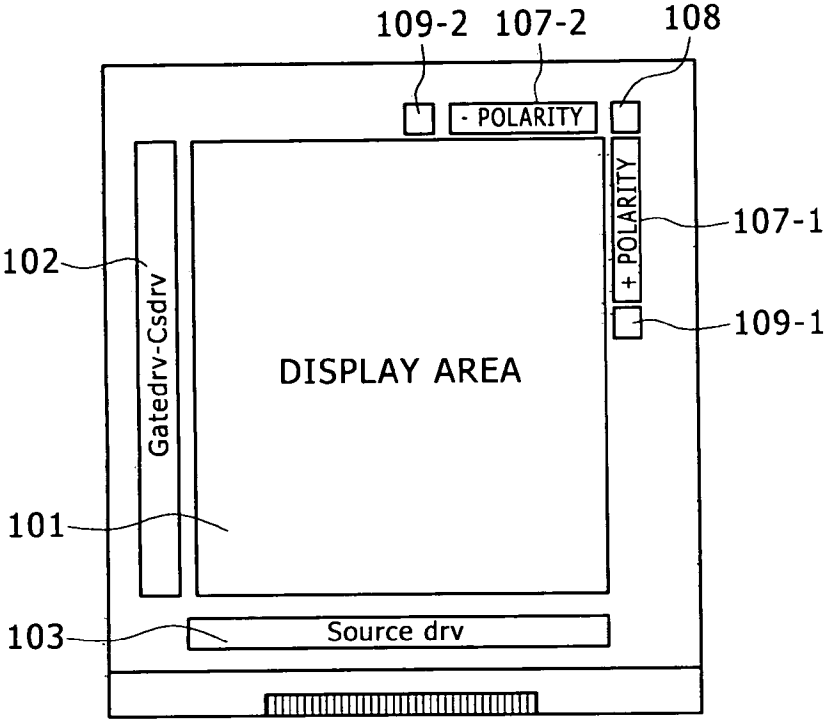
FIGS. 31A and 31B are each a diagram showing a typical layout of monitor pixel sections in a monitor circuit.
Figure 31B:
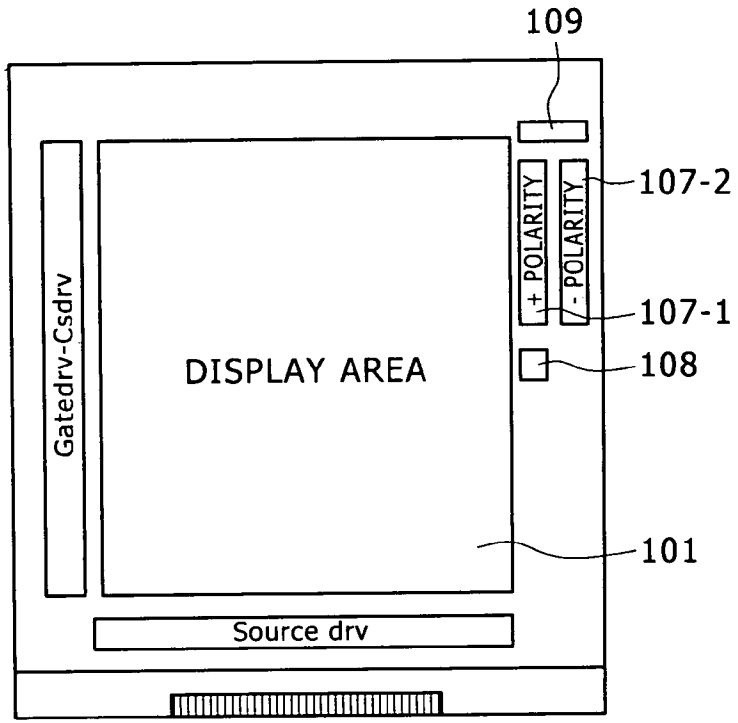

For example, as shown in FIG. 31A, the layout is split into a location above the effective pixel section 101 and a location on the right side of the effective pixel section 101. In addition, it is also possible to provide another typical layout shown in FIG. 31B as a layout in which the first monitor pixel section 107-1 is parallel to the second monitor pixel section 107-2, the monitor horizontal driving circuit 109 is located above the first monitor pixel section 107-1 and the second monitor pixel section 107-2 whereas the monitor vertical driving circuit 108 is located below the first monitor pixel section 107-1 and the second monitor pixel section 107-2.

On top of that, the vertical and horizontal driving circuits designed specially for the monitor pixel section can thus be provided separately from the effective pixel section 101 so that it is possible to solve a problem that the correction operation must be carried out in the blanking period of the video signal. As described previously, this problem is caused by the fact that, affected by signal line voltage variations due to display pixel circuits each receiving the video signal from the signal line in the middle of one frame period, the electric potential of the monitor pixel electric potential also inevitably changes.

As described earlier, driving operations are carried out on effective pixel circuits (each also referred to as a display pixel circuit) and monitor pixel electric potentials located at locations separated from the effective pixel circuits so that it is feared that the monitor-pixel electric potential is shifted from a target electric potential intended for the display pixel circuit due to a structural difference. However, the embodiment employs a circuit for adjusting the shift of the electric potential appearing in the monitor pixel electric potential from a target electric potential intended for the display pixel circuit.

This embodiment adopts a system in which the monitor circuit 120 includes a pair of monitor pixel sections, i. e., the first monitor pixel section 107-1 with the positive (+) polarity and the second monitor pixel section 107-2 with the negative (−) polarity. In the system, by shorting detection lines, which convey the pixel electric-potentials detected in the first monitor pixel section 107-1 and the second monitor pixel section 107-2, to each other, a midpoint detected potential can be generated as an electric potential for adjusting (correcting) the electric potential (or the center value) of the common voltage Vcom.

The generated midpoint electric-potential should agree with the electric potential of the common voltage Vcom applied to the effective pixel circuit (or the display pixel circuit). If the monitor pixel electric potential and the display pixel circuit (or the effective pixel circuit) are provided independently of each other, however, it is quite within the bounds of possibility that differences between an electric potential Pix detected in the monitor pixel electric potential and an electric potential Pix actually appearing in the display pixel circuit are generated due to variations in the liquid-crystal display panel surface as shown in FIG. 32 even if the monitor pixel and the display pixel are put in the same operating conditions. Typical variations in the liquid-crystal display panel surface are variations in liquidz34-crystal cell gap and variations in interlayer insulation film.

For example, the variations in liquid-crystal cell gap have an effect on the capacitance of the liquid-crystal cell whereas the variations in interlayer insulation film have an effect on typically the capacitance of the storage capacitor, the capacitance of the parasitic capacitor of the gate electrode of the TFT and the characteristics of the TFT.

Due to such variations in the liquid-crystal display panel surface and differences in electric potential, errors also exist in the monitor circuit so that it is feared that a detected electric potential is shifted from the target electric potential intended for the display pixel circuit. In order to solve this problem, it is necessary to adopt one of the following two typical methods or a combination of the methods.

In accordance with the first method, video signals having amplitudes different from each other are written into monitor pixel electric potentials so that an offset is deliberately provided to a midpoint electric-potential detected in each of the pixel circuits as an offset for correcting the detected midpoint electric-potential so as to eliminate the shift of the detected electric potential from the target electric potential intended for the display pixel circuit. In accordance with the second method, on the other hand, each monitor pixel electric potential is provided with a capacitor so that an offset is deliberately provided to a detected midpoint electric-potential as an offset for correcting the detected midpoint electric-potential so as to eliminate the shift of the detected electric potential from the target electric potential intended for the display pixel circuit.

By adopting one of the first and second methods or a combination of the methods, it is possible to cancel the shift of the detected electric potential from the target electric potential intended for the display pixel circuit.

First of all, the first method is explained. In accordance with this method, an operation is carried out to correct a detected midpoint electric-potential by deliberately providing the detected midpoint electric-potential with an offset caused by a difference in amplitude between video signals Sig applied to monitor pixel electric potentials.

Figure 33A:
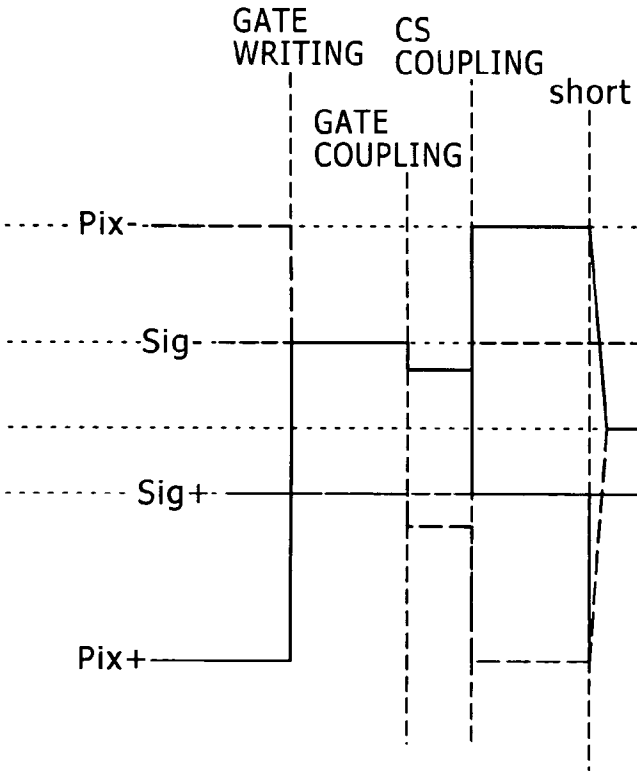
FIGS. 33A and 33B are each an explanatory diagram to be referred to in description of an operation carried out to correct a detected midpoint electric-potential by deliberately providing the detected midpoint electric-potential with an offset caused by a difference in amplitude between video signals Sig applied to monitor pixel electric potentials.
Figure 33B:
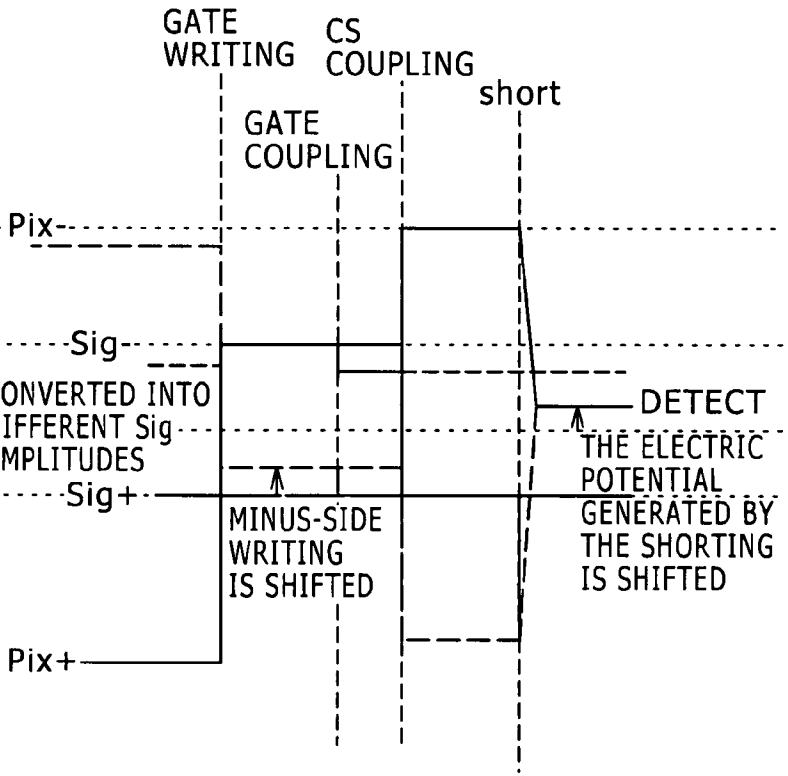

Each of FIGS. 33A and 33B is an explanatory diagram referred to in description of the operation carried out to correct a detected midpoint electric-potential by deliberately providing the detected midpoint electric-potential with an offset caused by a difference in amplitude between video signals Sig applied to monitor pixel electric potentials. To be more specific, FIG. 33A is an explanatory diagram showing a detected output obtained as a result of detecting the midpoint of potentials Pix for a case in which signals Sig having the same amplitudes are applied to monitor pixel electric potentials. On the other hand, FIG. 33B is an explanatory diagram showing a detected output obtained as a result of detecting the midpoint of potentials Pix for a case in which signals Sig having amplitudes different from each other are applied to monitor pixel electric potentials in order to deliberately provide an offset to the detected output so as to eliminate the shift of the detected electric potential from the target electric potential intended for the display pixel circuit.

In accordance with the first embodiment, an offset is provided deliberately to the detected output so as to eliminate the shift of the detected electric potential from the target electric potential intended for the display pixel circuit. As shown in FIG. 33B, signals Sig having amplitudes different from each other are written into a pair of monitor pixel sections employed in the embodiment. Since the detected midpoint electric-potential is generated by shorting detection lines, which convey the electric potentials detected from the monitor pixel sections, to each other, the detected electric potential can be shifted by a difference equal to the offset for canceling the shift of the detected electric potential from the target electric potential intended for the display pixel circuit. In the case shown in FIG. 33B, the amplitude of the video signal Sig− on the negative side is changed and then the video signal Sig− is written into the monitor pixel section on the negative side. It is to be noted, however, that it is also possible to provide a configuration in which the amplitude of the video signal Sig+ on the positive side is changed and then the video signal Sig+ is written into the monitor pixel section on the positive side.

Figure 34:
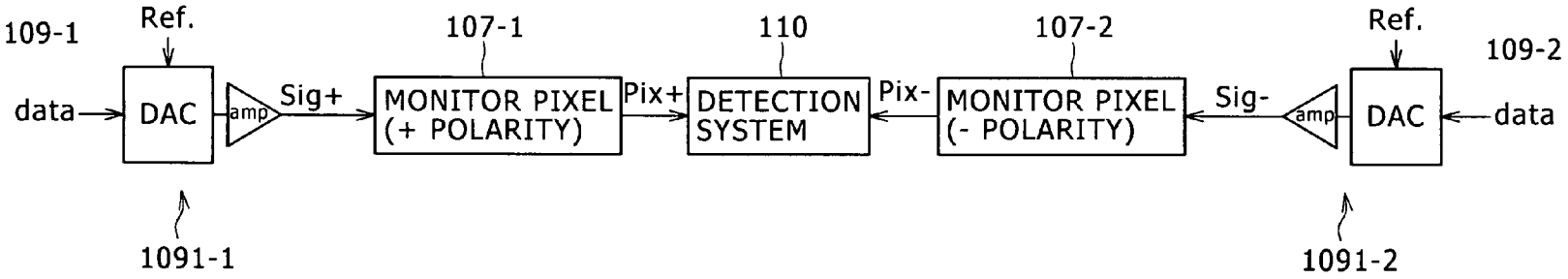
FIG. 34 is a diagram showing a first typical configuration of a circuit for carrying out the operation to correct a detected midpoint electric-potential by deliberately providing the detected midpoint electric-potential with an offset caused by a difference in amplitude between video signals Sig applied to monitor pixel electric potentials.

FIG. 34 is a diagram showing a first typical configuration of a circuit for carrying out the operation to correct a detected midpoint electric-potential by deliberately providing the detected midpoint electric-potential with an offset caused by a difference in amplitude between video signals Sig applied to monitor pixel electric potentials.

The circuit shown in FIG. 34 typically employs a positive-polarity write circuit 1091-1 provided at the output stage of the first monitor horizontal driving circuit 109-1 associated with the first monitor pixel section 107-1 as a write circuit designed specially for the positive polarity. By the same token, the circuit typically employs a negative-polarity write circuit 1091-2 provided at the output stage of the second monitor horizontal driving circuit 109-2 associated with the second monitor pixel section 107-2 as a write circuit designed specially for the negative polarity. Each of the positive-polarity write circuit 1091-1 and the negative-polarity write circuit 1091-2 generates a video signal Sig with an amplitude controllable independently.

Each of the positive-polarity write circuit 1091-1 and the negative-polarity write circuit 1091-2 employs a digital-analog converter DAC and an amplifier amp for amplifying an analog signal generated by the digital-analog converter DAC.

Figure 35:
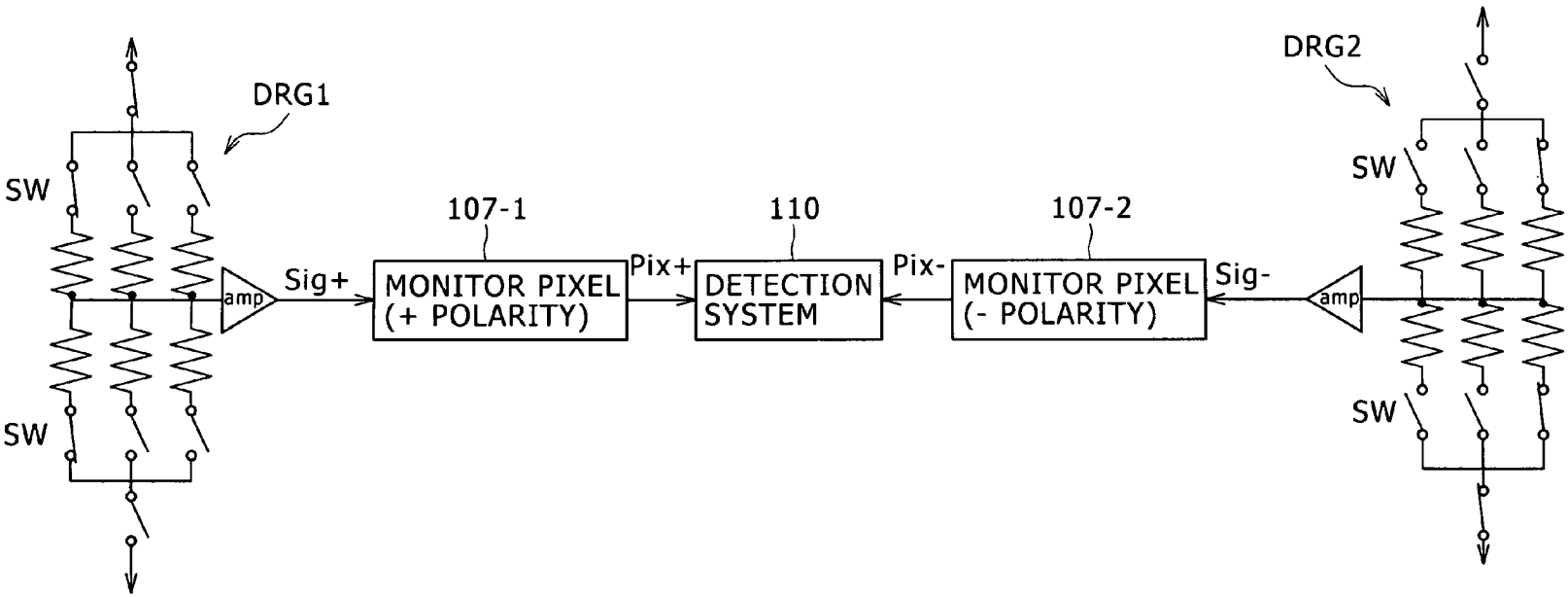
FIG. 35 is a diagram showing a second typical configuration of a circuit for carrying out the operation to correct a detected midpoint electric-potential by deliberately providing the detected midpoint electric-potential with an offset caused by a difference in amplitude between video signals Sig applied to monitor pixel electric potentials.

FIG. 35 is a diagram showing a second typical configuration of a circuit for carrying out the operation to correct a detected midpoint electric-potential by deliberately providing the detected midpoint electric-potential with an offset caused by a difference in amplitude between video signals Sig applied to monitor pixel electric potentials.

Much like the circuit shown in FIG. 34, the circuit shown in FIG. 35 also employs a positive-polarity write circuit 1091-1 provided at the output stage of the first monitor horizontal driving circuit 109-1 associated with the first monitor pixel section 107-1 as a write circuit designed specially for the positive polarity. By the same token, the circuit typically employs a negative-polarity write circuit 1091-2 provided at the output stage of the second monitor horizontal driving circuit 109-2 associated with the second monitor pixel section 107-2 as a write circuit designed specially for the negative polarity.

In the case of the circuit shown in FIG. 35, however, the positive-polarity write circuit 1091-1 and the negative-polarity write circuit 1091-2 employ voltage dividing resistors DRG1 and DRG2 respectively in place of the digital-analog converters DAC in addition to the amplifiers amp each used for amplifying an analog signal generated by one of the voltage dividing resistors DRG1 and DRG2. Each of the voltage dividing resistors DRG1 and DRG2 generates a video signal Sig with an amplitude controllable independently.

In the typical configuration shown in FIG. 35, each of the voltage dividing resistors DRG1 and DRG2 employs switches for selecting a resistor series circuit for generating a video signal Sig with a desired amplitude. However, it is also possible to adopt another control method by which a resistor is disconnected by making use of a laser repair technique in order to select a resistor series circuit for generating a video signal Sig with a desired amplitude.

Figures 36A, 36B:
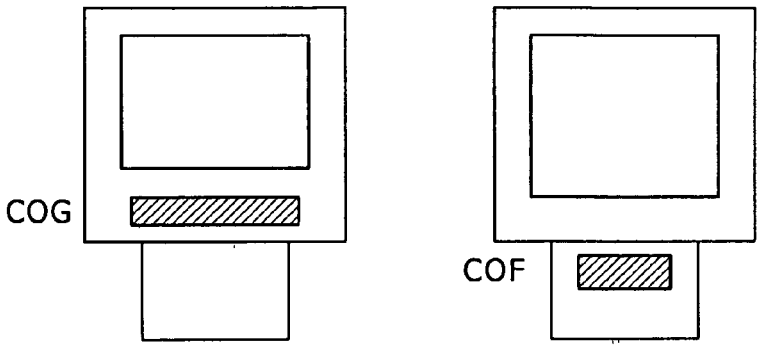

It is to be noted that the midpoint electric-potential detection system and/or the Sig writing system do not have to be integrated with the LCD (liquid-crystal display) panel and embedded in the liquid-crystal display panel. That is to say, the midpoint electric-potential detection system and/or the Sig write system can be implemented as an external IC such as a COG, a COF or the like as shown in FIG. 36A or 36B respectively.

Next, the second method is explained. In accordance with the second method, each monitor pixel electric potential is provided with an additional capacitor so that an offset is provided deliberately to a detected midpoint electric-potential as an offset for correcting the detected electric potential so as to eliminate the shift of the detected electric potential from the target electric potential intended for the display pixel circuit.

Figure 37:
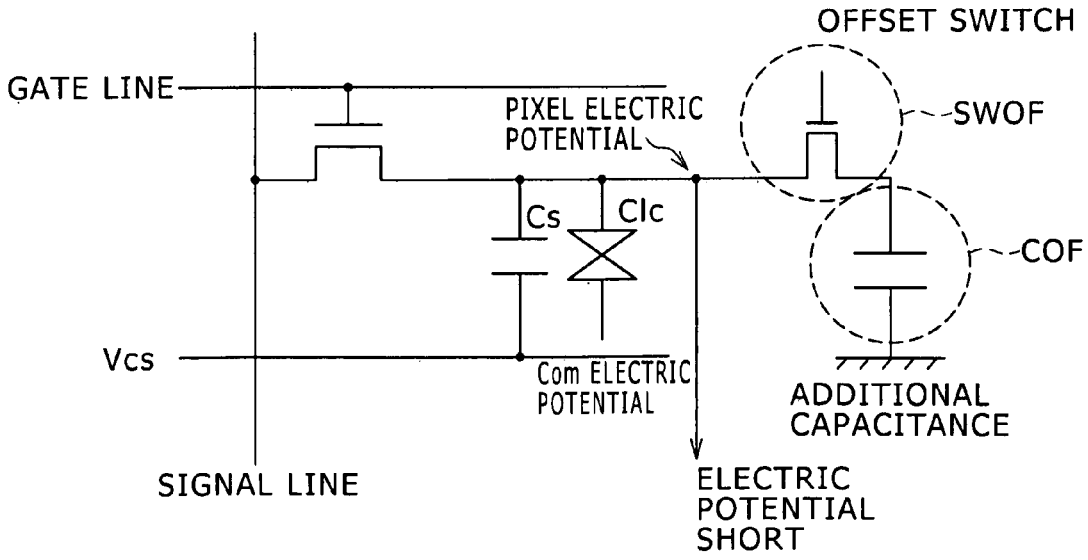
FIG. 37 is an explanatory diagram to be referred to in description of an outline of an operation carried out to correct a detected midpoint electric-potential by deliberately providing the detected midpoint electric-potential with an offset generated by an additional capacitor.

FIG. 37 is an explanatory diagram referred to in description of an outline of an operation carried out to correct a detected midpoint electric-potential by deliberately providing the detected midpoint electric-potential with an offset generated by an additional capacitor.

In accordance with the second method, an additional capacitor COF is attached to the node ND321 of the monitor pixel circuit PXLCM as a capacitor used for adjusting the amount of electric charge accumulated in the monitor pixel circuit PXLCM.

The additional capacitor COF is added to each of the positive-polarity monitor pixel and the negative-polarity monitor pixel. The additional capacitor COF is connected to or disconnected from the monitor pixel circuit PXLCM by adoption of the switching or laser-repair technique in order to adjust the capacitance of the monitor pixel circuit PXLCM. By adjusting the capacitance of the monitor pixel circuit PXLCM, the offset provided to the detected electric potential of the monitor pixel circuit PXLCM can be controlled.

In the typical configuration shown in FIG. 37, the switching technique based on an offset switch SWOF is adopted.

Figure 38:
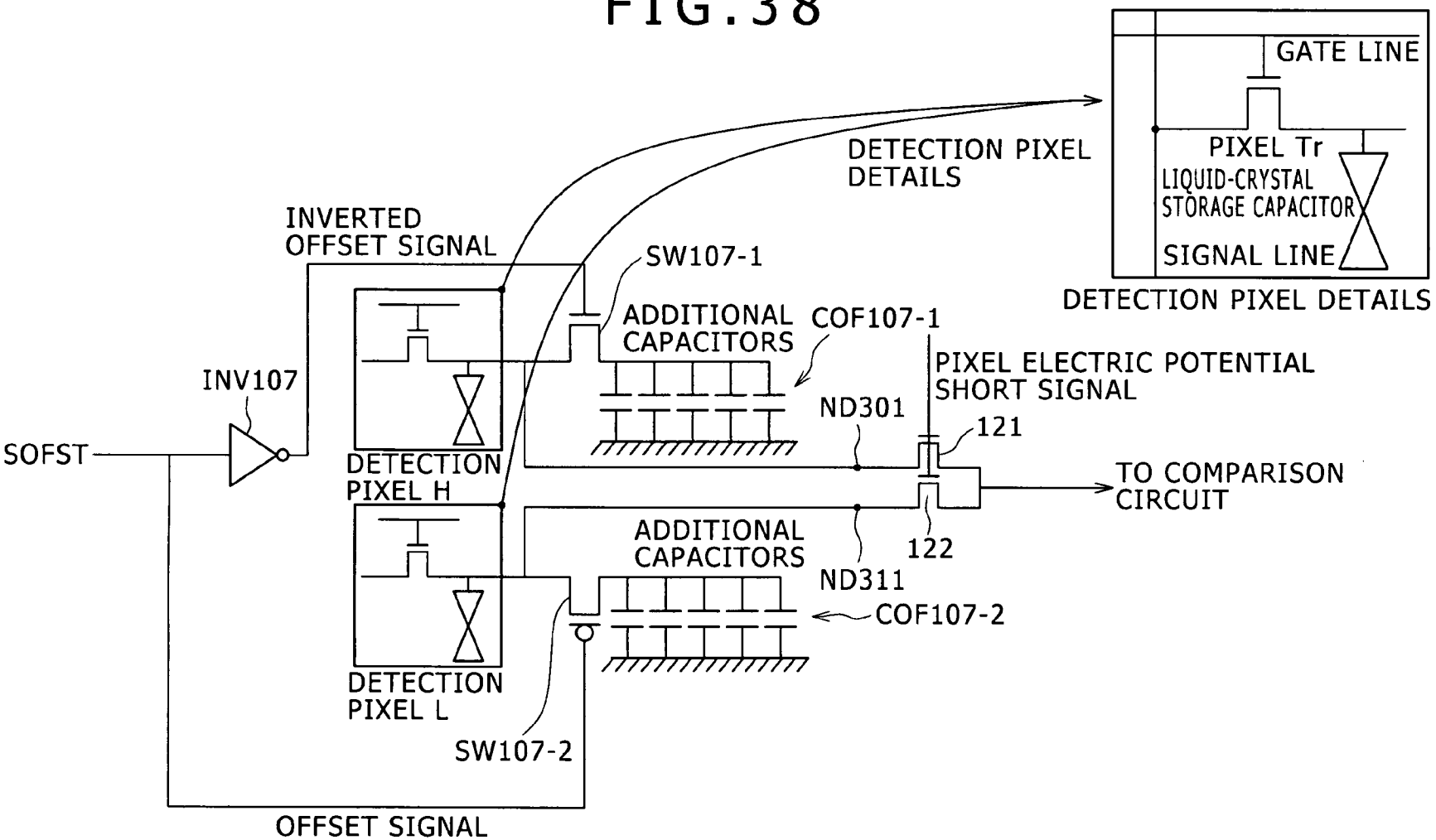
FIG. 38 is a circuit diagram showing a typical configuration of a midpoint electric-potential detection circuit for carrying out an operation to correct a detected midpoint electric-potential by deliberately providing the detected midpoint electric-potential with an offset generated by additional capacitors.

FIG. 38 is a circuit diagram showing a typical configuration of a midpoint electric-potential detection circuit 124A for carrying out an operation to correct a detected midpoint electric-potential by deliberately providing the detected midpoint electric-potential with an offset generated by additional capacitors.

The midpoint electric-potential detection circuit 124A shown in FIG. 38 includes a plurality of additional capacitors COF107-1 forming a parallel circuit connected to the node ND301 of the first monitor pixel section 107-1 through an NMOS transistor functioning as a switch SW107-1 and a plurality of additional capacitors COF107-2 forming a parallel circuit connected to the node ND311 of the second monitor pixel section 107-2 through a PMOS transistor functioning as a switch SW107-2.

The gate electrode (also referred to as a control electrode) of the switch SW107-1 is connected through an inverter INV107 to a line supplying an offset signal SOFST. On the other hand, the gate electrode (also referred to as a control electrode) of the switch SW107-2 is connected directly to the line supplying the offset signal SOFST.

In the typical configuration shown in FIG. 38, the first monitor pixel section 107-1 is shown as a pixel circuit of the positive polarity whereas the second monitor pixel section 107-2 is shown as a pixel circuit of the negative polarity. In addition, in the typical configuration shown in FIG. 38, each of switches 121 and 122 for taking the average of the potentials appearing in the first monitor pixel section 107-1 and the second monitor pixel section 107-2 is a transistor.

Figure 39:
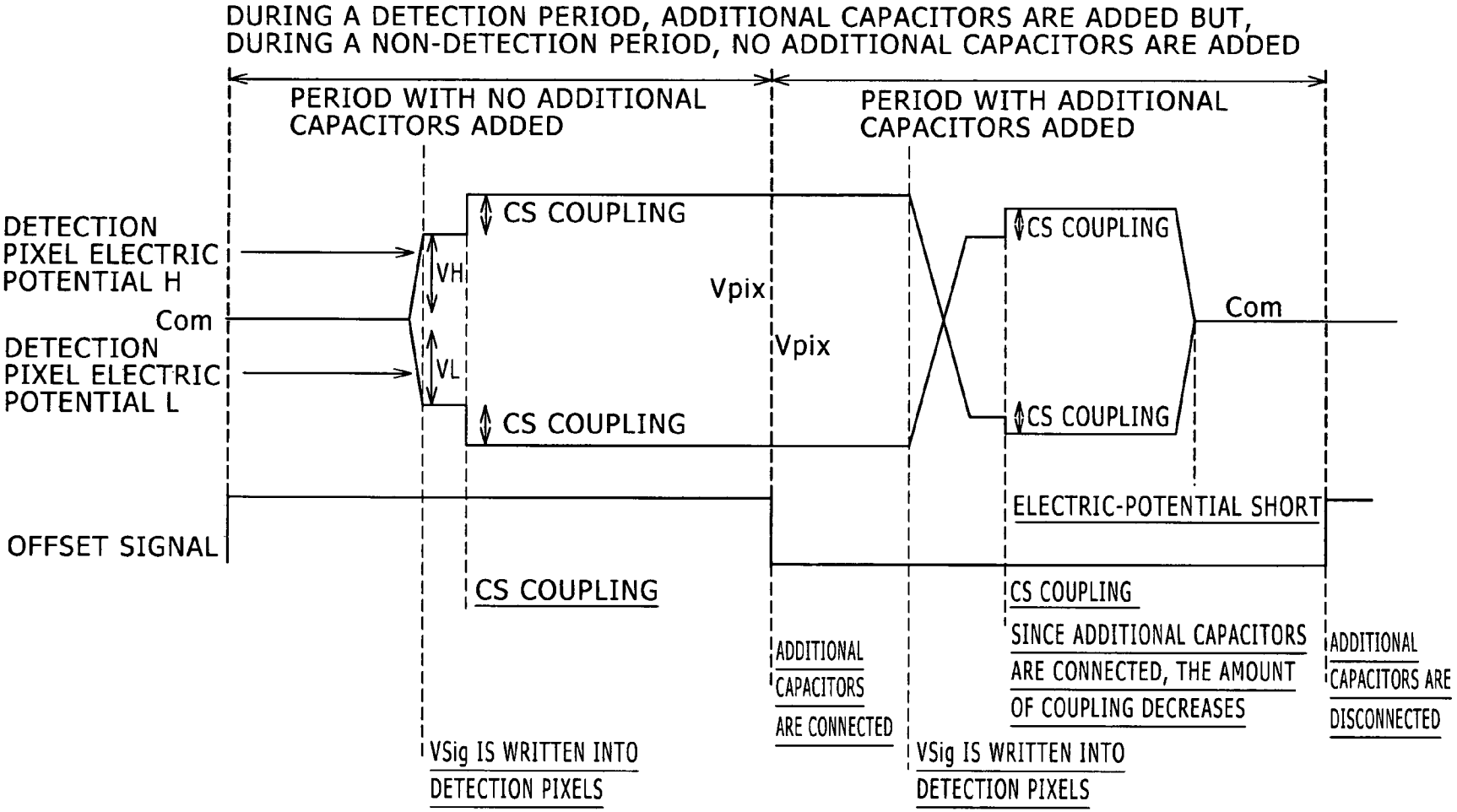
FIG. 39 shows typical timing charts of timings with which the additional capacitors are connected to their respective nodes.

FIG. 39 shows typical timing charts indicating timings with which the additional capacitors COF107-1 and COF107-2 are connected to the nodes ND301 and ND311 respectively.

As shown in the timing charts of FIG. 39, during a period to detect electric potentials each appearing in a pixel circuit, the active-low offset signal SOFTS is set at a low level which is the active-state level. In this state, the additional capacitors COF107-1 and COF107-2 are connected to respectively the nodes ND301 and ND311 at which the pixel electric potentials to be detected appear.

During a period to detect no electric potentials each appearing in a pixel circuit, on the other hand, the offset signal SOFTS is set at a high level which is the inactive-state level. In this state, the additional capacitors COF107-1 and COF107-2 are disconnected from respectively the nodes ND301 and ND311.

In addition, during a period to detect electric potentials each appearing in a pixel circuit, the additional capacitors COF107-1 and COF107-2 are connected to respectively the nodes ND301 and ND311 as described above. Thus, the magnitude of the CS coupling effect decreases.

Figure 40:
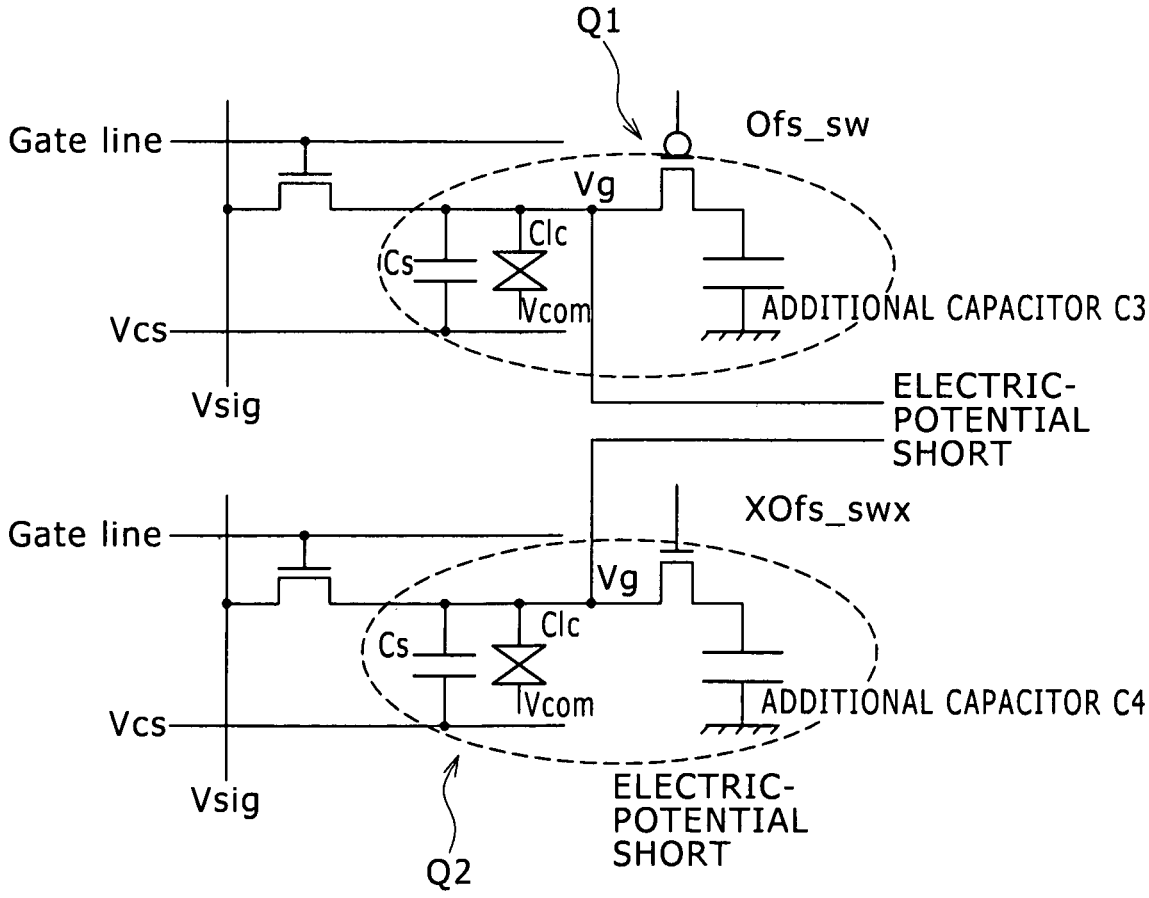
FIG. 40 is a diagram showing a pixel electric-potential shorted-state model of a circuit for correcting detected electric potentials by deliberately providing an offset to each of the electric potentials.

FIG. 40 is a diagram showing a pixel electric-potential short model of a circuit for correcting detected electric potentials by deliberately providing an offset to each of the electric potentials. Model equations based on the pixel electric-potential short model are explained below as equations for the circuit for correcting detected electric potentials by deliberately providing an offset to each of the electric potentials.

[Eq. 5]

$$Q1=(C1+C2+C3)VL+\{C1/(C1+C2+C3)\}\times Vcs\times(C1+C2+C3)$$

$$Q2=(C1+C2+C4)VH-\{C1/(C1+C2+C4)\}\times Vcs\times(C1+C2+C4)$$

$$Q1+Q2=(C1+C2)(VH+VL)+C3VL+C4VH=\{2(C1+C2)+C3+C4\}Vcom$$

$$Vcom=\{(C1+C2)(VH+VL)+C3VL+C4VH\}/\{2(C1+C2)+C3+C4\} \quad (5\text{-}4)$$

Notations used in the above equations are explained as follows:

Notation C1 denotes the capacitance of the liquid-crystal cell Clc.

Notation C2 denotes the capacitance CS of the storage capacitor Cs.

Notation C3 denotes the capacitance of an additional capacitor added on the L (negative-polarity) side.

Notation C4 denotes the capacitance of an additional capacitor added on the H (positive-polarity) side.

Notation VH denotes an electric potential to be written into the pixel circuit from the signal line on the positive-polarity side.

Notation VL denotes an electric potential to be written into the pixel circuit from the signal line on the negative-polarity side.

Figure 41:
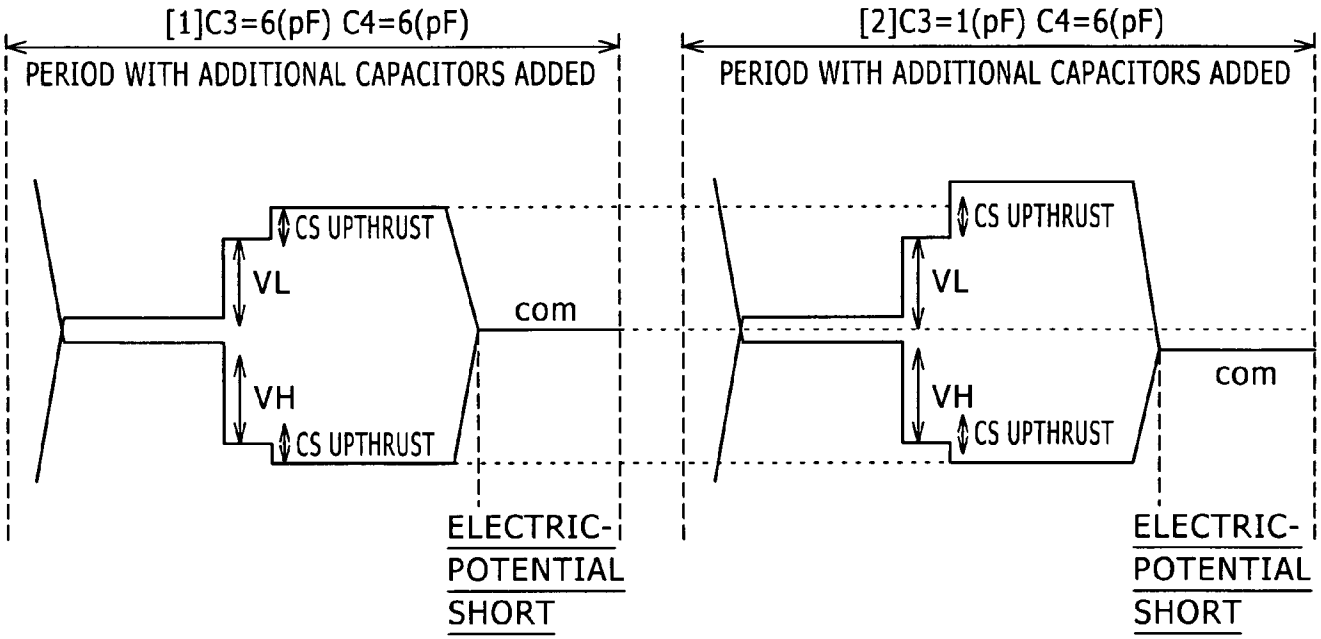
FIG. 41 (1) is a diagram showing the waveforms of the electric potentials for certain capacitances of the additional capacitors whereas FIG. 41 (2) is a diagram showing the waveforms of the electric potentials for other capacitances (different from the other capacitances) of the additional capacitors.

FIG. 41 (1) is a diagram showing the waveforms of the electric potentials VL and VH for C3=6 pF and C4=6 pf whereas FIG. 41 (2) is a diagram showing the waveforms of the electric potentials VL and VH for C3=1 pF and C4=6 pf. When the capacitance C3 is changed from 6 pF to 1 pF, the center value com of the common voltage Vcom changes as described below.

[Eq. 5]

First of all, from the model equations given above, the center value com of the common voltage Vcom is expressed as follows:

$$com=\{(C1+C2)(Vh+VL)+C3VL+C4VH\}/\{2(C1+C2)+C3+C4\} \quad (5\text{-}4)$$

Let us assume that C1=11 pF, C2=36 pF, VL=3.35 V and VH=zero V (which is a value taken as a reference voltage). Then, the typical numerical values are substituted into Eq. (5-4) as follows:

For the waveforms shown in FIG. 41 (1):

$$com=\{(11+36)(0+3.35)+6\times3.35+6\times0\}/\{2(11+36)+6+6\}=1.675\text{ V} \quad (5\text{-}4\text{-}1)$$

For the waveforms shown in FIG. 41 (2):

$$com=\{(11+36)(0+3.35)+1\times3.35+6\times0\}/\{2(11+36)+1+6\}=1.593\text{ V} \quad (5\text{-}4\text{-}2)$$

As is obvious from the values expressed by Eqs. (5-4-1) and (5-4-2) as the computed values of the average com, a change of the capacitance C3 of the additional capacitor added on the L (negative-polarity) side provides an offset for correcting the detected electric potential.

That is to say, the values expressed by Eqs. (5-4-1) and (5-4-2) as the computed values of the average com prove that the offset deliberately given to a detected electric potential can be used as an offset for correcting the detected electric potential.

Figure 42:
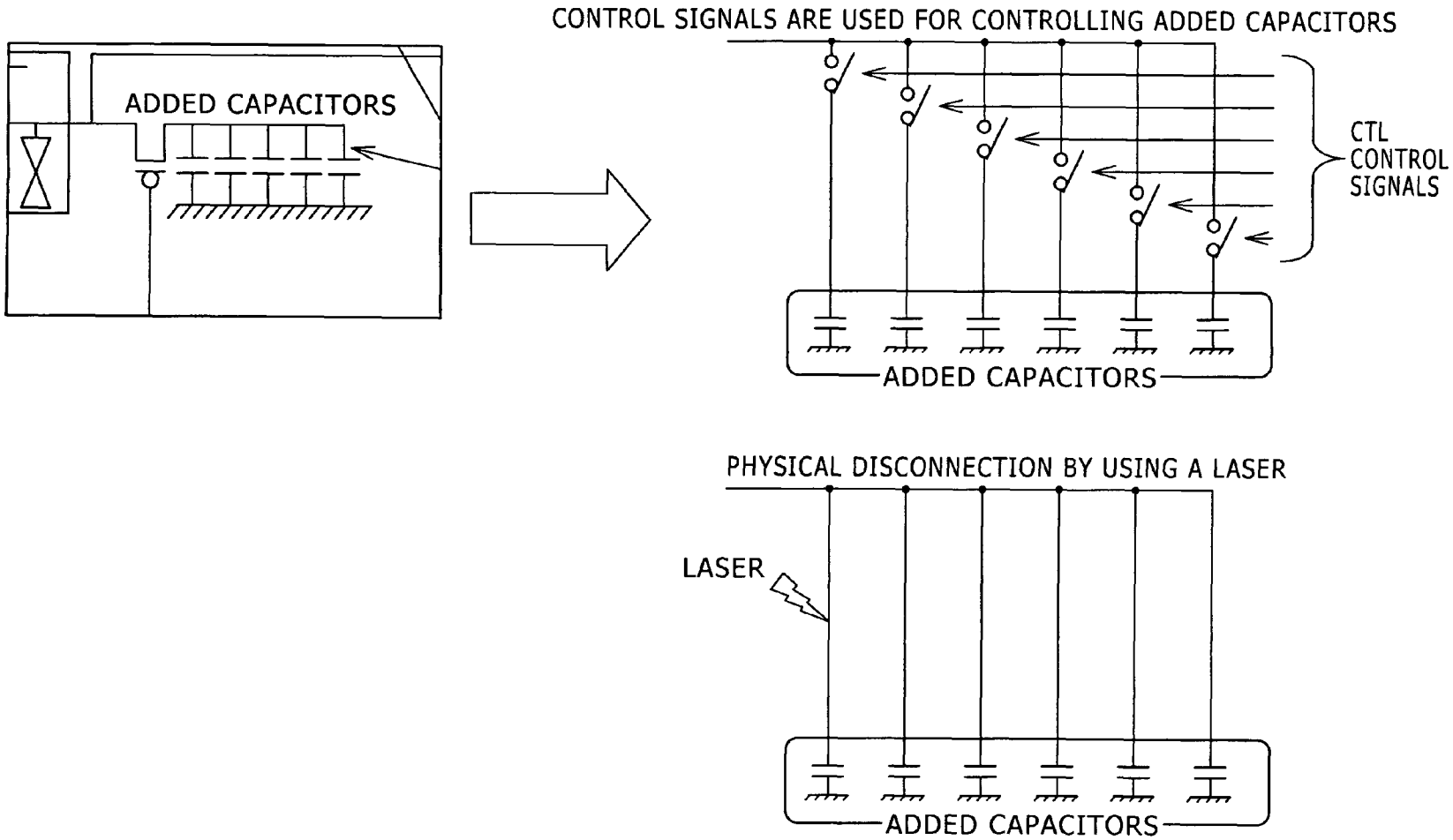
FIG. 42 is a diagram showing a typical configuration for changing the capacitances of the additional capacitors which are provided as a COF.

FIG. 42 is a diagram showing a typical configuration for changing the capacitances of the additional capacitors which are provided as a COF.

As shown in FIG. 42, the capacitances of the additional capacitors COF can be controlled by putting each of switches SWOF in a turned-on or turned-off state in accordance with control signals CTL applied to the switches SWOF. As an alternative, any one of the additional capacitors COF can be physically disconnected by making use of a laser in order to set the capacitances of the additional capacitors COF.

In addition, as described previously, in a configuration according to the embodiment, effective pixel circuits (also each referred to as a display pixel circuit) and monitor pixel electric potentials are laid out individually. Detection lines conveying electric potentials detected from the monitor pixel electric potentials are shorted to each other by making use of the switches 121 and 122 in order to find the midpoint of the detected potentials.

In this configuration, an electric potential may be deformed, depending on whether or not a process to rewrite a video signal into each of the monitor pixel electric potentials is carried out after the operation to short the detection lines, which convey electric potentials detected from the monitor pixel electric potentials, to each other. Thus, the pixel function may deteriorate as evidenced by, for example, a burn-in phenomenon.

In order to solve this problem, in accordance with the embodiment, there is provided a configuration in which a process to rewrite a video signal is carried out after the operation to short the detection lines, which convey electric potentials detected from the monitor pixel, to each other. By carrying out the process to rewrite a video signal, the deformation of the electric potential is corrected so as to provide electrical protection.

In accordance with the embodiment, an operation is carried out in order to short the detection lines, which convey electric potentials detected from the monitor pixel for the positive (+) and negative (−) polarities, to each other. By shorting the detection lines, the midpoint of the potential can be generated as an average used for adjusting the center value of the common voltage Vcom.

Figure 43A:
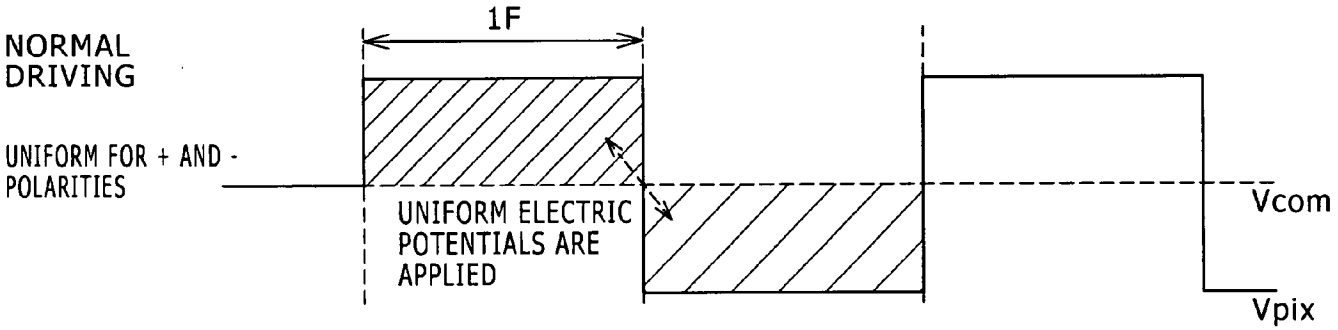

In a normal operation to drive a liquid-crystal cell, the common voltage Vcom for driving the liquid-crystal cell is an AC voltage like one shown in FIG. 43A. With such an AC voltage, the electric potential of the pixel circuit can be prevented from being deformed.

Figure 43B:
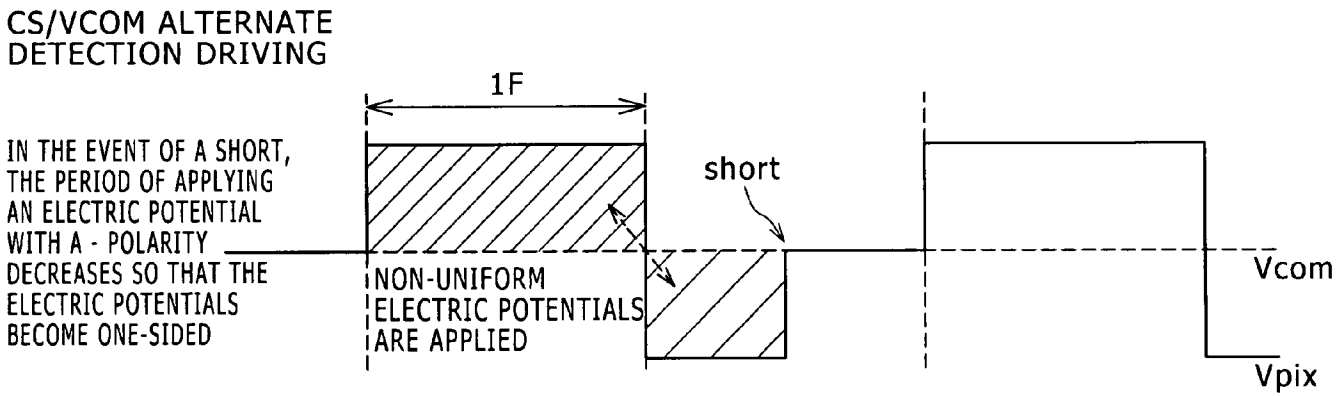
FIG. 43B is an explanatory diagram showing the waveform of a deformed electric potential in the case of a system in which a switch is put in shorted and open states alternately and repetitively in order to detect the electric potential.

In the case of a system in which a switch is put in shorted and open states alternately and repetitively in order to detect an electric potential of a monitor pixel, however, it is feared that the electric potential is deformed as shown in FIG. 43B.

In a shorted state, the period of the negative polarity becomes short, causing the electric potential to deform. In the typical case shown in FIG. 43B, the period of the negative polarity becomes short but it is the period of the positive polarity that adversely becomes short in a detected pixel.

Figure 44:
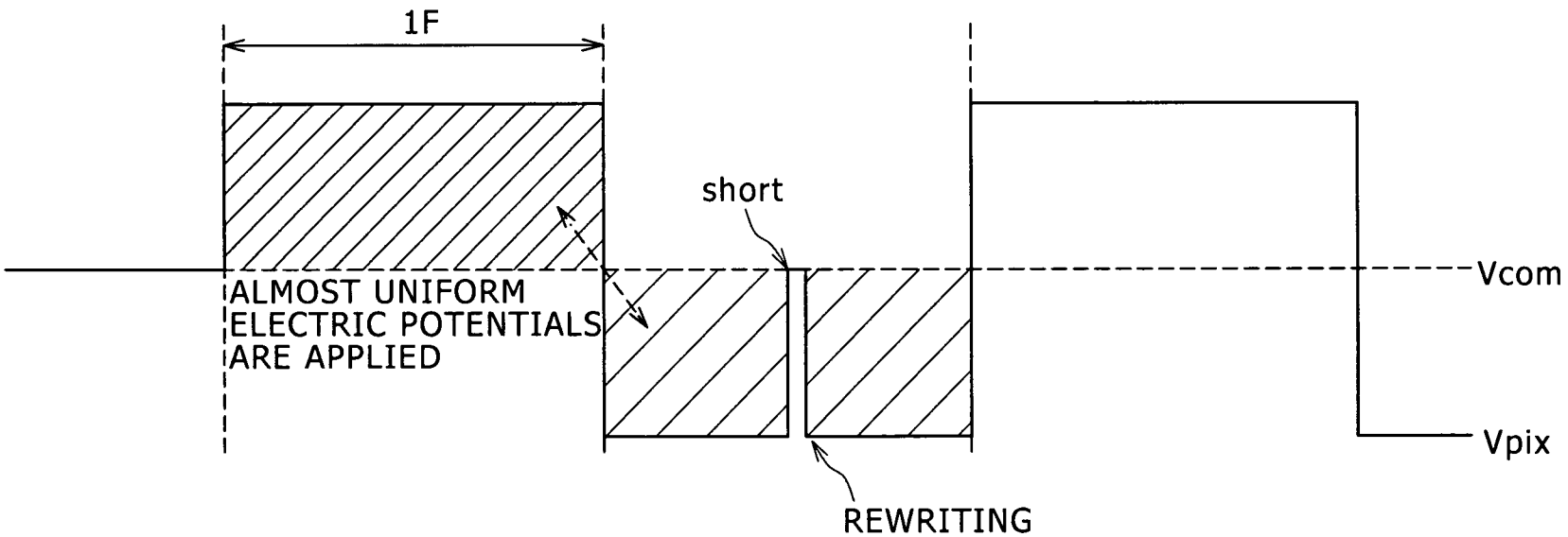
FIG. 44 is an explanatory diagram to be referred to in description of a method for preventing an electric potential detected from a monitor pixel electric potential from being deformed as a result of a process to put a detection line conveying the detected electric potential in a shorted state.

FIG. 44 is an explanatory diagram referred to in description of a method for preventing an electric potential detected from a monitor pixel electric potential from being deformed.

After the detection-result output circuit 110 serving as a detection system fetches a desired electric potential, it is not necessary to sustain the shorted state. Thus, after a detection process is completed, the same electric potential as the pre-short one is again written. Prior to the operation to rewrite the electric potential into the pixel circuit, it is necessary to once carry out a rewrite preparation process. A system for carrying out a rewrite preparation process prior to the operation to rewrite the pixel electric potential into the pixel circuit will be described later.

Figure 45:
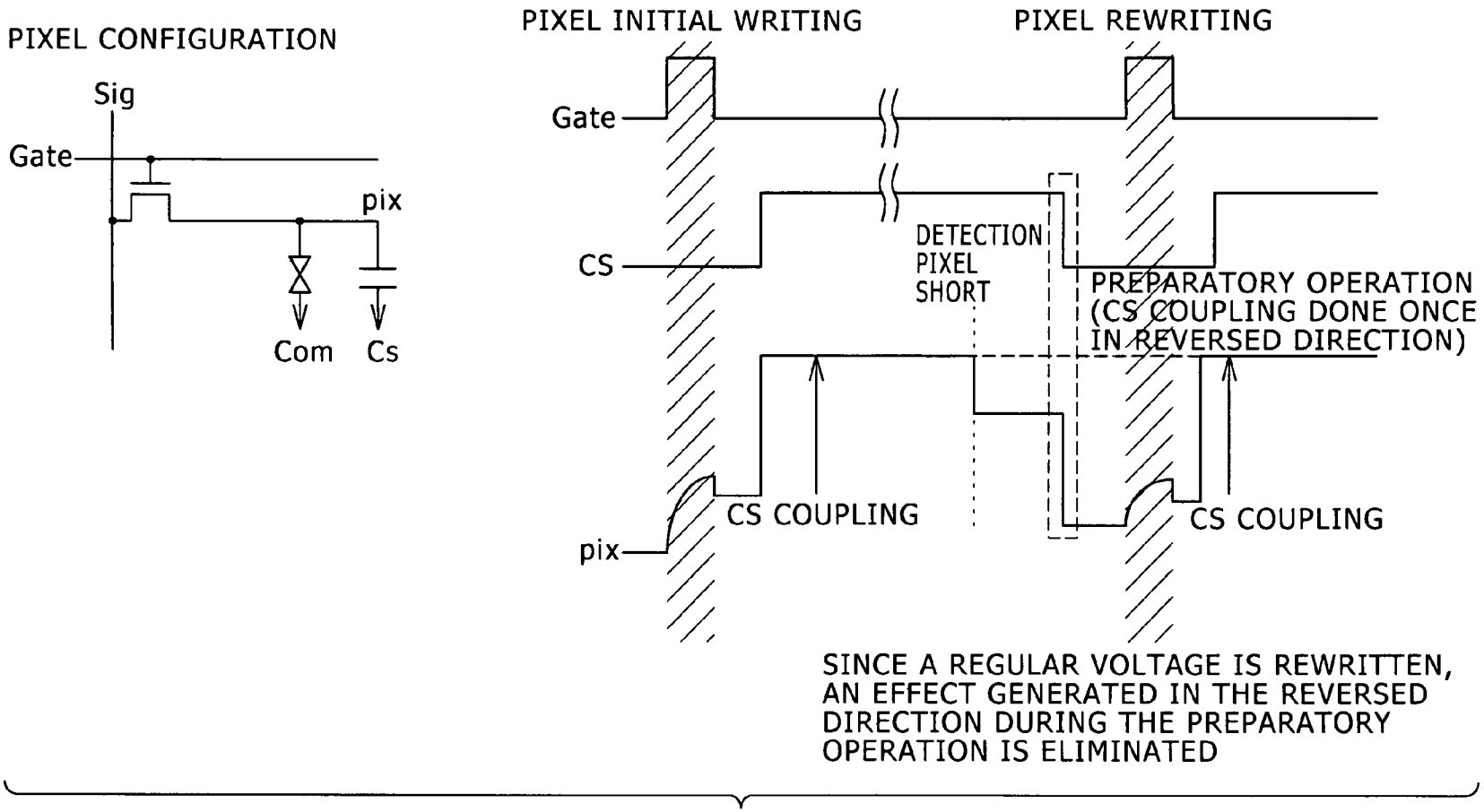
FIG. 45 is a diagram showing the configuration of a pixel circuit as well as an explanatory diagram to be referred to in concrete description of the method for preventing an electric potential detected from a monitor pixel electric potential from being deformed as a result of a process to put a detection line conveying the detected electric potential in a shorted state.

FIG. 45 is an explanatory diagram referred to in concrete description of the method for preventing an electric potential detected from a monitor pixel electric potential from being deformed as a result of a process to put a detection line conveying the detected electric potential in a shorted state.

As shown in FIG. 45, after a pixel electric potential pix is written into the pixel circuit by way of the TFT serving as the pixel transistor, the pixel electric potential pix reaches a desired level due to a CS coupling effect. In a first write operation, once such a CS coupling effect occurs. Thus, an ingenious attempt needs to be made in order to prevent another CS coupling effect from further raising the pixel electric potential pix at a rewrite time.

Such an attempt is made in a rewrite preparation process to change the capacitor signal CS in a direction opposite to the present polarity of the capacitor signal CS. The rewrite preparation process may lower or raise the capacitor signal CS by changing the capacitor signal CS in the L (downward) or H (upward) direction in accordance with the polarity of the pixel circuit. That is to say, the rewrite preparation process generates a CS coupling effect in a direction opposite to the direction of the other CS coupling effect which will occur at the rewrite time.

Of course, when the capacitor signal CS is changed, the electric potential pix appearing in the pixel circuit is also affected by the change. If the rewrite preparation process is carried out with a timing immediately preceding the gate pulse used to trigger the operation to rewrite the video signal represented by the electric potential pix into the pixel circuit as shown in FIG. 45, however, the normal video signal will be rewritten into the pixel circuit right after the rewrite preparation process so that the effect of the change occurring in the preparation process on the electric potential pix will be canceled by a pix change caused by the video signal rewrite operation.

Figure 46:
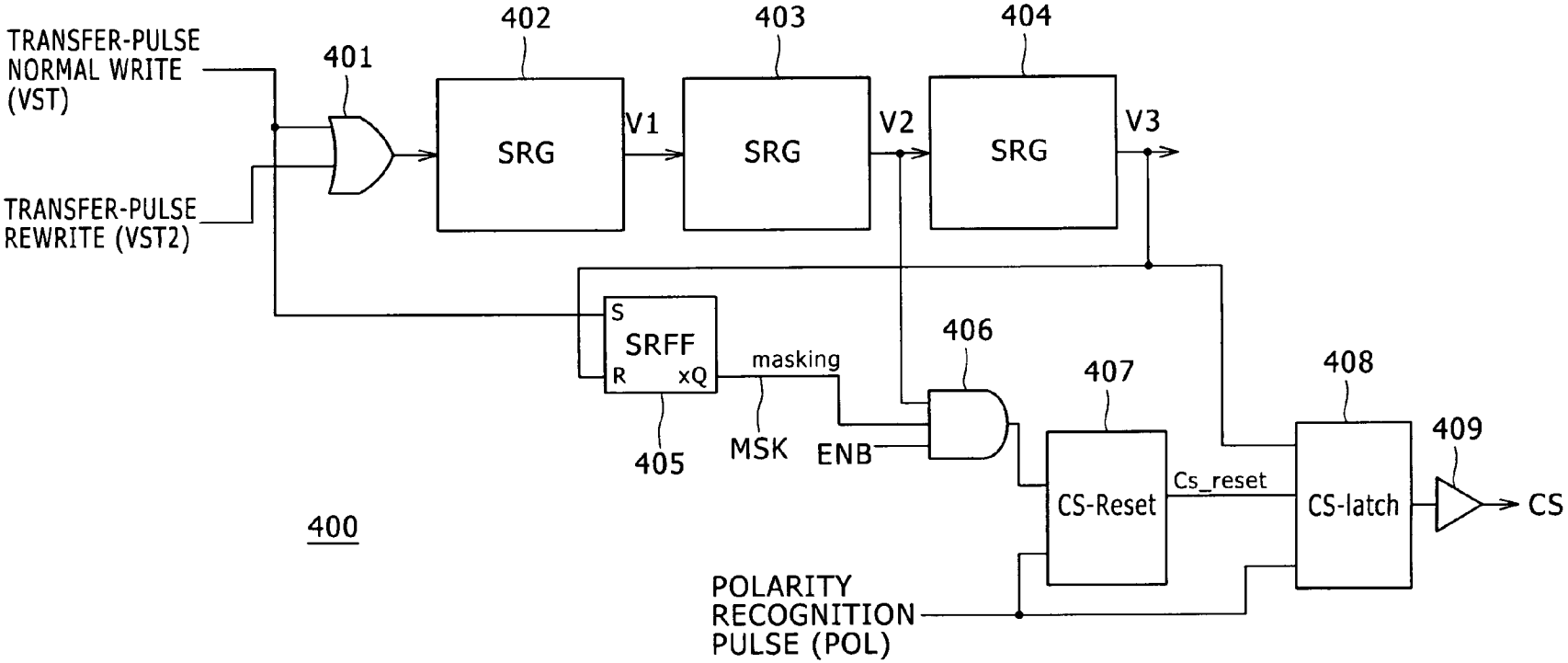
FIG. 46 is a diagram showing a first typical configuration of an electric-potential deformation preventing circuit for preventing a detected electric potential from being deformed in a process of shorting detection lines, which convey signals at electric potentials each appearing in a monitor pixel electric potential, to each other.

FIG. 46 is a diagram showing a first typical configuration of an electric-potential deformation preventing circuit 400 for preventing a detected electric potential from being deformed in a process of shorting the detection lines, which convey electric potentials each appearing in a monitor pixel electric potential, to each other.

Figure 47A:
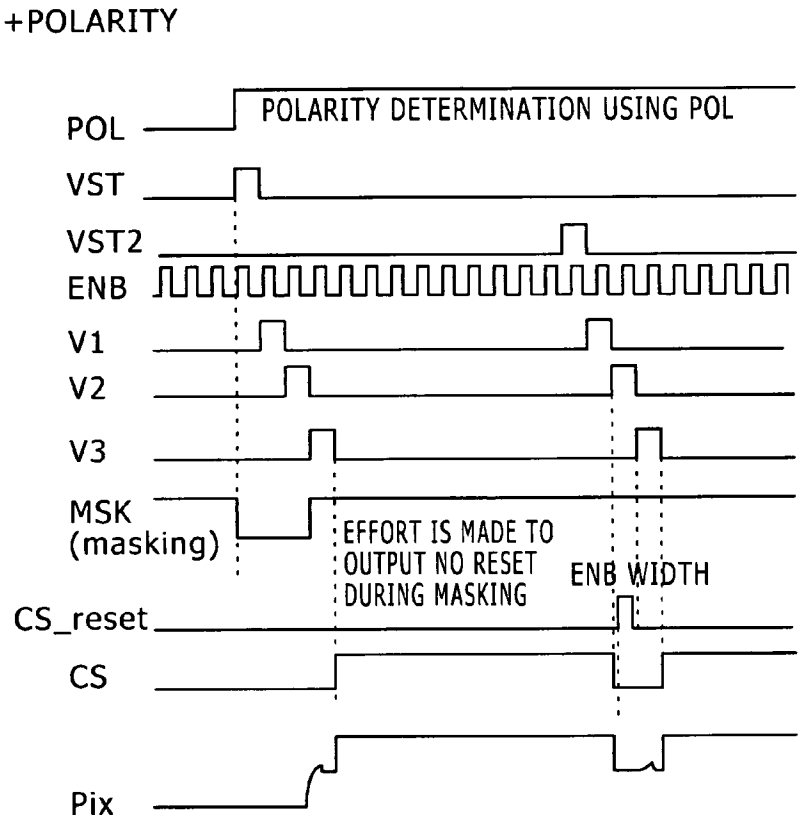
FIGS. 47A and 47B are timing charts of signals appearing in the electric-potential deformation preventing circuit shown in FIG. 46.
Figure 47B:
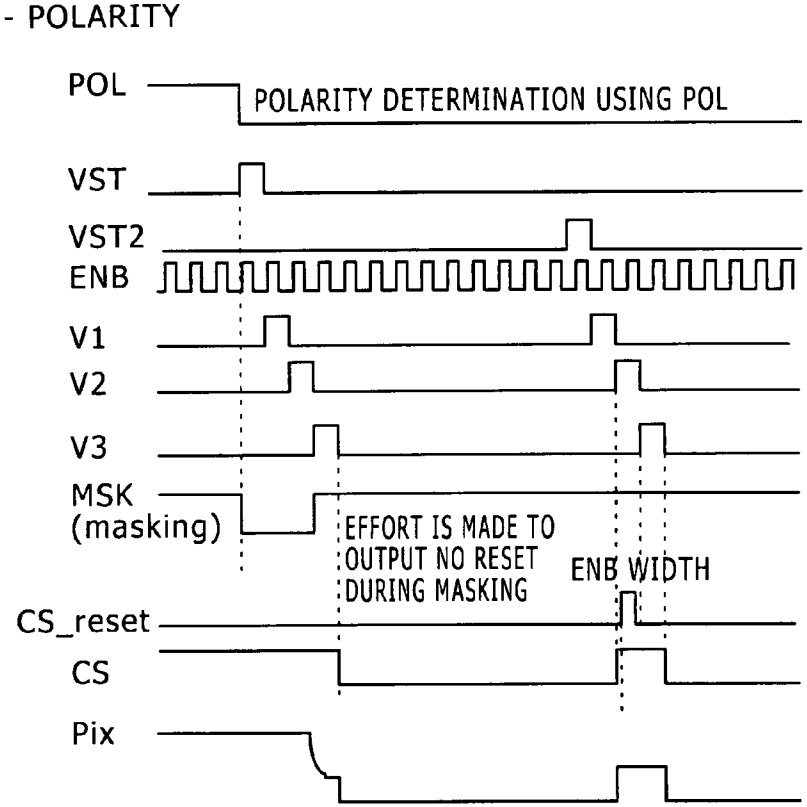

FIGS. 47A and 47B show timing charts of signals appearing in the electric-potential deformation preventing circuit 400 shown in FIG. 46.

As shown in FIG. 46, the electric-potential deformation preventing circuit 400 includes a two-input OR gate 401, shift registers 402 to 404, an SR flip-flop (SRFF) 405, a 3-input AND gate 406, a CS reset circuit 407, a CS latch circuit 408 and an output buffer 409. The two-input OR gate 401 receives a transfer pulse VST (also referred to as a vertical start pulse VST) used for normal signal write operations and another rewrite transfer pulse VST2 used for video signal rewrite operations, computing a logical sum of the normal-write transfer pulse VST and the other rewrite transfer pulse VST2. The shift registers 402 to 404 are wired to the output terminal of the two-input OR gate 401 in a cascade connection forming a series circuit. The SRFF 405 is set by the transfer pulse VST used for normal signal write operations and reset by a pulse V3 generated by the shift register 404 provided at the last stage of the cascade connection. The SRFF 405 outputs an active-low masking signal MSK from an inverted output terminal XQ thereof. The 3-input AND gate 406 receives an output pulse V2 generated by the shift register 403 provided at the middle stage of the cascade connection, the masking signal MSK and an enable signal ENB, computing a logical product of the output pulse V2, the masking signal MSK and the enable signal ENB. The CS reset circuit 407 inputs an output signal S406 from the 3-input AND gate 406 synchronously with a polarity synchronization pulse POL and outputs a CS reset signal Cs_reset to the CS latch circuit 408. The CS latch circuit 408 latches an output pulse V3 from the SRG 404 synchronously with the polarity synchronization pulse POL and resets the latched data in accordance with the CS reset signal Cs_reset received from the CS reset circuit 407. The output buffer 409 is a buffer for outputting a signal from the CS latch circuit 408 as the capacitor signal CS.

As described above, the electric-potential deformation preventing circuit 400 shown in FIG. 46 employs the CS reset circuit 407, making it possible to carry out a rewrite preparation process.

The CS reset circuit 407 recognizes the present polarity of the capacitor signal CS and carries out a reset operation (or the rewrite preparation process) in a direction opposite to the recognized polarity. For this reason, the CS reset circuit 407 makes use of the pulse V2 received from the shift register 403 by way of the 3-input AND gate 406 so that the rewrite preparation process can be carried out immediately before the operation to rewrite the video signal into the pixel circuit.

In addition, in order to change the capacitor signal CS in a direction opposite to the present polarity of the capacitor signal CS, that is, in order to change the capacitor signal CS in a direction causing a CS coupling effect to occur in a direction opposite to the direction of the other CS coupling effect which will occur at the rewrite time, it is necessary to determine the present polarity of the capacitor signal CS. That is why the CS reset circuit 407 also receives the polarity recognition pulse POL.

In addition, during a reset operation, the CS reset signal Cs_reset is not output.

In this typical configuration, the operation to write the video signal into the pixel circuit is carried out with a timing determined by the pulse V3.

Figure 48:
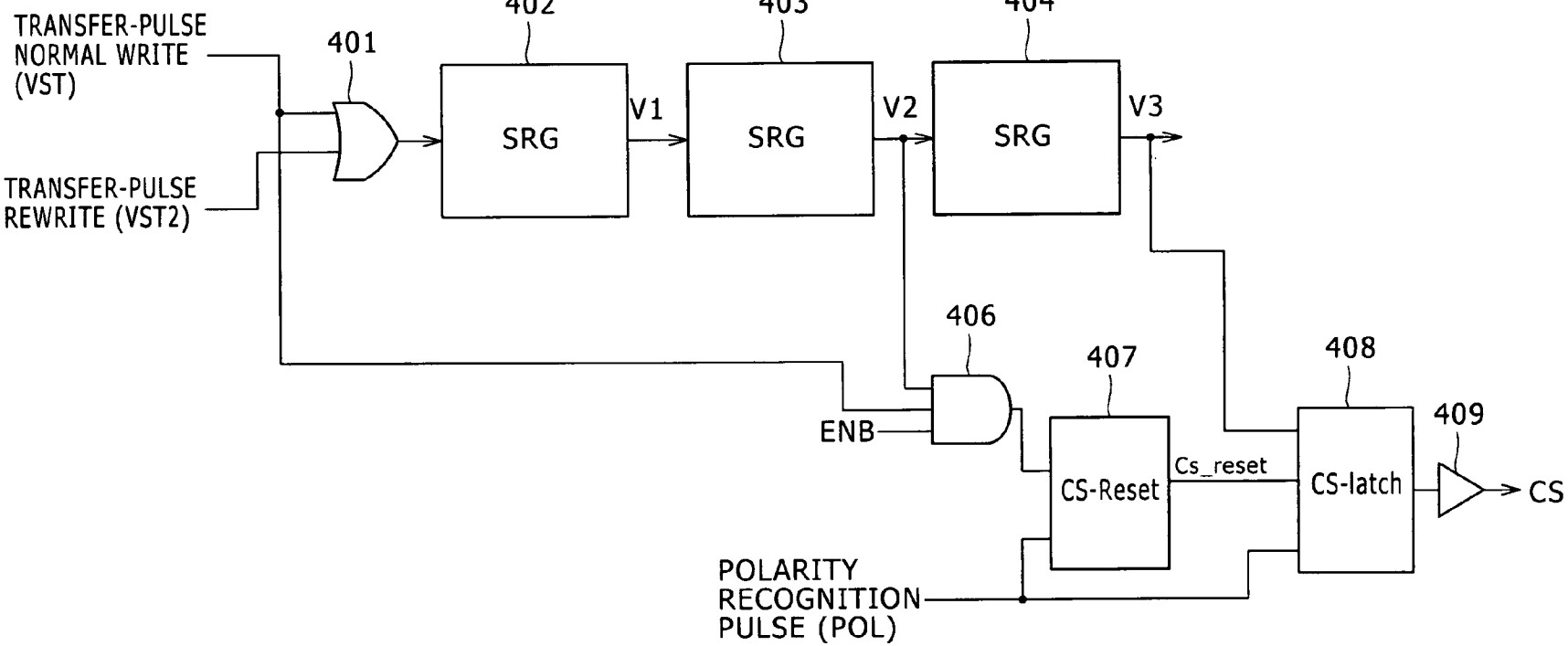
FIG. 48 is a diagram showing a second typical configuration of the electric-potential deformation preventing circuit for preventing a detected electric potential from being deformed in a process of shorting lines, which convey signals at electric potentials each appearing in a monitor pixel electric potential, to each other.
Figure 49B:
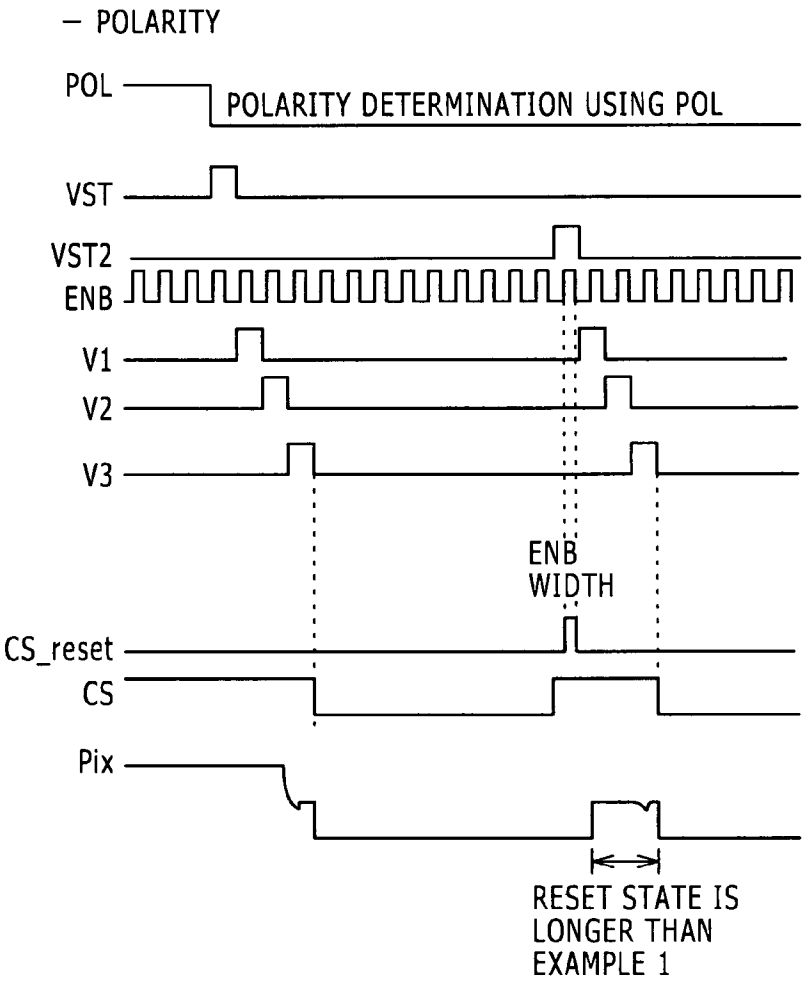
FIGS. 49A and 49B show timing charts of signals appearing in the electric-potential deformation preventing circuit shown in FIG. 48.
Figure 49A:
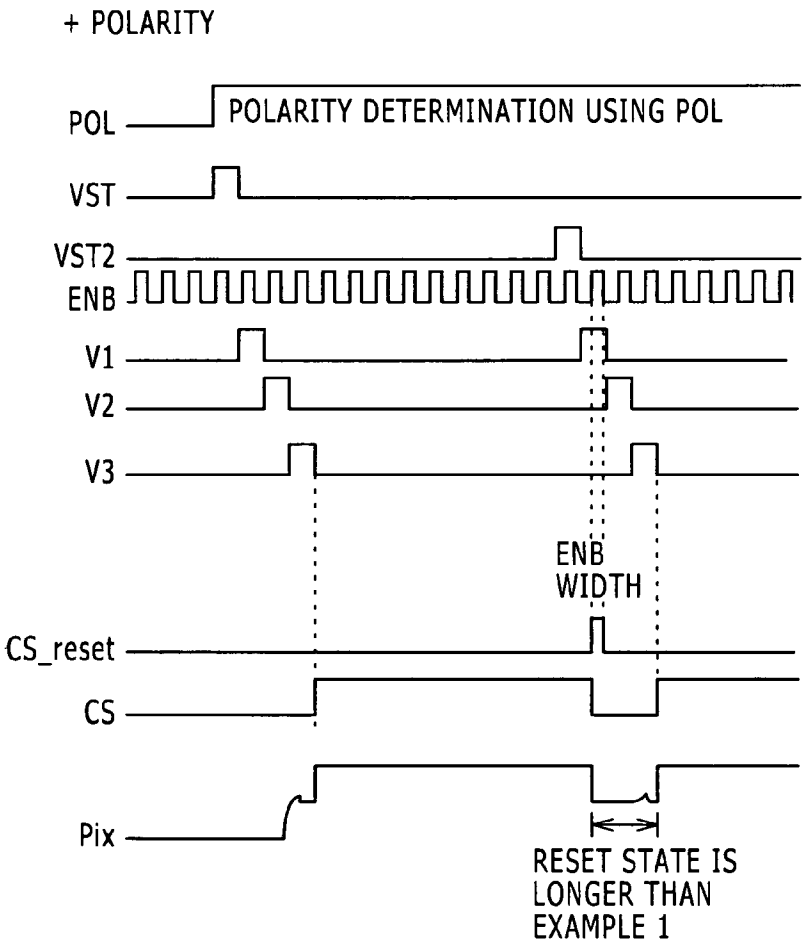

FIG. 48 is a diagram showing a second typical configuration an electric-potential deformation preventing circuit 400A for preventing a detected electric potential from being deformed in a short process of electric potentials each appearing in a monitor pixel electric potential. FIGS. 49A and 49B show timing charts of FIG. 48.

In the electric-potential deformation preventing circuit 400A shown in FIG. 48, the rewrite preparation process is carried out without considering the masking period set by the SRFF 405 employed in the electric-potential deformation preventing circuit 400 shown in FIG. 46. However, the configuration of the electric-potential deformation preventing circuit 400A is simpler than the configuration of the electric-potential deformation preventing circuit 400 shown in FIG. 46 in that the electric-potential deformation preventing circuit 400A does not include the SRFF 405 employed in the electric-potential deformation preventing circuit 400. It is also possible to provide the electric-potential deformation preventing circuit 400A with a configuration in which the rewrite preparation process is carried out with a timing determined by the rewrite transfer pulse VST2.

The electric-potential deformation preventing circuit 400A shown in FIG. 48 is useful for a long reset period as far as the reset period is acceptable.

It is to be noted that each of the electric-potential deformation preventing circuit 400 and the electric-potential deformation preventing circuit 400A can be integrated in the active-matrix display apparatus 100 by adoption of an LTPS technology or attached to the active-matrix display apparatus 100 as a COG, a COF or the like.

Next, the layout of gate lines in the monitor circuit 120 is explained.

As described previously, in this embodiment, the gate lines are provided so as to form the so-called nesting layout. Basically, however, if the time constant of the gate line in the display pixel (or the effective pixel) is different from the time constant of the gate line in the monitor pixel, there will also be a difference in generated electric potential between the display pixel and the monitor pixel. If there is a difference in generated electric potential between the display pixel circuit and the monitor pixel, it is feared that the output of each of the correction is shifted from the target electric potential intended for the display pixel.

In order to solve the problem described above, the monitor pixel with a gate line having a small time constant is provided with an adjustment resistor. To put it concretely, an ingenious attempt is made to devise the shape of the gate line in the monitor pixel so that the gate line also serves as a resistor. In this way, the time constant of the gate line in the monitor pixel can be made equal to the time constant of the gate line in the display pixel. Thus, the problem is solved.

Figure 50A:
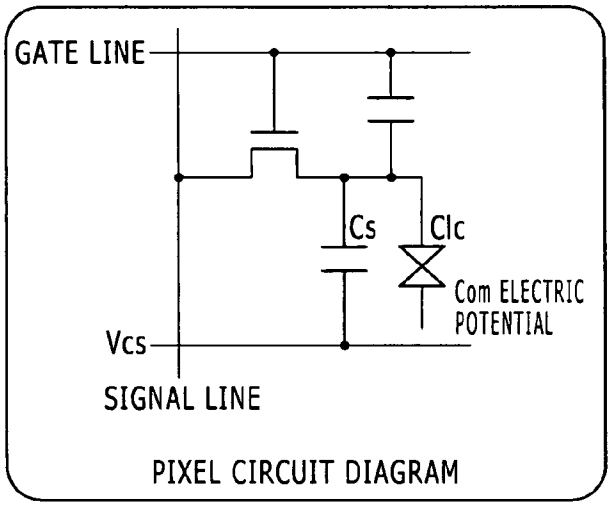
FIGS. 50A to 50C are each an explanatory diagram to be referred to in description of causes of the difference in generated electric potential between a display pixel circuit and a monitor pixel electric potential.
Figure 50B:
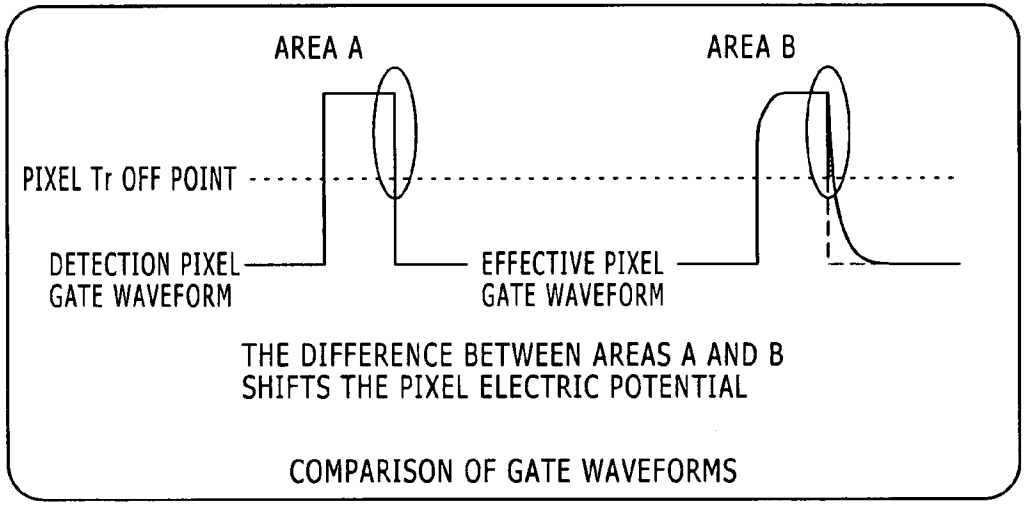
Figure 50C:
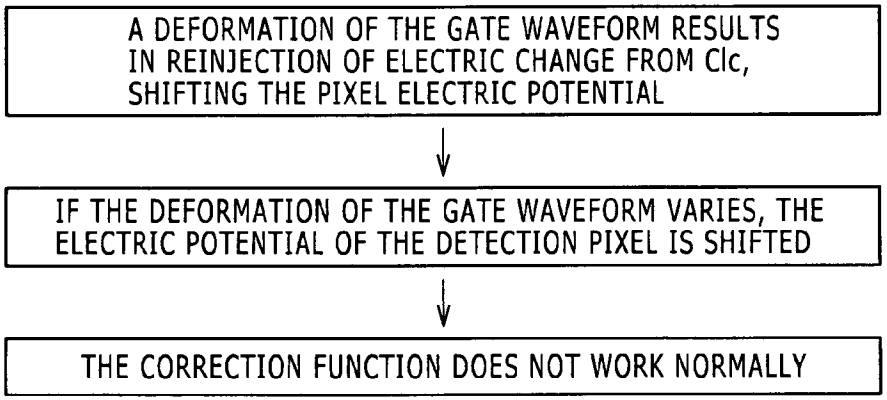

Each of FIGS. 50A to 50C is an explanatory diagram referred to in description of causes of the difference in generated electric potential between the display pixel circuit and the monitor pixel. To be more specific, FIG. 50A is a diagram showing an equivalent of a pixel unit whereas FIG. 50B is a diagram showing a comparison of the waveforms of signals applied to gate electrodes. FIG. 50C is an explanatory diagram showing a description of phenomena occurring along the time axis as a description of causes of differences in time constant.

As shown in the diagrams of FIGS. 50A to 50C, in general, the deformation of a signal applied to the gate causes electric charge to be re-injected from the liquid-crystal capacitance Ccl so that the electric potential appearing in the pixel circuit is shifted.

If the deformation of a signal applied to the gate of the transistor employed in the monitor pixel (also referred to as a detection pixel) is different from the deformation of a signal applied to the gate of the transistor employed in the display pixel, the shift of the electric potential appearing in the monitor pixel is also different from the shift of the electric potential appearing in the display pixel. As a result, it is feared that the signal correction circuit does not work correctly in some cases.

Figure 51B:
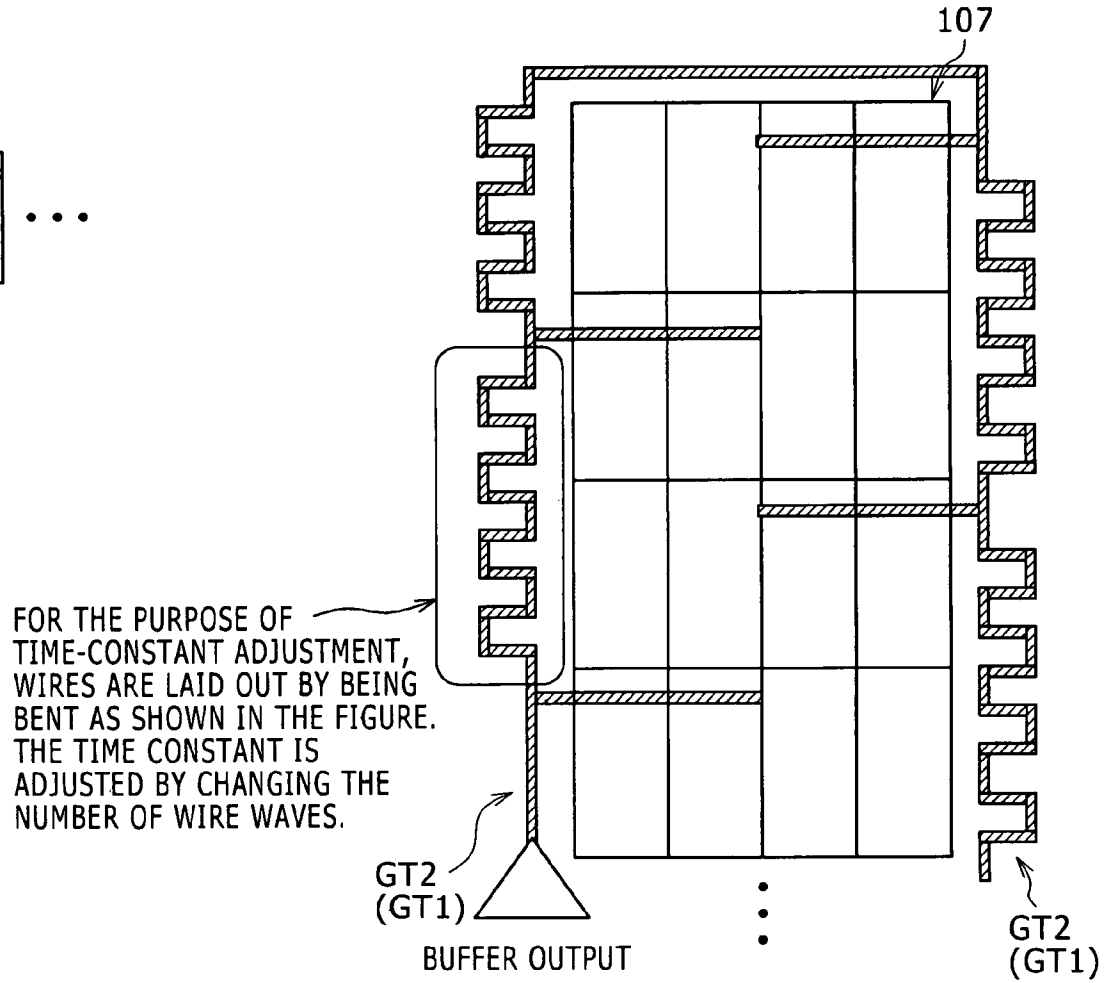
FIG. 51B is a diagram showing a layout model of a monitor pixel 1 (also referred to as a detection pixel 1) according to the embodiment.
Figure 51A:
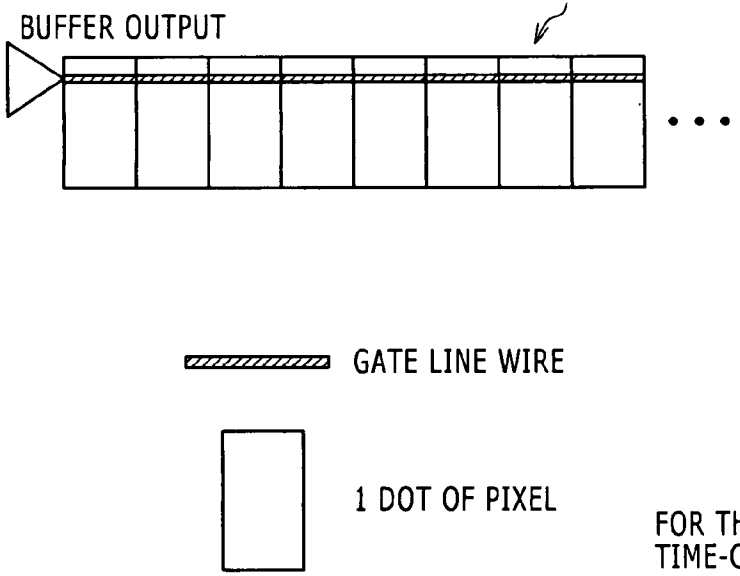

FIG. 51A is a diagram showing a layout model of an effective pixel (also referred to as a display pixel) according to the embodiment whereas FIG. 51B is a diagram showing a layout model of a monitor pixel (also referred to as a detection pixel) according to the embodiment.

In the embodiment, in order to adjust the time constants of gate lines GT1 and GT2 in the monitor circuit 120, each of the gate lines G1 and G2 is bent to form a zigzag shape as shown in FIG. 51B. In the case of a gate line bent to form a zigzag shape, the time constant of the gate line is determined by the number of zigzag waves.

Figure 52A:
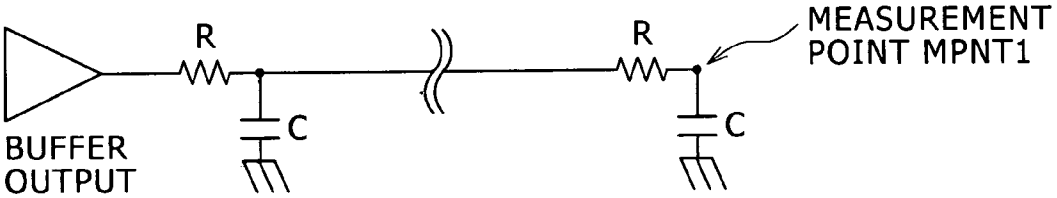
FIGS. 52A and 52B are each an explanatory diagram to be referred to in description of a method for making the time constants of gate lines match each other.
Figure 52B:
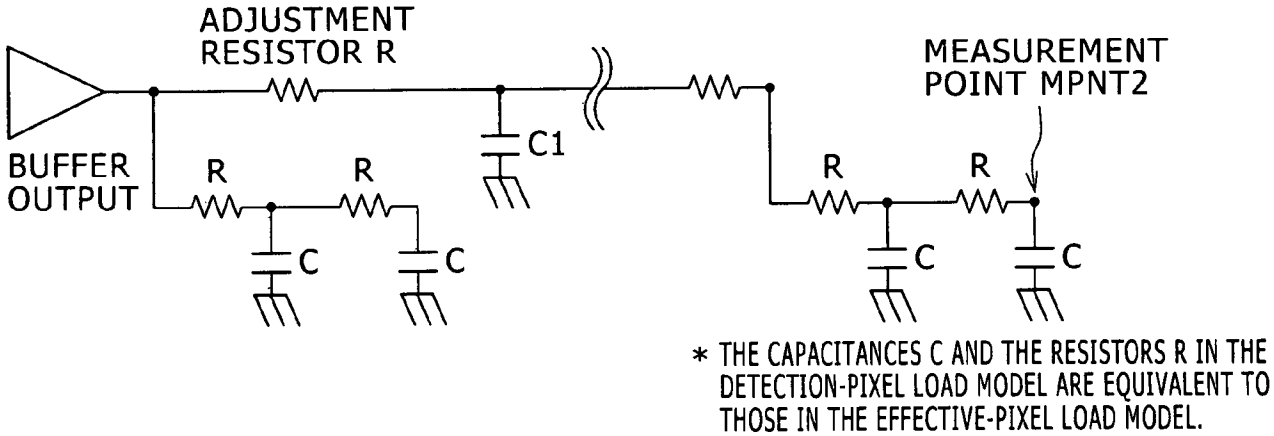

Each of FIGS. 52A and 52B is an explanatory diagram referred to in description of a method for making the time constants of gate lines match each other.

In the examples shown in the diagrams of FIGS. 52A and 52B, the layouts of resistive wires are devised so that the time constant at a measurement point MPNT1 in a display pixel load model matches the time constant at a measurement point MPNT2 in a monitor pixel load model.

Figure 53A:
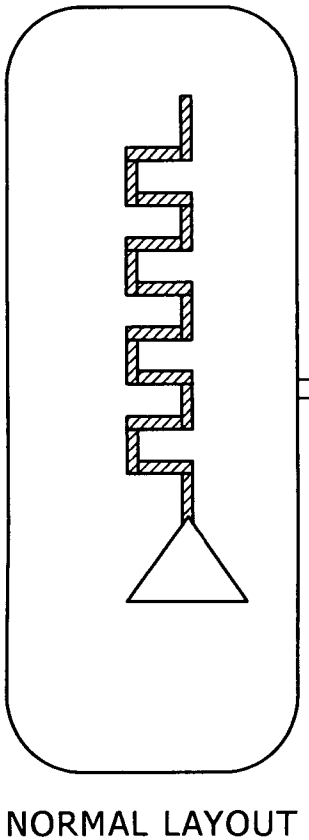
FIGS. 53A to 53C are each a diagram showing an example of making use of a layout option taken in the method for making the time constants of gate lines match each other.
Figure 53B:
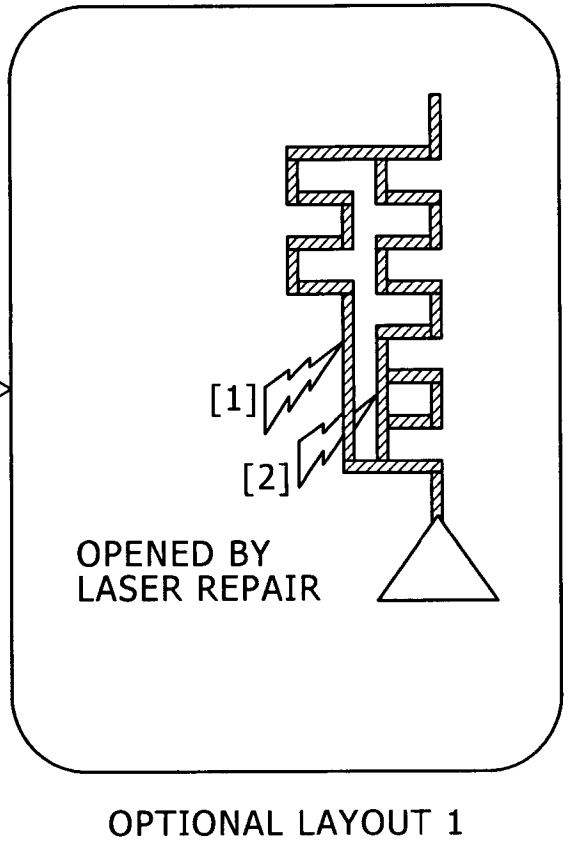
Figure 53C:
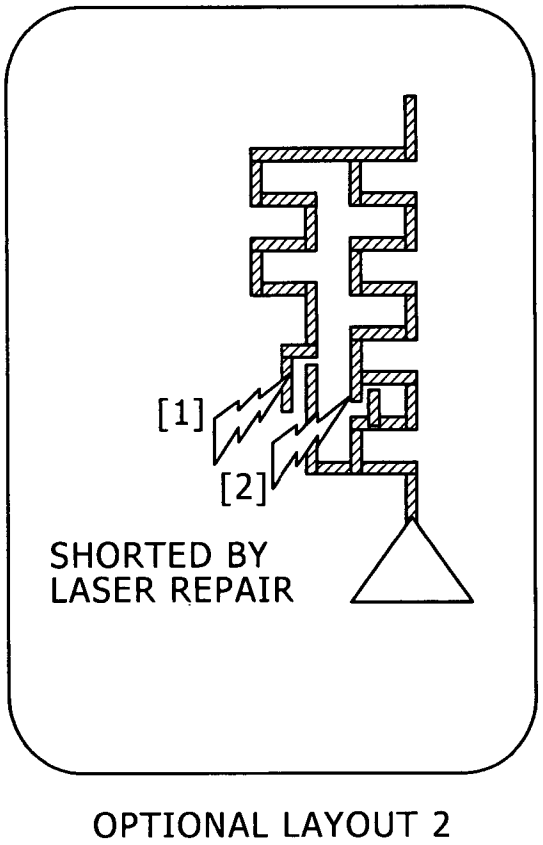

Each of FIGS. 53A to 53C is a diagram showing an example of making use of a layout option taken in the method for making the time constants of gate lines match each other.

In the examples shown in the diagrams of FIGS. 53A and 53B, an ordinary layout can also be changed to a parallel-line layout such as option layout 1 or 2. If a detected electric potential becomes abnormal after the manufacturing process, the time constant can be adjusted by adoption of the laser-repair technique.

The above description has explained a system for automatically adjusting (or correcting) the center value of the common voltage Vcom. Next, the value of the common voltage Vcom according to the embodiment is described.

In the embodiment, the common voltage Vcom, which is typically a series of pulses with a small amplitude and a polarity typically changing once every H (horizontal scan period), is supplied through the supply line 112 to the second pixel electrode of the liquid-crystal cell LC201 employed in every display pixel circuit PXLC of the effective pixel section 101, the second pixel electrode of the liquid-crystal cell LC301 employed in every detection pixel electric potential of the first monitor pixel section 107-1 and the second pixel electrode of the liquid-crystal cell LC311 employed in every detection pixel electric potential of the second monitor pixel section 107-2 as a signal common to all pixel circuits.

Each of the amplitude ΔVcom of the common voltage Vcom and a difference ΔVcs can be set at a selected value optimizing both the black luminance and the white luminance. As described earlier, the difference ΔVcs is the difference between the first level CSH of the capacitor signal CS and second level CSL of the capacitor signal CS.

For example, as will be described later, each of the amplitude ΔVcom of the common voltage Vcom and the CS electric potential ΔVcs is set at such a value that an effective pixel electric potential ΔVpix_W applied to the liquid crystal cell in a white display does not exceed 0.5 V.

A common-voltage generation circuit for generating the common voltage Vcom can be embedded in the liquid-crystal display panel or provided as a circuit external to the liquid-crystal display panel. If the common-voltage generation circuit is provided as a circuit external to the liquid-crystal display panel, the common voltage Vcom is supplied as an external voltage to the liquid-crystal display panel.

The small amplitude ΔVcom is generated due to a capacitive coupling effect. As an alternative, the small amplitude ΔVcom can also be generated digitally.

It is desirable to generate the small amplitude ΔVcom having a very small magnitude typically in a range of about 10 mV to 1.0 V. This is because, if the small amplitude ΔVcom has a magnitude outside the range, the amplitude ΔVcom will reduce effects such as an effect of improving a response speed in the event of overdriving and an effect of reducing acoustic noises.

As described above, each of the amplitude ΔVcom of the common voltage Vcom and the difference ΔVcs can be set at a selected value optimizing both the black luminance and the white luminance. As explained earlier, the difference ΔVcs is the difference between the first level CSH of the capacitor signal CS and second level CSL of the capacitor signal CS.

For example, as will be described later, each of the amplitude ΔVcom of the common voltage Vcom and the CS electric potential ΔVcs is set at such a value that an effective pixel electric potential ΔVpix_W applied to the liquid crystal cell in a white display does not exceed 0.5 V.

The capacitive coupling driving method according to the embodiment is described in more detail as follows.

FIGS. 54A to 54E show the timing charts of main driving waveforms including the liquid-crystal cell in accordance with the embodiment. To be more specific, FIG. 54A shows the timing chart of the gate pulse GP_N, FIG. 54B shows the timing chart of the common voltage Vcom, FIG. 54C shows the timing chart of the capacitor signal CS_N, FIG. 54D shows the timing chart of the video signal Vsig and FIG. 54E shows the timing chart of the signal Pix_N applied to the liquid-crystal cell.

In the capacitive coupling driving operation carried out in accordance with the embodiment, the common voltage Vcom is not a fixed DC voltage. Instead, the common voltage Vcom is a series of pulses with a small amplitude and a polarity typically changing once every horizontal scan period or once every 1H. The common voltage Vcom is supplied to the second pixel electrode of the liquid-crystal cell LC201 employed in every display pixel circuit PXLC of the effective pixel section 101, the second pixel electrode of the liquid-crystal cell LC301 employed in every detection pixel electric potential of the first monitor pixel section 107-1 and the second pixel electrode of the liquid-crystal cell LC311 employed in every detection pixel electric potential of the second monitor pixel section 107-2 as a signal common to all pixel circuits.

In addition, the capacitor lines 105-1 to 105-*m* are provided independently of each other for the m respective rows of the matrix in the same way as the gate lines 104-1 to 104-*m*. The vertical driving circuit 102 also asserts capacitor signals CS1 to CSm on the capacitor lines 105-1 to 105-*m* respectively. Each of the capacitor signals CS1 to CSm is set selectively at a first level CSH such as a voltage in the range three to four V or a second level CSL such as zero V.

In the capacitive coupling driving operation, the effective pixel electric potential ΔVpix applied to the liquid crystal can be expressed by Eq. (7) given as follows.

[Eq. 7]

$$\Delta V\text{pix3}=V\text{sig}+\{Ccs/(Ccs+Clc+Cg+Csp)\}\Delta Vcs+\{Clc/(Ccs+Clc+Cg+Csp)\}\Delta V\text{com}/2-V\text{com}\approx V\text{sig}+\{Ccs/(Ccs+Clc)\}\Delta Vcs+\{Clc/(Ccs+Clc)\}\Delta V\text{com}/2-V\text{com} \quad (7)$$

Notations used in Eq. (7) are explained by referring to FIGS. 54 and 55 as follows. Notation Vsig denotes the video signal voltage appearing on the signal line 106. Notation Ccs denotes the capacitance of the storage capacitor CS201. Notation Clc denotes the capacitance of the liquid crystal cell LC201. Notation Cg is a stray capacitance between the node ND201 and the gate line 104. Notation Csp is a stray capacitance between the node ND201 and the signal line 106. Notation ΔVcs denotes the electric potential of the capacitor signal CS appearing on the capacitor line 105. Notation Vcom denotes the common voltage applied to the second pixel electrode of the liquid-crystal cell LC201 as a signal common to all pixel circuits.

The second term {Ccs/(Ccs+Clc)}ΔVcs of the approximation equation in Eq. (7) is a term causing the white luminance side to become black or to sink due to the nonlinearity property of the liquid crystal dielectric constant. On the other hand, the third term {Clc/(Ccs+Clc)}ΔVcom/2 is a term causing the white luminance side to become more white or to float due to the nonlinearity property of the liquid crystal dielectric constant.

That is to say, the capacitive coupling driving operation is carried out by compensating for a sinking portion by making use of a function to make the low electric potential side (or the white luminance side) white, that is, a function to float the low electric potential side (or the white luminance side). The sinking portion is a trend portion caused by the second term, which is a term to make the low electric potential side (or the white luminance side) black. For this reason, each of the CS electric potential ΔVcs and an amplitude ΔVcom is set at such a value that both the black luminance and the white luminance can be optimized. As a result, an optimum contrast level can be obtained.

Figure 56A:
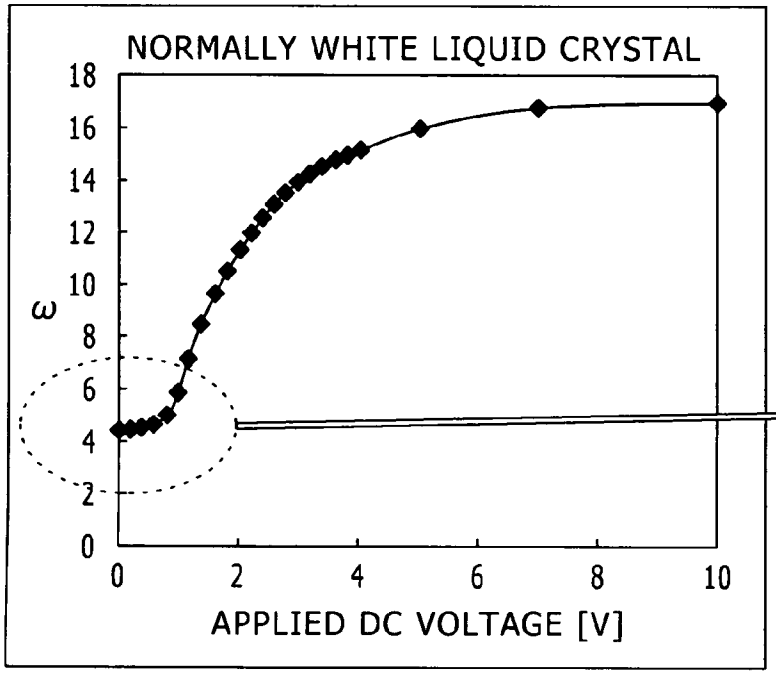
FIGS. 56A and 56B are each an explanatory diagram to be referred to in description of a criterion for selecting the value of an effective pixel electric potential applied to a liquid-crystal cell in a white display in the case of a normally white liquid-crystal cell used in the liquid-crystal display apparatus as a liquid-crystal material.
Figure 56B:
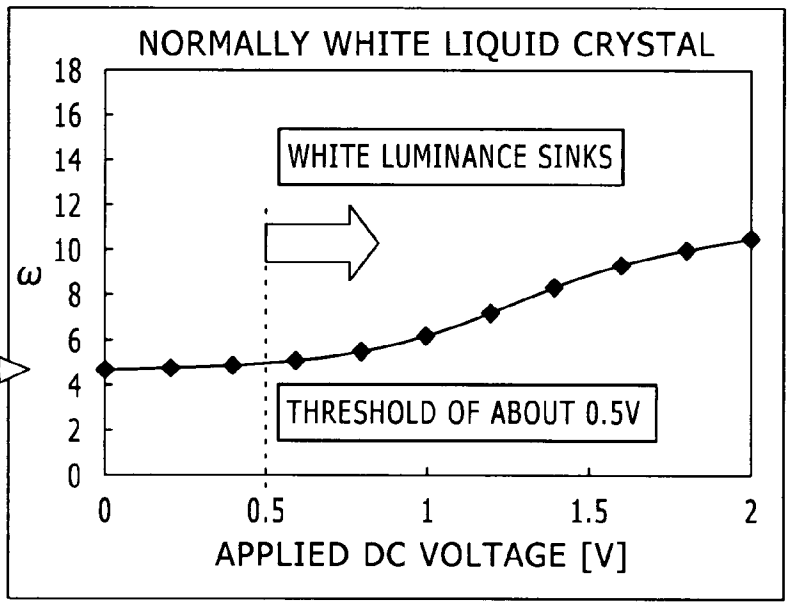

Each of FIGS. 56A and 56B is an explanatory diagram referred to in description of a criterion for selecting the value of the effective pixel electric potential ΔVpix_W applied to the liquid-crystal cell in a white display in the case of a normally white liquid-crystal cell used in the liquid-crystal display apparatus 100 as a liquid-crystal material. That is to say, in this case, the liquid crystal material used in the liquid-crystal display apparatus 100 is the normally white liquid crystal. To put it in detail, FIG. 56A is a diagram showing a characteristic representing a relation between the liquid crystal dielectric constant ϵ and the voltage applied to the liquid crystal whereas FIG. 56B is an enlarged diagram showing a portion enclosed by an ellipse as a portion of the characteristic shown in FIG. 56A.

In accordance with the characteristic of the liquid crystal material used in the liquid-crystal display apparatus 100, as shown in the diagrams of FIG. 56, if a voltage at least equal to about 0.5 V is applied to the liquid-crystal cell, the white luminance sinks inevitably. Thus, in order to optimize the white luminance, it is necessary to keep the effective pixel electric potential ΔVpix_W applied to the liquid-crystal cell in a white display at a value not greater than 0.5 V. For this reason, each of the CS electric potential ΔVcs and the amplitude ΔVcom is set at such a value that the effective pixel electric potential ΔVpix_W applied to the liquid crystal does not exceed 0.5 V.

An actual evaluation indicates that, by setting the CS electric potential ΔVcs at 3.8 V and the amplitude ΔVcom at 0.5 V, an optimum contrast level can be obtained.

Figure 57:
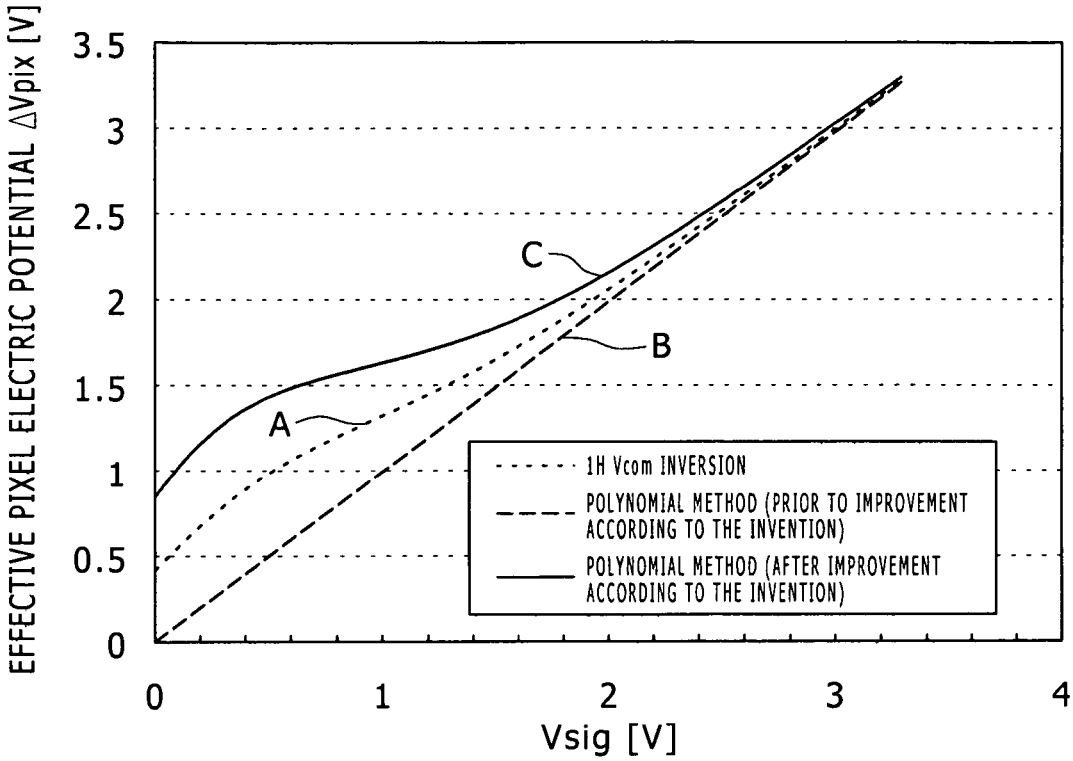
FIG. 57 is a diagram showing relations between a video signal voltage and an effective pixel electric potential for three driving methods, i, e., a driving method according to the embodiment of the present invention, a relevant capacitive-coupling driving method and the ordinary 1H Vcom driving method.

FIG. 57 is a diagram showing relations between the video signal voltage and the effective pixel electric potential for three driving methods, i, e., a driving method according to the embodiment of the present invention, a relevant capacitive-coupling driving method and the ordinary 1H Vcom driving method.

In FIG. 57, the horizontal axis represents the video signal Vsig whereas the vertical axis represents the effective pixel electric potential ΔVpix. In FIG. 57, a curve A represents a characteristic expressing the relation between the video signal voltage Vsig and the effective pixel electric potential ΔVpix for the driving method according to the embodiment of the present invention. A curve C represents a characteristic expressing the relation between the video signal voltage Vsig and the effective pixel electric potential ΔVpix for the relevant capacitive-coupling driving method. A curve B represents a characteristic expressing the relation between the video signal voltage Vsig and the effective pixel electric potential ΔVpix for the ordinary 1H Vcom driving method.

As is obvious from the characteristics shown in FIG. 57, the driving method according to the embodiment of the present invention provides a sufficiently improved characteristic representing the relation between the video signal voltage Vsig and the effective pixel electric potential ΔVpix in comparison with the relevant capacitive-coupling driving method.

Figure 58:
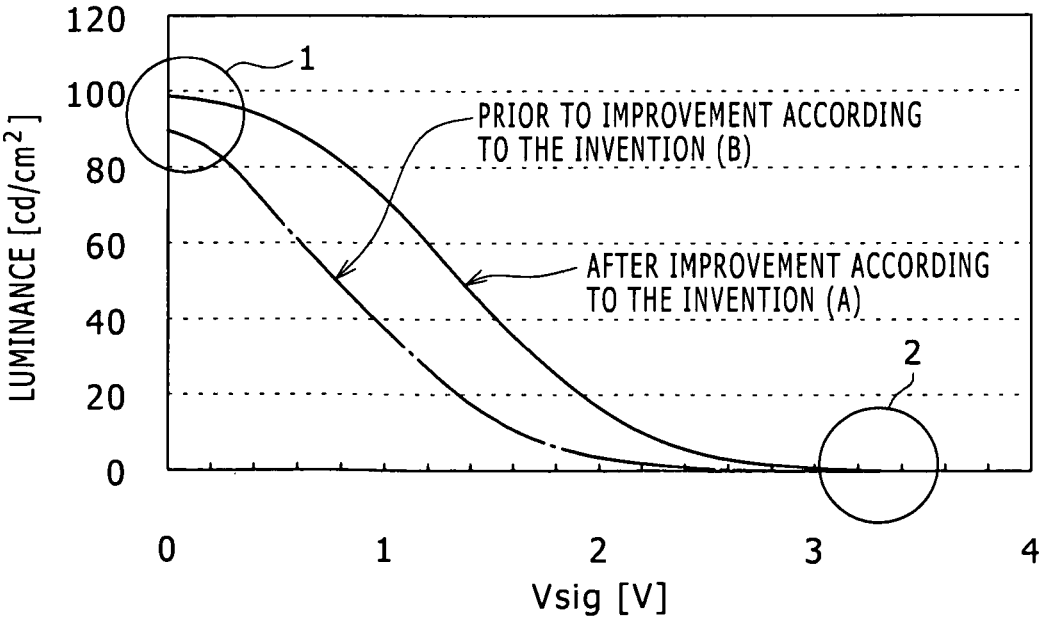
FIG. 58 is a diagram showing relations between the video signal voltage and the luminance for the driving method according to the embodiment of the present invention and the relevant capacitive-coupling driving method.

FIG. 58 is a diagram showing relations between the video signal voltage Vsig and the luminance for the driving method according to the embodiment of the present invention and the relevant capacitive-coupling driving method.

In FIG. 58, the horizontal axis represents the video signal Vsig whereas the vertical axis represents the luminance. In FIG. 58, a curve A represents a characteristic expressing the relation between the video signal voltage Vsig and the luminance for the driving method according to the embodiment of the present invention whereas a curve B represents a characteristic expressing the relation between the video signal voltage Vsig and the luminance for the relevant capacitive-coupling driving method.

As is obvious from the characteristics shown in FIG. 58, when the black luminance (2) is optimized in accordance with the relevant capacitive-coupling driving method, the white luminance (1) sinks as shown by the curve B. In accordance with the driving method according to the embodiment of the present invention, on the other hand, the amplitude of the common voltage Vcom is made small so that both the black luminance (2) and the white luminance (1) can be optimized as shown by the curve A.

Eq. (8) given below shows the values of the effective pixel electric potential ΔVpix_B for a black display and the effective pixel electric potential ΔVpix_W for a white display for the driving method according to the embodiment. The values of the effective pixel electric potential ΔVpix_B for a black display and the effective pixel electric potential ΔVpix_W for a white display are obtained by actually inserting numerical values into Eq. (4) for the driving method according to the embodiment as substitutes for their respective terms of Eq. (4).

By the same token, Eq. (9) given below shows the values of the effective pixel electric potential ΔVpix_B for a black display and the effective pixel electric potential ΔVpix_W for a white display for the relevant capacitive-coupling driving method. The values of the effective pixel electric potential ΔVpix_B for a black display and the effective pixel electric potential ΔVpix_W for a white display are obtained by actually inserting numerical values into Eq. (1) for the relevant capacitive-coupling driving method as substitutes for their respective terms of Eq. (1).

[Eq. 8]

(1):For a black display:

$$\begin{aligned}\Delta\text{Vpix_B} &= Vsig + \{Ccs/(\text{Clc_b} + Ccs)\}\Delta Vcs + \\ &\quad \{\text{Clc_b}/(\text{Clc_b} + Ccs)\}\Delta Vcom/2 - Vcom \\ &= 3.3\,\text{V} + 1.65\text{V} - 1.65\,\text{V} \\ &= 3.3\,\text{V} \leftarrow \text{The black luminance is optimized.}\end{aligned}$$

(2):For a white display:

$$\begin{aligned}\Delta\text{Vpix_B} &= Vsig + \{Ccs/(\text{Clc_w} + Ccs)\}\Delta Vcs + \\ &\quad \{\text{Clc_w}/(\text{Clc_w} + Ccs)\}\Delta Vcom/2 - Vcom \\ &= 0.zero\ \text{V} + 2.05\,\text{V} - 1.65\,\text{V} \\ &= 0.4\,\text{V} \leftarrow \text{The white luminance is optimized.}\end{aligned}$$

[Eq. 9]

(1):For a black display:

$$\Delta Vpix_W = Vsig + \{Ccs/(Clc_w + Ccs)\}\Delta Vcs - Vcom$$

$$= 3.3\,V + 1.65\,V - 1.65\,V$$

$$= 3.3\,V \leftarrow \text{The black luminance is optimized.}$$

(2):For a white display:

$$\Delta Vpix_W = Vsig + \{Ccs/(Clc_w + Ccs)\}\Delta Vcs - Vcom$$

$$0.zero\ V + 2.45\,V - 1.65\,V$$

$$0.8\,V \leftarrow \text{The white luminance sinks.}$$

As is obvious from Eqs. (8) and (9), in the case of a black display, the effective pixel electric potential ΔVpix_B is 3.3 V for both the driving method according to the embodiment and the relevant driving method. Thus, the black luminance is optimized. As is obvious from Eq. (9), however, in the case of a white display, the effective pixel electric potential ΔVpix_W is 0.8 V, which is greater than 0.5 V, for the relevant driving method. Thus, the white luminance inevitably sinks as explained previously by referring to the diagram of FIG. 56B.

As is obvious from Eq. (8), however, in the case of a white display, the effective pixel electric potential ΔVpix_W is 0.4 V, which is smaller than 0.5 V, for the driving method according to the embodiment. Thus, the white luminance is optimized as explained earlier by referring to FIG. 56B.

One of characteristics of the embodiment is that the embodiment is a typical concrete implementation of the active-matrix display apparatus 100 in which the correction circuit 111 corrects the electric potential Vcs of the capacitor signal CS in accordance with pixel electric potentials detected by the first monitor pixel section 107-1 and the second monitor pixel section 107-2, which are employed in the monitor circuit 120, in order to optimize the optical characteristic of the active-matrix display apparatus 100. In concrete typical configurations of correction systems to be described below, typically, the first monitor pixel section 107-1 is a section designed for the positive (or negative) polarity whereas the second monitor pixel section 107-2 is a section designed for the negative (or positive) polarity. A system for correcting the electric potential Vcs of the capacitor signal CS is a Vcs correction system 111A to be described later by referring to FIG. 59.

In this embodiment, the dielectric constant of the liquid-crystal cell varies due to changes of the driving temperature, the thickness of an insulation film employed in the storage capacitor Cs201 varies due to variations generated in the mass production of the products and the gap of the liquid-crystal cell varies also due to variations generated in the mass production. These variations in dielectric constant, insulation-film thickness and cell gap cause an electric potential applied to the liquid-crystal cell to vary. For this reason, the variations in dielectric constant, insulation-film thickness and cell gap are electrically detected by monitoring the variations of the electric potential applied to the liquid-crystal cell in order to suppress the variations of the electric potential. In this way, it is possible to eliminate the effects of the dielectric-constant variations caused by the changes of the driving temperature, the insulation-film thickness variations caused by the variations generated in the mass production and the cell gap variations also caused by the variations generated in the mass production.

That is to say, the liquid-crystal display panel according to the embodiment employs monitor (or detection) pixel each functioning as a dummy pixel circuit also referred to as a sensor pixel for detecting the variations caused by driving-temperature changes and caused by the mass production of the products. The result of the detection is used for correcting electric potentials appearing on storage lines or correcting the operation of the reference driver. As a result, it is possible to implement a liquid-crystal display apparatus capable of optimizing (or correcting) the luminance.

It is to be noted that a reference driver not shown in FIG. 4 functions as a gradation-voltage generation circuit for generating pixel video data to be conveyed by signal lines.

That is to say, the system for correcting the operation of the reference driver in accordance with pixel electric potentials detected by the first monitor pixel section 107-1 and the second monitor pixel section 107-2, which are employed in the monitor circuit 120, functions as a system for correcting the electric potential Vsig of the video signal Sig.

Figure 59:
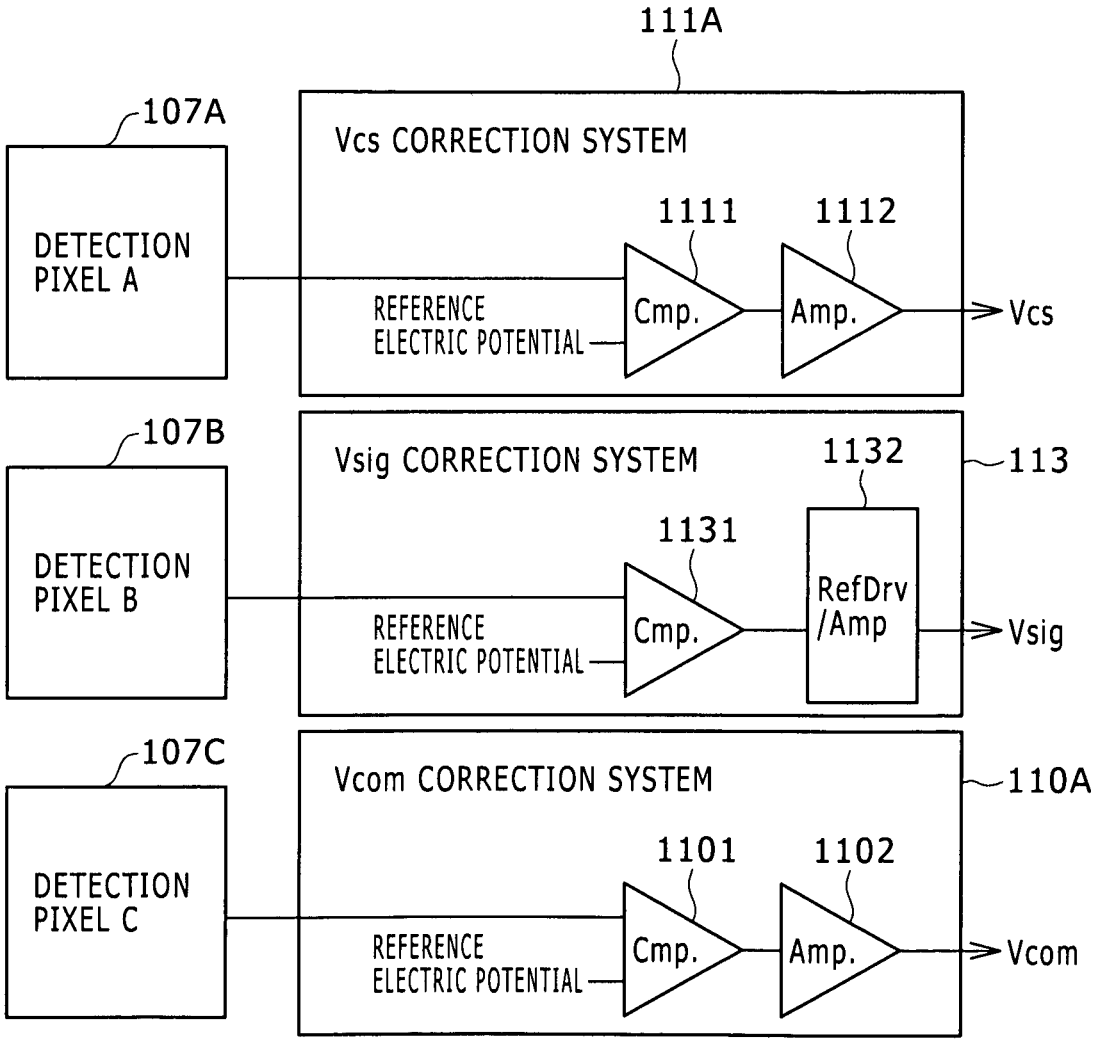
FIG. 59 is a diagram showing a typical configuration including 3 signal correction systems for 3 monitor pixel sections (each referred to as a detection pixel section, a sensor pixel section or a dummy pixel section) respectively.

As explained above, the correction system of the active-matrix display apparatus 100 according to the embodiment corrects the operation of the reference driver in accordance with pixel electric potentials detected by the first monitor pixel section 107-1 employed in the monitor circuit 120 as a section designed for the positive (or negative) polarity and the second monitor pixel section 107-2 employed in the monitor circuit 120 as a section designed for the negative (or positive) polarity. As shown in FIG. 59, the correction system includes a Vcom correction system 110A functioning as a first correction system, the aforementioned Vcs correction system 111A functioning as a second correction system and the aforementioned Vsig correction system 113 functioning as a third correction system. The Vcom correction system 110A is the detection-result output circuit 110 employed in the monitor circuit 120 whereas the Vcs correction system 111A is the correction circuit 111 cited before.

The Vcom correction system 110A employs a comparator 1101 and an amplifier 1102 as main components. By the same token, the Vcs correction system 111A employs a comparator 1111 and an amplifier 1112 as main components. In the same way, the Vsig correction system 113 employs a comparator 1131 and an amplifier 1132 as main components.

It is to be noted that each of the detection pixel sections (each referred to as a monitor pixel section) 107A, 107B and 107C shown in FIG. 59 have functions equivalent to those of the first monitor pixel section 107-1 employed in the monitor circuit 120 as a section designed for the positive (or negative) polarity and the second monitor pixel section 107-2 also employed in the monitor circuit 120 as a section designed for the negative (or positive) polarity.

The configuration shown in FIG. 59 is a typical configuration having the 3 detection pixel sections 107A, 107B and 107C provided for systems.

However, such a configuration leads to an increased circuit area.

Figure 60:
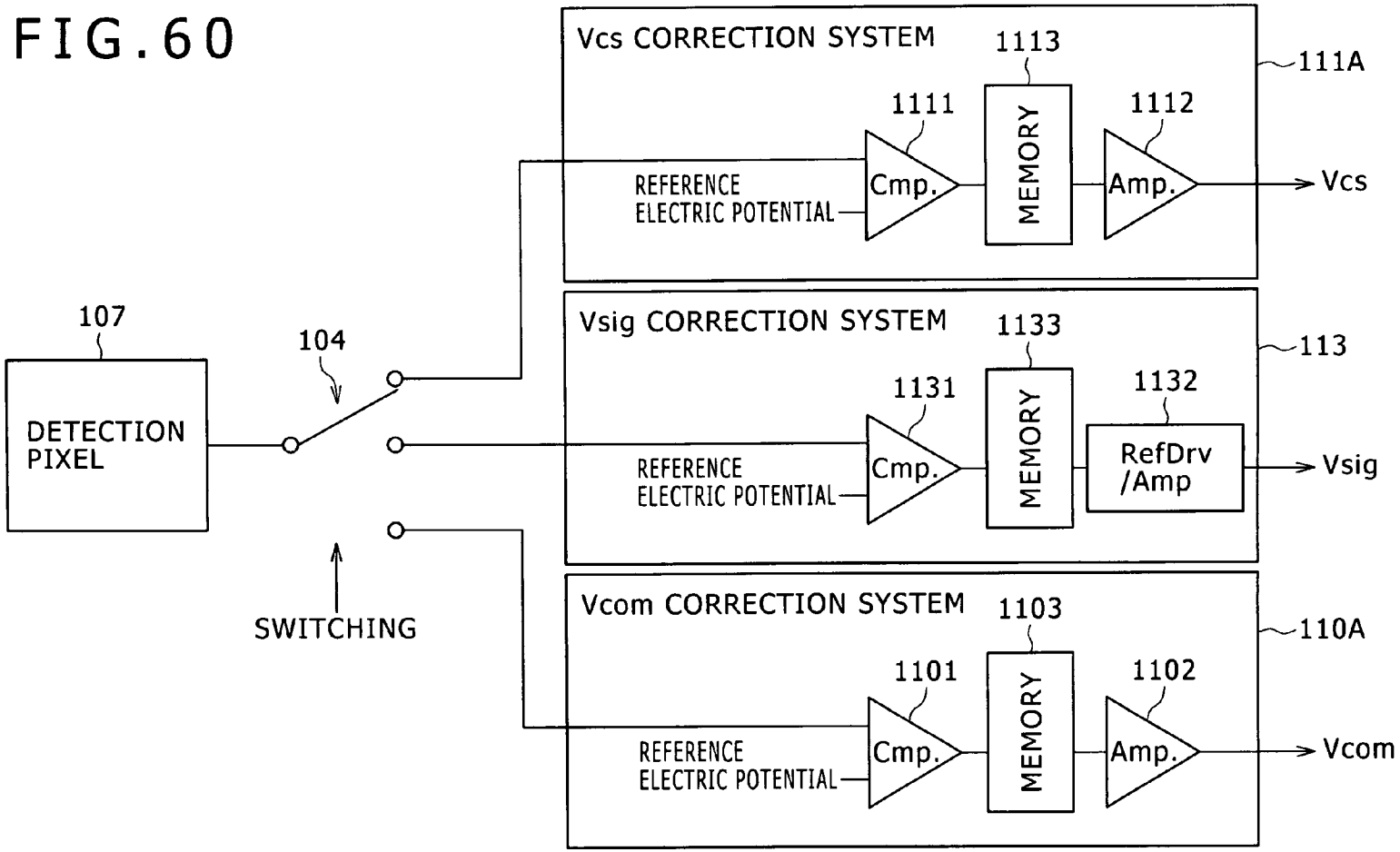
FIG. 60 is a diagram showing a typical configuration including a plurality of signal correction systems and one monitor pixel section (also referred to as a detection pixel section) shared by the signal correction systems.

In order to solve the problem of an increased circuit area, this embodiment is provided with one detection pixel section 107 as shown in FIG. 60. The detection pixel section 107 is connected selectively to input a pixel electric potential to the Vcs correction system 111A, the Vsig correction system 113 and the Vcom correction system 110A by making use of a switch circuit 114. It is to be noted that the configuration shown in FIG. 60 is a typical configuration in which the one detection pixel section 107 (also referred to as a monitor pixel section) is shared by a plurality of systems.

The switch circuit 114 has an active (fixed) contact point a and 3 passive contact points b, c and d. The fixed contact point a is connected the output terminal of the detection pixel section 107 to serve as a contact point for receiving a pixel electric potential detected by the detection pixel section 107. The 3 passive contact points b, c and d are connected to the input terminals of the Vcom correction system 110A, the Vsig correction system 113 and the Vcs correction system 111A respectively.

In the Vcom correction system 110A, the output terminal of the comparator 1101 is connected to a memory 1103 used for storing a detection result output by the comparator 1101 as a comparison result output by the comparator 1101. By the same token, in the Vsig correction system 113, the output terminal of the Vsig correction system 113 is connected to a memory 1133 used for storing a detection result output by the comparator 1131 as a comparison result produced by the comparator 1131. In the same way, the Vcs correction system 111A, the output terminal of the comparator 1111 is connected to a memory 1113 used for storing a detection result output by the comparator 1111 as a comparison result produced by the comparator 1111. In this way, the detection result generated by the detection pixel section 107 can be switched among the Vcom correction system 110A, the Vsig correction system 113 and the Vcs correction system 111A. It is to be noted that the type of the memories 1103, 1113 and 1133 is by no means limited to a particular memory type. That is to say, for example, each of the memories 1103, 1113 and 1133 can be a DRAM, an SRAM or the like.

With such a configuration, only one detection pixel section 107 can be used in a plurality of signal correction systems provided independently of each other as systems for correcting a variety of signals.

In addition, the operation to switch the detection pixel section 107 among the Vcom correction system 110A, the Vsig correction system 113 and the Vcs correction system 111A by making use of the switch circuit 114 does not have to be carried out in a particular order but it is carried out by arbitrarily assigning a weight to each of the Vcom correction system 110A, the Vsig correction system 113 and the Vcs correction system 111A.

Each of FIGS. 61A to 61D is a diagram referred to in explanation of a typical operation to switch the detection pixel section 107 (also referred to as a monitor pixel section) among a plurality of correction systems provided for correcting a variety of signals as systems sharing the detection pixel section 107.

Figures 61A, 61B, 61C, 61D:
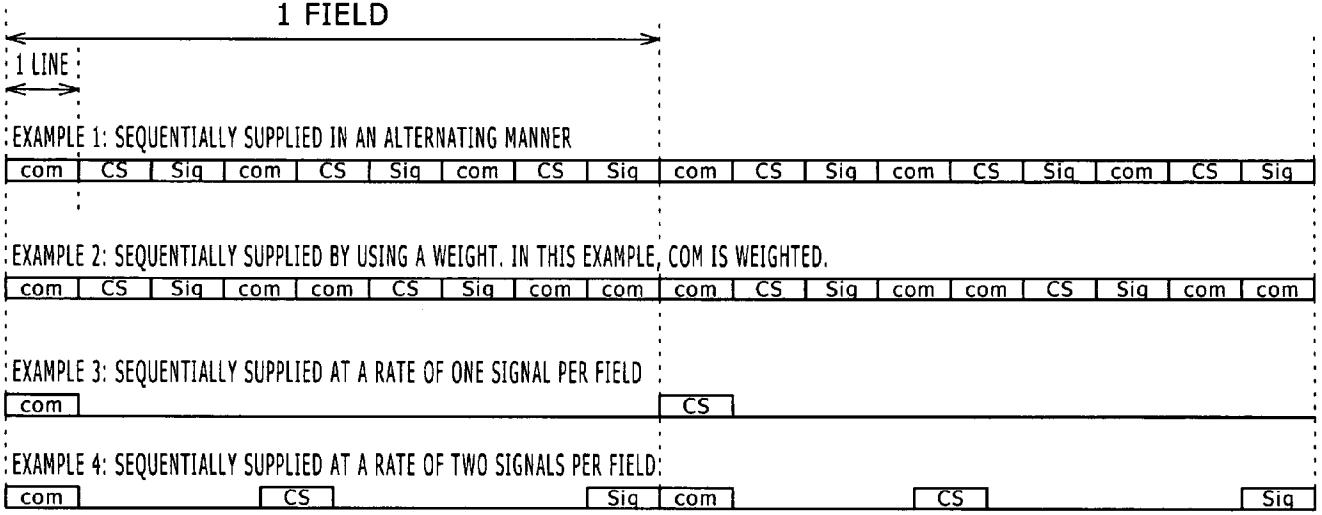
FIGS. 61A to 61D are each a diagram to be referred to in explanation of a typical operation to switch a detection pixel section (also referred to as a monitor pixel section) among a plurality of correction systems provided for correcting a variety of signals as systems sharing the detection pixel section.

To be more specific, FIG. 61A is a diagram showing a typical operation to switch the detection pixel section 107 among a plurality of correction systems by turns. FIG. 61B is a diagram showing a typical operation to switch the detection pixel section 107 among a plurality of correction systems by assigning a weight to the system for correcting the common voltage Vcom. To put it in detail, the pixel electric potential detected by the detection pixel section 107 is supplied to the Vcom correction system 110A twice or three times in a row before supplying the detected pixel electric potential to the Vcs correction system 111A and the Vsig correction system 113 sequentially. FIG. 61C is a diagram showing a typical operation to switch the detection pixel section 107 among a plurality of correction systems once a field. FIG. 61D is a diagram showing a typical operation to switch the detection pixel section 107 among a plurality of correction systems twice a field.

It is to be noted that, it is not necessary to stick with a driving method such as a field driving method or a line driving method as long as a desired pixel electric potential can be obtained.

Each of the signal correction systems can be integrated in the active-matrix display apparatus 100 by adoption of the LTPS technology or attached to the active-matrix display apparatus 100 as a COG, a COF or the like.

Figure 62:
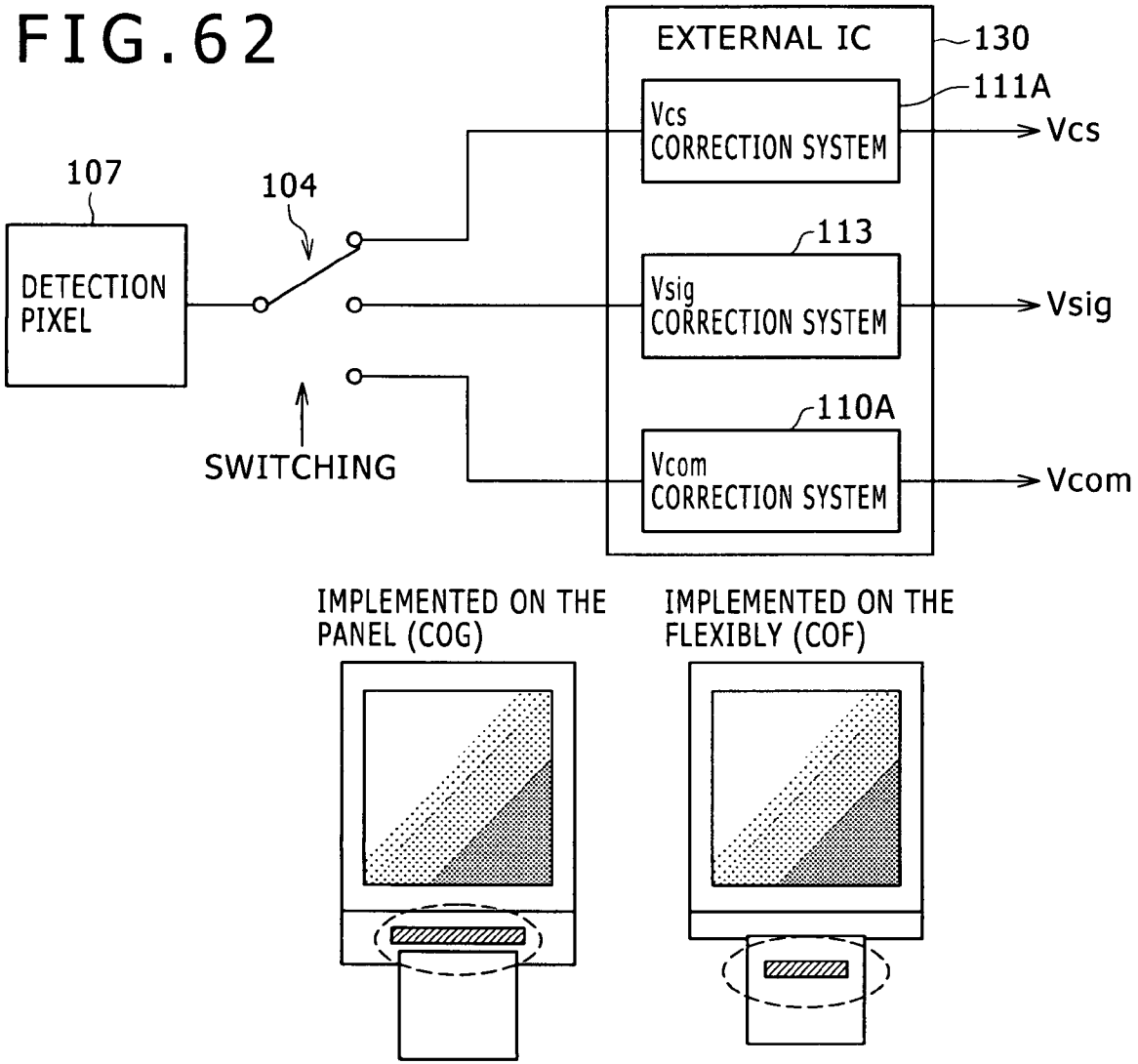
FIG. 62 is a diagram showing a typical configuration in which a Vcom correction system, a Vcs correction system and a Vsig correction system are mounted on an external IC.

FIG. 62 is a diagram showing a typical configuration in which the Vcom correction system 110A, the Vcs correction system 111A and the Vsig correction system 113 are mounted on an external IC130.

The number of signal correction systems is by no means limited to 3. For example, it is possible to provide a configuration in which any two of the signal correction systems can be incorporated. Each of FIGS. 63A to 63C is a diagram showing a configuration in which two of the three signal correction systems are incorporated.

Figure 63A:
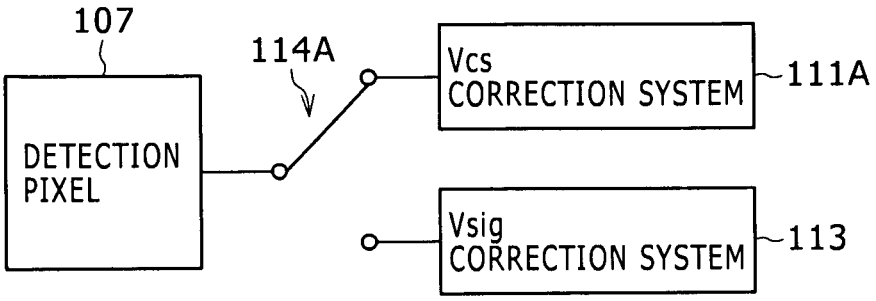
FIGS. 63A to 63C are each a diagram showing a configuration in which two of the Vcom correction system, the Vcs correction system and the Vsig correction system are incorporated.

To be more specific, FIG. 63A is a diagram showing a configuration in which 2 signal correction systems, that is, the Vcs correction system 111A and the Vsig correction system 113 are incorporated, and the detection pixel section 107 is switched from the Vcs correction system 111A to the Vsig correction system 113 and vice versa by making use of the switch circuit 114. Likewise, FIG. 63B is a diagram showing a configuration in which two signal correction systems, that is, the Vcom correction system 110A and the Vcs correction system 111A are incorporated, and the detection pixel section 107 is switched from the Vcom correction system 110A to the Vcs correction system 111A and vice versa by making use of the switch circuit 114. Similarly, FIG. 63C is a diagram showing a configuration in which two signal correction systems, that is, the Vcom correction system 110A and the Vsig correction system 113 are incorporated, and the detection pixel section 107 is switched from the Vcom correction system 110A to the Vsig correction system 113 and vice versa by making use of the switch circuit 114.

Figure 63B:
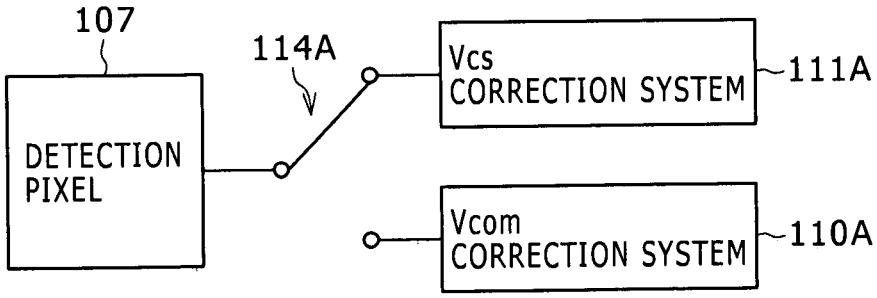
Figure 63C:
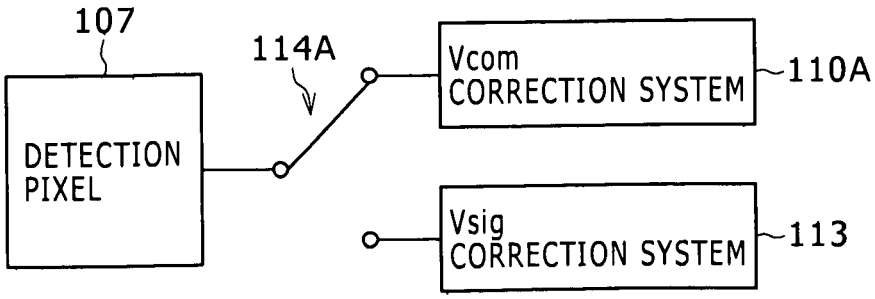
Figure 64:
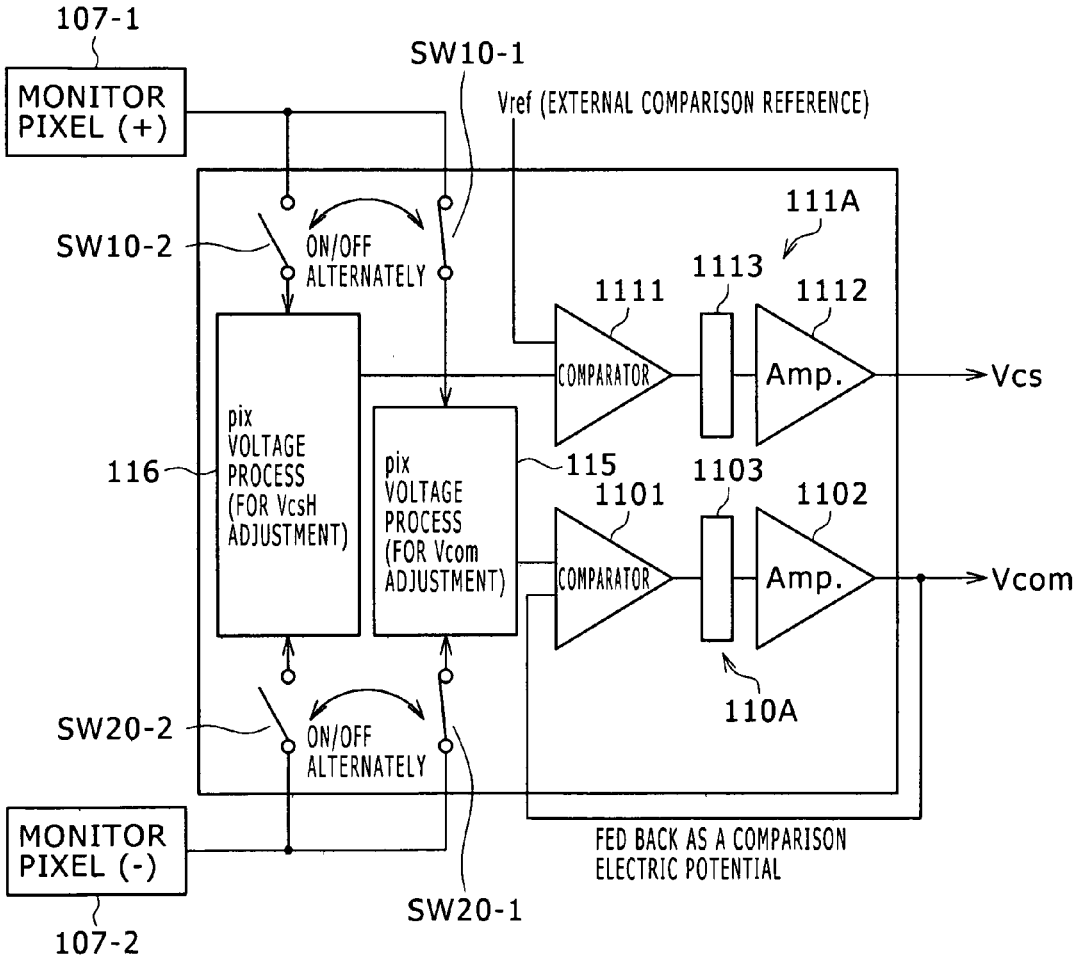
FIG. 64 is a diagram showing a more concrete typical configuration in which two correction systems, i. e. the Vcom correction system and the Vsig correction system, are incorporated.
Figure 65:
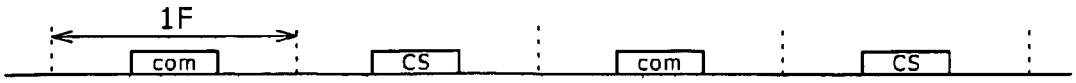
FIG. 65 is a diagram showing typical timings with which the circuit shown in FIG. 64 switches the monitor detection sections from the Vcom correction system to the Vsig correction system and vice versa.

FIG. 64 is a diagram showing a more concrete typical configuration in which two signal correction systems, that is, the Vcom correction system 111A and the Vcs correction system 111A are incorporated much like the configuration shown in FIG. 63B. FIG. 65 is a diagram showing typical timings. With these timings, the circuit shown in FIG. 64 switches the first monitor pixel section 107-1 and the second monitor pixel section 107-2, which correspond to the detection pixel section 107 shown in FIG. 63B, from the Vcom correction system 110A to the Vcs correction system 111A and vice versa. It is to be noted that the configuration shown in FIG. 64 is a typical configuration in which the first monitor pixel section 107-1 is driven as a pixel circuit of the positive polarity whereas the second monitor pixel section 107-2 is driven as a pixel circuit of the negative polarity.

The first monitor pixel section 107-1 is connected to a pixel electric-potential processing circuit 115 for processing the storage signal Vcs through a switch SW10-1 and connected to a pixel electric-potential processing circuit 116 for processing the common voltage Vcom through a switch SW10-2. By the same token, the second monitor pixel section 107-2 is connected to the pixel electric-potential processing circuit 115 through a switch SW20-1 and connected to the pixel electric-potential processing circuit 116 through a switch SW20-2.

The output terminal of the pixel electric-potential processing circuit 115 is connected to one of two input terminals of the comparator 1101 employed in the Vcom correction system 110A. By the same token, the output terminal of the pixel electric-potential processing circuit 116 is connected to one of two input terminals of the comparator 1111 employed in the Vcs correction system 111A.

The switches SW10-1 and SW10-2 are put in a turned-on and turned-off states alternately. By the same token, the switches SW20-1 and SW20-2 are also put in a turned-on and turned-off states alternately. However, the switches SW10-1 and SW20-1 operate synchronously with each other in order to connect and disconnect the first monitor pixel section 107-1 and the second monitor pixel section 107-2 respectively to and from the pixel electric-potential processing circuit 115. By the same token, the switches SW10-2 and SW20-2 operate synchronously with each other in order to connect and disconnect the first monitor pixel section 107-1 and the second monitor pixel section 107-2 respectively to and from the pixel electric-potential processing circuit 116.

With the configuration described above, electric potentials of both polarities for detection of the common voltage Vcom and electric potentials of both polarities for detection of the storage signal Vcs are monitored alternately at intervals of one field (or one F). The result of monitoring the electric potentials for detection of the common voltage Vcom is supplied to the Vcom correction system 110A during a particular field whereas the result of monitoring the electric potentials for detection of the storage signal Vcs is supplied to the Vcs correction system 111A during a field following the particular field.

Next, the operation of the configuration described above is explained.

Each of the vertical shift registers VSR employed in the vertical driving circuit 102 receives a vertical start pulse VST generated by a clock generator not shown in the figure as a pulse serving as a command to start a vertical scan operation and a vertical clock signal generated by the clock generator as a clock signal serving as the reference of the vertical scan operation. It is to be noted that the vertical clock signal is typically vertical clock signals VCK and VCKX having phases opposite to each other.

In each the shift registers VSR, the level of the vertical clock pulses is shifted and the vertical clock pulses are delayed by a delay time varying from pulse to pulse. For example, in each of the shift registers VSR, the normal-write transfer pulse VST starts a shift operation synchronous with the vertical clock signal VCK and a pulse shifted out from the shift register VSR is supplied to a gate buffer provided for the shift register VSR.

In addition, the normal-write transfer pulse VST is propagated to the shift registers VSR sequentially from the clock generator located above or below the effective pixel section 101. Thus, basically, pulses supplied by the shift registers VSR synchronously with the vertical clock signal are asserted on the gate lines 104-1 to **104-*m* by way of the gate buffers associated with the shift registers VSR in order to drive the gate lines 104-1 to 104-*m*** in order.

The vertical driving circuit 102 drives the gate lines 104-1 to **104-*m* and the capacitor lines 105-1 to 105-*m* sequentially, starting typically from the first gate line 104-1 and the first capacitor line 105-1 respectively. After a gate pulse GP is asserted on a gate line (one of the gate lines 104-1 to 104-*m*) in order to write a video signal into a pixel circuit PXLC connected to the gate line, the level of the capacitor signal (one of the capacitor signals CS1 to CSm) conveyed by the capacitor line (one of the capacitor lines 105-1 to 105-*m*) connected to the pixel circuit PXLC to supply the capacitor signal to the pixel circuit PXLC is changed from the first level CSH to the second level CSL or vice versa by the switch (one of the switches SW1 to SWm) connected to the capacitor line. The capacitor signals CS1 to CSm conveyed by the capacitor lines 105-1 to 105-*m*** respectively are set at the first level CSH or the second level CSL in an alternate way described as follows.

For example, when the vertical driving circuit 102 supplies the capacitor signal CS1 set at the first level CSH to the pixel circuit PXLC through the first capacitor line 105-1, the vertical driving circuit 102 then supplies the capacitor signal CS2 set at the second level CSL to the pixel circuit PXLC through the second capacitor line 105-2, the capacitor signal CS3 set at the first level CSH to the pixel circuit PXLC through the third capacitor line 105-3 and the capacitor signal CS4 set at the second level CSL to the pixel circuit PXLC through the fourth capacitor line 105-4 subsequently. In the same way, the vertical driving circuit 102 thereafter sets the capacitor signals CS5 to CSm at the first level CSH or the second level CSL alternately and supplies the capacitor signals CS5 to CSm to the pixel circuit PXLC through the capacitor lines 105-5 to **105-*m*** respectively.

The capacitor signal is corrected by the Vcs correction system 111A to a predetermined electric potential on the basis of electric potentials detected from first monitor pixel section 107-1 and the second monitor pixel section 107-2 which are employed in the monitor circuit 120.

The common voltage Vcom alternating at a small amplitude of ΔVcom is supplied to the second pixel electrode of the liquid-crystal cell LC201 employed in every pixel circuit PXLC in the effective pixel section 101 as a signal common to all the pixel circuits PXLC.

The center value of the common voltage Vcom is adjusted to an optimum value by the Vcom correction system 110A on the basis of electric potentials detected from first monitor pixel section 107-1 and the second monitor pixel section 107-2 which are employed in the monitor circuit 120.

On the basis of a horizontal start pulse HST serving as a command to start a horizontal scan operation and a horizontal clock signal serving as the reference pulse of the horizontal scan operation, the horizontal driving circuit 103 sequentially samples the input video signal Vsig for every 1H or for each horizontal scan period H in order to write the input video signal Vsig at one time into the pixel circuits PXLC on a row selected by the vertical driving circuit 102 through the signal lines 106-1 to **106-*n***. It is to be noted that, the horizontal clock signal is typically horizontal clock signals HCK and HCKX having phases opposite to each other.

For example, first of all, a selector switch for R is driven and controlled to enter a conductive state. In this state, R data is output to signal lines and written into pixel circuits. After the R data is written into the pixel circuits, a selector switch for G is driven and controlled to enter a conductive state. In this state, G data is output to the signal lines and written into the pixel circuits. After the G data is written into the pixel circuits, a selector switch for B is driven and controlled to enter a conductive state. In this state, B data is output to the signal lines and written into the pixel circuits.

In this embodiment, after a video signal from the signal line has been written into the pixel circuit, that is, after the falling edge of the gate pulse GP, the electric potential appearing on the pixel circuit (that is, the electric potential appearing on the node ND201) is changed by a variation of a capacitor signal on the capacitor line (that is, one of the storage lines 105-1 to **105-*m*) by making use of a capacitive coupling effect through the storage capacitor Cs201. The electric potential appearing on the node ND201** is changed in order to modulate a voltage applied to the liquid-crystal cell.

The common voltage Vcom applied to the second pixel electrode of the liquid-crystal cell LC201 at that time as a signal common to all pixel circuits is not set at a fixed value.

Instead, the common voltage Vcom is a series of pulses with a small amplitude ΔVcom in the range 10 mV to 1.0 V and a polarity typically changing once every horizontal scan period or once every 1H. As a result, not only is the black luminance optimized, but the white luminance is also optimized as well.

As described above, in accordance with the embodiment, when an input voltage is received as a voltage with a dynamic range insufficient for a gradation display, the driving operation is modified only for the black side with large voltage variations. That is to say, the function of the voltage boosting section 142 is disabled only for gradation zero but enabled for gradations one to 63. Thus, it is possible to reduce the power consumption and, at the same time, obtain a dynamic range sufficient for the gradation display.

In addition, in accordance with the embodiment, there is provided a driving method whereby, after the falling edge of a gate pulse GP asserted on a specific one of the gate lines 104-1 to **104-*m*, that is, after pixel video data from a signal line (that is, one of the signal lines 106-1 to 106-*n*) is written into a pixel circuit PXLC connected to the specific gate line 104, the capacitor lines 105-1 to 105-*m* each connected independently for one of the rows are driven as described above, resulting in a capacitive coupling effect of the storage capacitor Cs201 employed in each of the pixel circuits PXLC and, in each of the pixel circuits PXLC, an electric potential appearing on the node ND201 is changed due to the capacitive coupling effect in order to modulate a voltage applied to the liquid-crystal cell LC201**.

Then, in the course of an actual driving operation according to this driving method, a monitor circuit detects an electric potential found as a midpoint of detected electric potentials appearing on monitor pixel circuits PXLC of the first monitor pixel section 107-1 and the second monitor pixel section 107-2, which are provided besides the effective pixel section 101, as electric potentials having the positive and negative polarities and automatically corrects the center value of a common voltage Vcom on the basis of the detected potential midpoint. The center value of the common voltage Vcom is corrected by feeding back the average to the reference driver in order to automatically adjust the center value of the common voltage Vcom. In this patent specification, the electric potential appearing on a monitor pixel circuit PXLC means an electric potential appearing on a connection node ND201 of the monitor pixel circuit PXLC.

By carrying out the operations described above, the effect described below can be obtained.

Since the active-matrix display apparatus 100 includes a system for automatically adjusting the center value of the common voltage Vcom in the liquid-crystal display panel serving as the active-matrix display apparatus 100, the inspection process requiring the cumbersome labor hours is not needed at a shipping time. Thus, even if the center value of the common voltage Vcom is shifted from an optimum value due to the temperature of an environment in which the active-matrix display apparatus 100 is used, the driving method, the driving frequency, the backlight (B/L) luminance or the luminance of incoming light, the system for automatically adjusting the center value of the common voltage Vcom is capable of sustaining the center value of the common voltage Vcom at a value optimum for the environment. As a result, the active-matrix display apparatus 100 offers a merit of the capability of appropriately preventing flickers from being generated on the display screen.

In addition, by adjusting the center value of the common voltage Vcom to an optimum value, it is possible to eliminate the effect of variations in actual pixel electric potential on the quality of the image.

On top of that, this embodiment has a configuration in which the monitor circuit 120 is created independently of the effective pixel section 101 at a location adjacent to the effective pixel section 101 as a circuit employing the first monitor pixel section 107-1, the second monitor pixel section 107-2, the vertical driving circuit (V/CSDRVM) 108, the first monitor horizontal driving circuit (HDRVM1) 109-1 and the second monitor horizontal driving circuit (HDRVM2) 109-2. In addition, the gate lines are provided so as to form the so-called nesting layout. Thus, the embodiment offers a merit of a higher degree of freedom with which the liquid-crystal display panel is designed.

As a result, it is easier to lay out the configuration circuits of the monitor circuit 120, that is, easier to lay out the first monitor pixel section 107-1, the second monitor pixel section 107-2, the vertical driving circuit (V/CSDRVM) 108, the first monitor horizontal driving circuit (HDRVM1) 109-1 and the second monitor horizontal driving circuit (HDRVM2) 109-2.

On top of that, the vertical and horizontal driving circuits designed especially for the monitor pixel section can thus be provided separately from the effective pixel section 101 so that it is possible to solve a problem that the correction operation must be carried out in the blanking period of the video signal. As described previously, this problem is caused by the fact that, in the middle of one frame period, affected by signal line voltage variations due to display pixel circuits each receiving the video signal from the signal line, the electric potential of the monitor pixel electric potential also inevitably changes.

Due to such variations in the liquid-crystal display panel surface and differences in electric potential, errors also exist in the monitor circuit so that it is feared that a detected electric potential is shifted from a target electric potential intended for the display pixel circuit. In order to solve this problem, it is necessary to adopt one of the following two typical methods or a combination of the methods.

In accordance with the first method, video signals having amplitude different from each other are written into monitor pixel so that an offset is deliberately provided to a midpoint electric-potential detected from each of the pixel circuits as an offset for correcting the detected electric potential so as to eliminate the shift of the detected electric potential from the target electric potential intended for the display pixel circuit. In accordance with the second method, on the other hand, each monitor pixel is provided with a capacitor so that an offset is provided deliberately to a detected midpoint electric-potential as an offset for correcting the detected electric potential so as to eliminate the shift of the detected electric potential from the target electric potential intended for the display pixel circuit.

By adopting either one of the first and second methods or a combination of the methods, it is possible to cancel the shift of the detected electric potential from the target electric potential intended for the display pixel circuit.

In addition, in this embodiment, a driving operation is carried out to put each of the switches 121 and 122 in a turned-on state shorting so as to obtain the midpoint of the detected potentials. The embodiment is designed into a configuration in which, after the process of shorting the detection lines, which convey electric potentials detected from monitor pixel electric potentials, to each other in order to obtain the midpoint of the detected potentials, an operation to rewrite a video signal is carried out in order to correct a deformation of each of the detected electric potentials and, hence make it possible to provide electrical protection.

Thus, in this configuration, an electric potential may not be deformed, regardless whether or not a process to rewrite a video signal is carried out after the operation to short the detection lines, which convey electric potentials detected from the monitor pixel electric potentials, to each other. As a result, the pixel function may not deteriorate due to a deformed electric potential as evidenced by for example a burn-in phenomenon.

In addition, in this embodiment, in order to solve the problem described above, the monitor pixel having a small time constant is provided with an adjustment resistor. To put it concretely, an ingenious attempt is made to devise the shape of the gate line in the monitor pixel so that the gate line also serves as a resistor. In this way, the time constant of the gate line in the monitor pixel can be made equal to the time constant of the gate line in the display pixel circuit. Thus, it is possible to lessen the fear that the electric potential appearing in the monitor pixel (also referred to as a detection pixel) is shifted from a target electric potential. As a result, it is no longer feared that the correction function does not work normally.

On top of that, one detection pixel section 107 is included in the embodiment. In the configuration of the embodiment, the electric potential output by the detection pixel section 107 as a result of detection is switched by making use of the switch circuit 114 to be selectively output to the Vcom correction system 110A, the Vcs correction system 111A, the Vsig correction system 113 or the like. In such a configuration, only one detection pixel section 107 is shared by a plurality of signal correction systems and allows the correction systems to be provided independently of each other without entailing an increase in circuit area.

In addition, each of the pixel circuits PXLC includes a thin-film transistor TFT201 functioning as a switching device, a liquid-crystal cell LC201 and a storage capacitor Cs201. The first pixel electrode of the liquid-crystal cell LC201 is connected to the drain (or the source) of the thin-film transistor TFT201. The drain (or the source) of the thin-film transistor TFT201 is also connected to the first electrode of the storage capacitor Cs201. In each of the pixel circuits provided on any individual one of the rows, the second electrode of the storage capacitor is connected to a capacitor line connected to the individual row. In addition, a common voltage signal with a level changing at time intervals determined in advance is supplied to the second pixel electrode of the display element as a signal common to all pixel circuits. Thus, both the black luminance and the white luminance can be optimized. As a result, an optimum contrast level can be obtained.

Furthermore, in this embodiment, the dielectric constant of the liquid-crystal varies due to changes of the driving temperature, the thickness of an insulation film employed in the storage capacitor Cs201 varies due to variations generated in the mass production of the products and the gap of the liquid-crystal varies also due to variations generated in the mass production. These variations in dielectric constant, insulation-film thickness and cell gap cause an electric potential applied to the liquid-crystal to vary. For this reason, the variations in dielectric constant, insulation-film thickness and cell gap are electrically detected by monitoring the variations of the electric potential applied to the liquid-crystal in order to suppress the variations of the electric potential. In this way, it is possible to eliminate the effects of the dielectric-constant variations caused by the changes of the driving temperature, the insulation-film thickness variations caused by the variations generated in the mass production and the cell gap variations also caused by the variations generated in the mass production.

Moreover, the CS driver employed in the vertical driving circuit 102 according to the embodiment identifies the polarity of a capacitor signal CS on the basis of only a polarity, which is observed in an operation to write a signal into a pixel circuit as a polarity observed with a timing indicated by a polarity recognition pulse POL, independently of stages preceding and succeeding the stage of the CS driver and independently of the frame detected for an immediately preceding frame.

The embodiment described so far implements a liquid-crystal display apparatus employing an analog interface driving circuit for receiving an analog video signal supplied to the liquid-crystal display apparatus, latching the analog video signal and writing the latched analog video signal sequentially from point to point into pixel circuits. It is to be noted, however, that the embodiment can also be applied as well to a liquid-crystal display apparatus for receiving a digital video signal and writing the digital video signal into pixel sequentially from line to line by adoption of a selector method.

In addition, as described above, in accordance with the embodiment, there is provided a driving method whereby, after the falling edge of a gate pulse GP asserted on a specific one of the gate lines 104-1 to 104-*m*, that is, after pixel video data from a signal line (that is, one of the signal lines 106-1 to 106-*n*) is written into a pixel circuit PXLC connected to the specific gate line 104, the capacitor lines 105-1 to 105-*m* each connected independently for one of the rows are driven as described above, resulting in a capacitive coupling effect of the storage capacitor Cs201 employed in each of the pixel circuits PXLC and, in each of the pixel circuits PXLC, an electric potential appearing on the node ND201 is changed due to the capacitive coupling effect in order to modulate a voltage applied to the liquid-crystal. On top of that, the embodiment includes an automatic signal correction system in which, during an actual driving operation according to this driving method, a monitor circuit detects an electric potential found as a midpoint of detected electric potentials appearing on monitor pixel circuits PXLCM of the first monitor pixel section 107-1 and the second monitor pixel section 107-2 as electric potentials having the positive and negative polarities and automatically corrects the center value of a common voltage Vcom on the basis of the detected potential midpoint.

It is to be noted, however, that the driving method adopted by the automatic signal correction system for correcting the center value of the common voltage Vcom does not have to be the capacitive coupling driving method. That is to say, the automatic signal correction system may also adopt the ordinary 1H Vcom inversion driving method.

Figure 66:
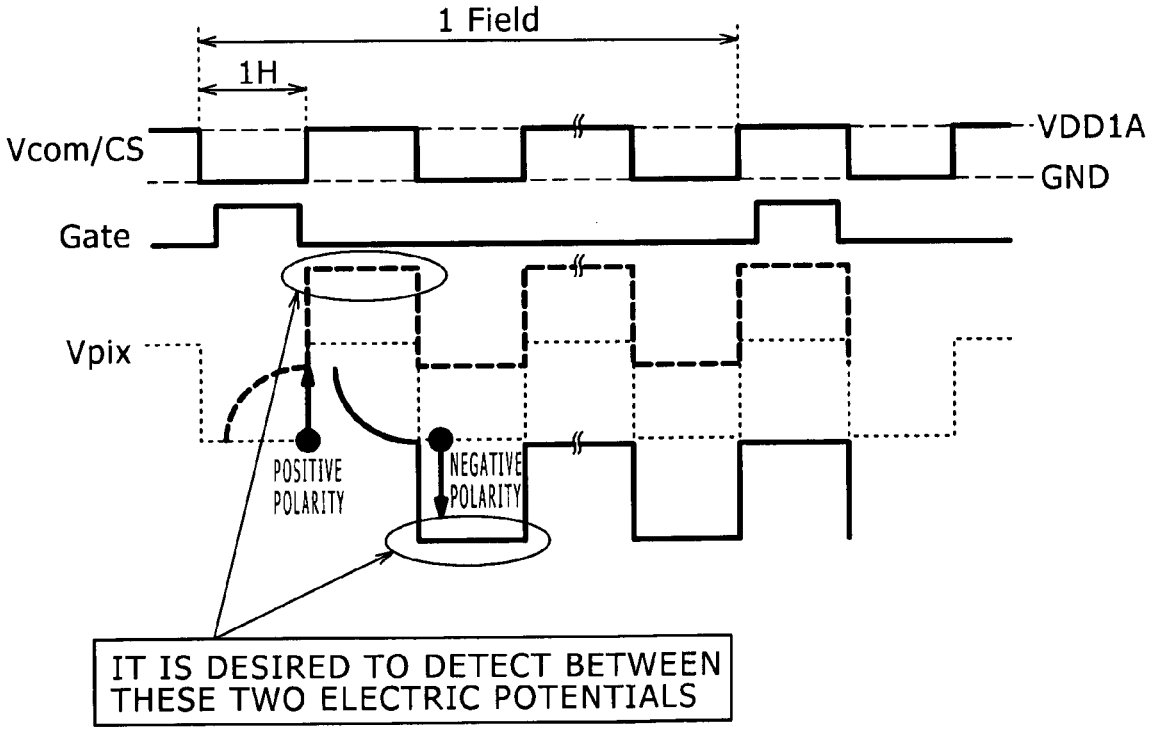
FIG. 66 is a diagram showing typical waveforms of signals generated as a result of adoption of the ordinary 1H Vcom inversion driving method in the automatic signal correction system for correcting the center value of the common voltage Vcom.

FIG. 66 is a diagram showing typical waveforms of signals generated as a result of adoption of the ordinary 1H Vcom inversion driving method in the automatic signal correction system for correcting the center value of the common voltage Vcom. In this case, an electric potential with a positive polarity never coexists with an electric potential with a negative polarity at the same time because the first pixel electrode of the liquid-crystal cell (that is, the pixel electrode located on the TFT side) experiences a capacitive coupling effect synchronously with a 1H inversion of the common voltage Vcom It is thus necessary to devise a technique to detect electric potentials appearing in the pixel circuit.

Figure 67:
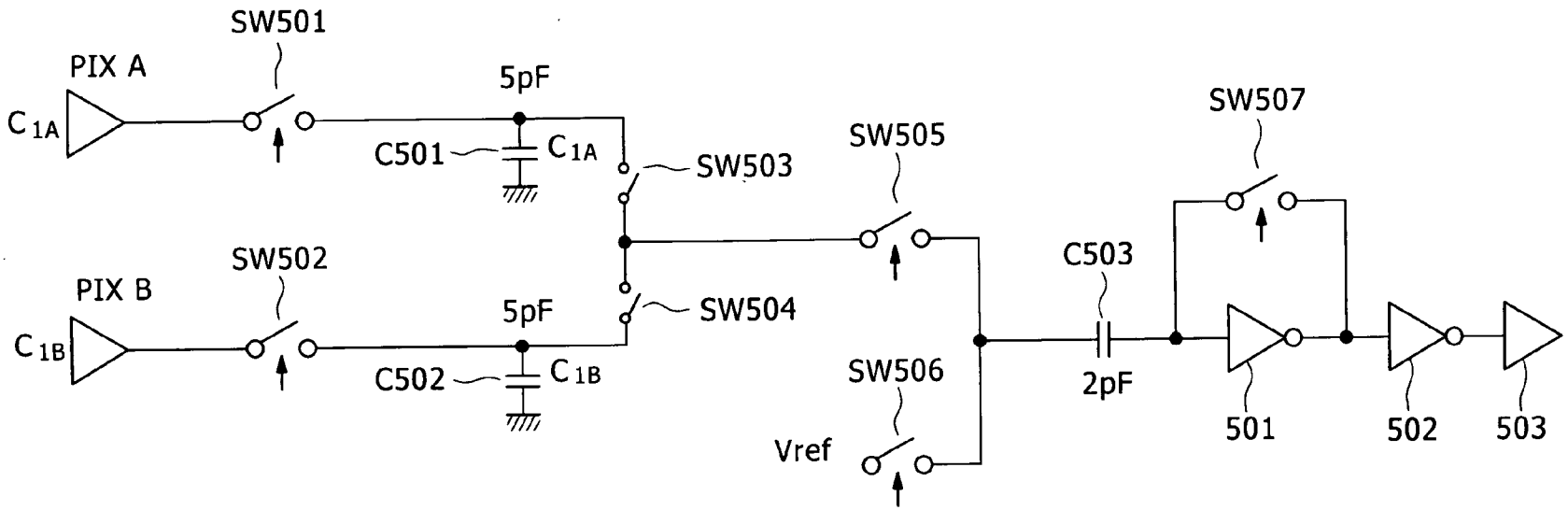
FIG. 67 is a diagram showing a typical configuration of a detection circuit including an automatic signal correction system for correcting the center value of the common voltage Vcom by adoption of the ordinary 1H Vcom inversion driving method.
Figure 68:
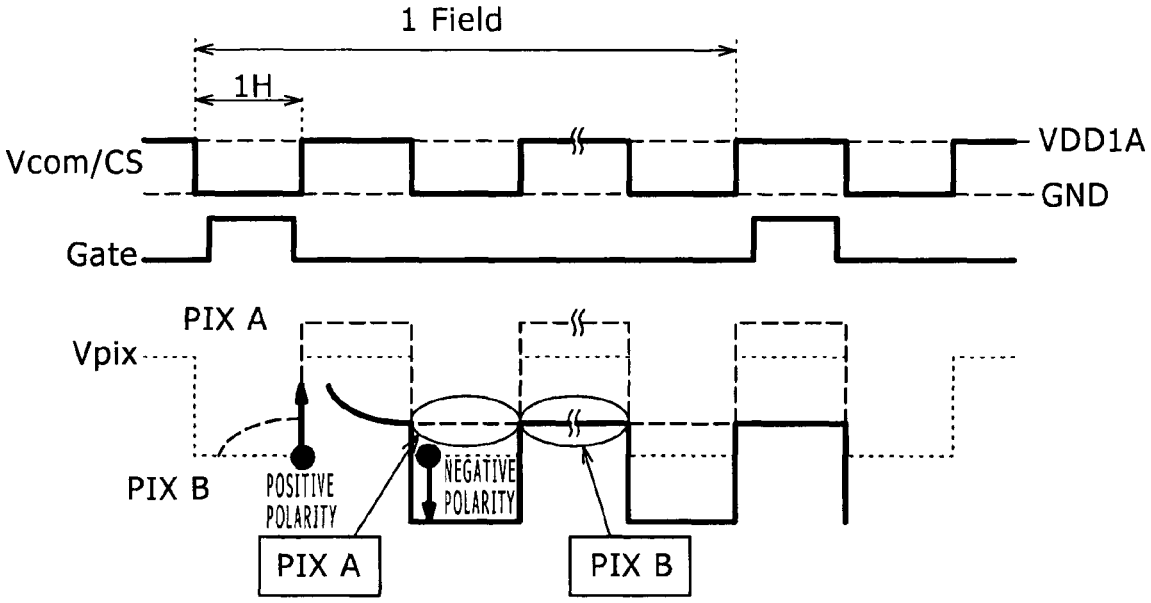
FIG. 68 shows typical timing charts of signals generated in the detection circuit shown in FIG. 67.

FIG. 67 is a diagram showing a typical configuration of a detection circuit 500 including an automatic signal correction system for correcting the center value of the common voltage Vcom by adoption of the ordinary 1H Vcom inversion driving method. FIG. 68 shows typical timing charts of signals generated in the detection circuit shown in FIG. 67.

The detection circuit 500 shown in FIG. 67 employs switches SW501 to SW507, capacitors C501 to C503, a comparison amplifier 501, a CMOS buffer 502 and an output buffer 503.

In the detection circuit 500, first of all, each of the switches SW506 and SW507 is put in a turned-on state. In this state, the input and output terminals of the comparison amplifier 501 are connected to each other, putting the comparison amplifier 501 in a reset state. In addition, the reference voltage Vref is electrically charged into the capacitor C503. Then, each of the switches SW506 and SW507 is put in a turned-off state.

Subsequently, a (½) Sig voltage is supplied to each of the monitor pixel section for the positive polarity and the monitor pixel section for the negative polarity. Then, the storage capacitors employed in the monitor pixel section for the positive polarity and the monitor pixel section for the negative polarity are driven into capacitive coupling states with timings shifted from each other by 1H. Then, the two storage capacitors are again driven into capacitive coupling states to obtain the DC value of the common voltage Vcom.

The switch SW501 is put in a turned-on state in order to accumulate an electric charge C1A of a pixel circuit PIXA in the capacitor C501 during a period of 1H. By the same token, the switch SW502 is then put in a turned-on state in order to accumulate an electric charge C1B of a pixel circuit PIXB in the capacitor C502 during a period of 1H.

Afterwards, each of the switches SW503 and SW504 is put in a turned-on state in order to merge the electric charge C1A accumulated in the capacitor C501 with the electric charge C1B accumulated in the capacitor C502 and obtain the average value of the electric charges C1A and C1B.

In this way, the ordinary 1H Vcom inversion driving method can be adopted in the automatic signal correction system for correcting the center value of the common voltage Vcom.

Also in this case, the inspection process entailing the cumbersome labor hours is not needed at a shipping time. Thus, even if the center value of the common voltage Vcom is shifted from an optimum value due to the temperature of an environment, the driving method, the driving frequency, the backlight (B/L) luminance or the luminance of incoming light, the system for automatically adjusting the center value of the common voltage Vcom is capable of sustaining the center value of the common voltage Vcom at a value optimum for the environment. As a result, the active-matrix display apparatus 100 offers a merit of the capability of appropriately preventing flickers from being generated on the display screen.

In addition, by adjusting the center value of the common voltage Vcom to an optimum value, it is possible to eliminate the effect of variations in actual pixel electric potential on the quality of the image.

The embodiment described above implements an active-matrix display apparatus making use of liquid crystal cells each functioning as the display element (or the electro-optical device) of a pixel circuit. However, the scope of the present invention is by no means limited to such liquid-crystal display apparatus. That is to say, the present invention can be applied to all active-matrix display apparatus including an active-matrix EL (Electroluminescence) display apparatus making use of EL devices each functioning as the display element of a pixel circuit.

The display apparatus according to the embodiment described above can be used as an LCD (Liquid-Crystal Display) panel which is the liquid-crystal display panel of a direct-vision video display apparatus or a projection LCD apparatus such as a liquid-crystal projector. Examples of the direct-vision video display apparatus are a liquid-crystal monitor and a liquid-crystal view finder.

On top of that, each of active-matrix display apparatus represented by the active-matrix liquid-crystal display apparatus according to the embodiment can not only be used as a display unit of OA equipment such as a personal computer and a word processor and a display unit of a TV receiver, but can also be used well as a display unit of electronic equipment (or a portable terminal) which needs to be made small in size and made compact. Examples of such electronic equipment or such a portable terminal are a cell phone and a PDA.

Figure 69:
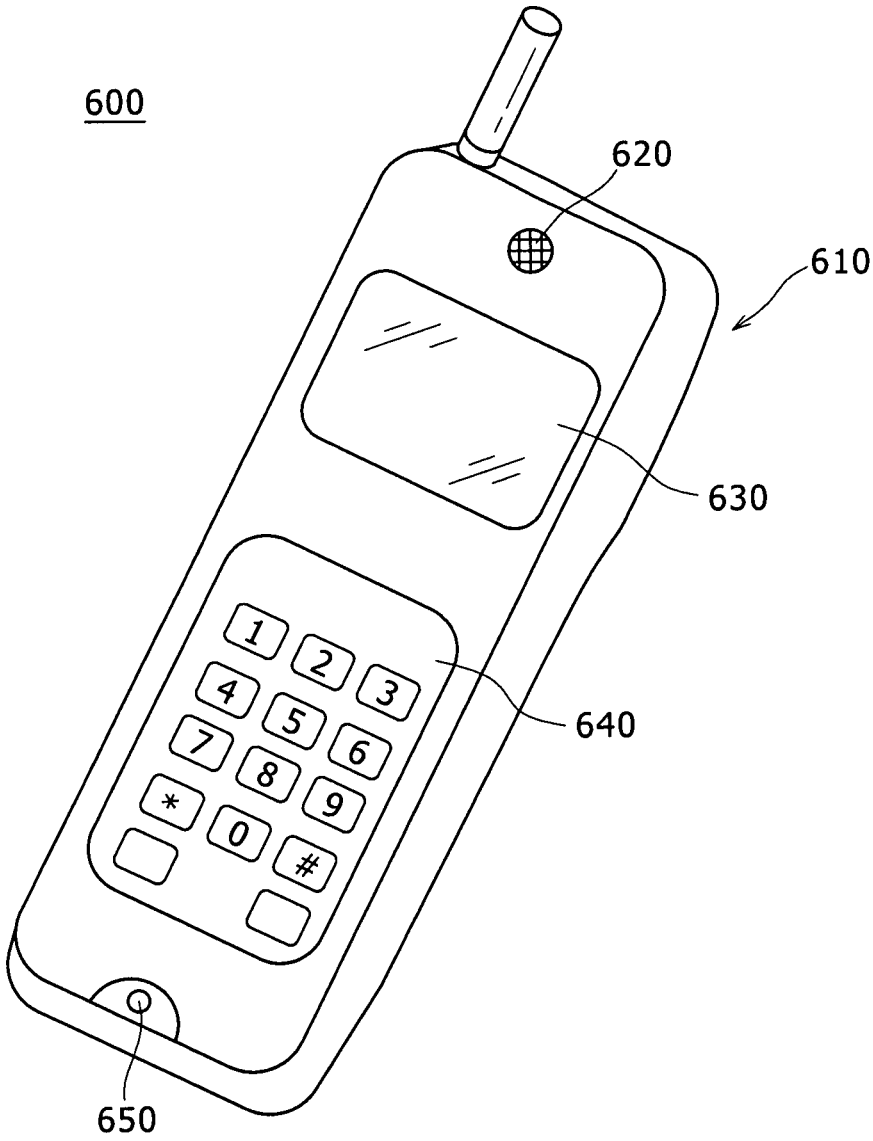
FIG. 69 is a diagram roughly showing an external view of electronic equipment serving as a portable terminal to which the embodiments of the present invention is applied.

FIG. 69 is a diagram roughly showing an external view of electronic equipment serving as a portable terminal 600 to which the present invention is applied. An example of such a portable terminal 600 is a cell phone.

The cell phone 600 according to an embodiment of the present invention employs a speaker section 620, a display section 630, an operation section 640 and a microphone section 650 which are provided on the front-face side of the phone case 610 of the cell phone 600 by being arranged sequentially starting from the top of the phone case 610.

The display section 630 employed in the cell phone 600 having the configuration described above is typically a liquid-crystal display apparatus which is the active-matrix liquid-crystal display apparatus according to the embodiments described so far.

As described above, by employing the active-matrix liquid-crystal display apparatus according to the embodiments explained so far in a portable terminal such as the cell phone 600 as the display section 630 of the cell phone 600, the cell phone 600 offers merits such as effective prevention of flickers from being generated on the display screen and a capability of displaying an image with a high quality.

In addition, the pitch can be reduced, the width of the frame can be decreased and the power consumption of the display apparatus can be lowered. Thus, the power consumption of the main unit of the portable terminal can also be reduced as well.

In addition, it should be understood by those skilled in the art that a variety of modifications, combinations, sub-combinations and alterations may occur, depending on design requirements and other factors as far as they are within the scope of the appended claims or the equivalents thereof.

What is claimed is:

1. A display apparatus comprising:

an effective pixel section having a plurality of pixel circuits arranged to form a matrix, each pixel circuit including a switching device through which pixel video data is written into said pixel circuit;

a plurality of scan lines respectively provided for individual rows of said pixel circuits arranged on said effective pixel section to control the conduction states of said switching devices;

a plurality of capacitor lines respectively arranged for the individual rows of said pixel circuits;

a plurality of signal lines respectively arranged for individual columns of said pixel circuits to propagate said pixel video data;

a first driving circuit configured to selectively drive said scan lines and said capacitor lines; and a second driving circuit configured to drive said signal lines, wherein said second driving circuit includes a voltage driving circuit having a voltage boosting function for carrying out a voltage boosting operation to boost an input voltage having a level with a dynamic range insufficient for a gradation expression;

said voltage driving circuit outputs a voltage obtained as a result of said voltage boosting operation or an unboosted voltage as a signal to one of said signal lines; and said voltage driving circuit has a select function for disabling said voltage boosting function for only a set of gradations determined in advance and implementing said voltage boosting function to boost said input voltage to an output voltage according to the level of said input voltage for gradations other than said set of gradations determined in advance, wherein the voltage driving circuit boosts only a black side with large voltage variations by setting a gradation zero as the set of gradations determined in advance, such that the voltage driving circuit disables the voltage boosting operation only for the gradation zero.

2. The display apparatus according to claim 1, wherein said voltage driving circuit carries out the voltage boosting function based on a capacitive coupling effect and does not make use of said capacitive coupling effect for the gradation zero.

3. A display apparatus comprising:

an effective pixel section having a plurality of pixel circuits arranged to form a matrix, each pixel circuit including a switching device through which pixel video data is written into said pixel circuit;

a plurality of scan lines respectively provided for individual rows of said pixel circuits arranged on said effective pixel section to control the conduction states of said switching devices;

a plurality of capacitor lines respectively arranged for the individual rows of said pixel circuits;

a plurality of signal lines respectively arranged for individual columns of said pixel circuits to propagate said pixel video data;

a first driving circuit configured to selectively drive said scan lines and said capacitor lines;

a second driving circuit configured to drive said signal lines, wherein said second driving circuit includes a voltage driving circuit having a voltage boosting function for carrying out a voltage boosting operation to boost an input voltage having a level with a dynamic range insufficient for a gradation expression, said voltage driving circuit outputs a voltage obtained as a result of said voltage boosting operation or an unboosted voltage as a signal to one of said signal lines, and said voltage driving circuit has a select function for disabling said voltage boosting function for only a set of gradations determined in advance and implementing said voltage boosting function to boost said input voltage to an output voltage according to the level of said input voltage for gradations other than said set of gradations determined in advance;

a monitor circuit configured to detect an electric potential found as a midpoint of detected electric potentials appearing on positive-polarity and negative-polarity monitor pixels provided besides said effective pixel section, and corrects the center value of a common voltage signal with a level changing at predetermined time intervals on the basis of said detected potential midpoint, wherein each of said pixel circuits arranged in said effective pixel section includes a display element having a first pixel electrode as well as a second pixel electrode, and a storage capacitor having a first electrode as well as a second electrode, in each of said pixel circuits, said first pixel electrode of said display element and said first electrode of said storage capacitor are connected to one terminal of said switching device;

in each of said pixel circuits, said second electrode of said storage capacitor is connected to said capacitor line provided for said individual row; and said common voltage with a level changing at time intervals determined in advance is supplied to said second pixel electrode of each of said display elements.

4. A method for driving a display apparatus, said display apparatus including an effective pixel section having a plurality of pixel circuits arranged to form a matrix, each pixel circuit including a switching device through which pixel video data is written into said pixel circuit; a plurality of scan lines respectively provided for individual rows of said pixel circuits arranged on said effective pixel section to control the conduction states of said switching devices; a plurality of capacitor lines respectively arranged for the individual rows of said pixel circuits; a plurality of signal lines respectively arranged for individual columns of said pixel circuits to propagate said pixel video data; a first driving circuit configured to selectively drive said scan lines and said capacitor lines; and a second driving circuit configured to drive said signal lines, the method comprising:

sending, in an operation to output a signal with a level according to a gradation expression to one of said signal lines, an input voltage having a level with a dynamic range insufficient for said gradation expression to said second driving circuit;

disabling a voltage boosting function for only a set of gradations determined in advance; and boosting said input voltage to an output voltage according to the level of said input voltage for gradations other than said set of gradations determined in advance;

wherein said disabling and said boosting is carried out for a black side with large voltage variations by setting a gradation zero as the set of gradations determined in advance, such that the voltage boosting operation is disabled only for the gradation zero.

5. The method according to claim 4, wherein said voltage driving circuit carries out the voltage boosting function based on a capacitive coupling effect and does not make use of said capacitive coupling effect for gradation zero.

6. An electronic equipment comprising a display apparatus including:

an effective pixel section having a plurality of pixel circuits arranged to form a matrix, each pixel circuit including a switching device through which pixel video data is written into said pixel circuit;

a plurality of scan lines respectively provided for individual rows of said pixel circuits arranged on said effective pixel section to control the conduction states of said switching devices;

a plurality of capacitor lines respectively arranged for the individual rows of said pixel circuits;

a plurality of signal lines respectively arranged for columns of said pixel circuits to propagate said pixel video data;

a first driving circuit configured to selectively drive said scan lines and said capacitor lines; and a second driving circuit configured to drive said signal lines, wherein said second driving circuit includes a voltage driving circuit having a voltage boosting function for carrying out a voltage boosting operation to boost an input voltage having a level with a dynamic range insufficient for a gradation expression, said voltage driving circuit outputs a voltage obtained as a result of said voltage boosting operation or an unboosted voltage as a signal to one of said signal lines, and said voltage driving circuit has a select function for disabling said voltage boosting function for only a set of gradations determined in advance and implementing said voltage boosting function to boost said input voltage to an output voltage according to the level of said input voltage for gradations other than said set of gradations determined in advance, wherein the voltage driving circuit boosts only a black side with large voltage variations by setting a gradation zero as the set of gradations determined in advance, such that the voltage driving circuit disables the voltage boosting operation only for the gradation zero.

7. The electronic equipment according to claim 6, wherein said voltage driving circuit carries out the voltage boosting function based on a capacitive coupling effect and does not make use of said capacitive coupling effect for gradation zero.

8. A method for driving a display apparatus, said display apparatus including an effective pixel section having a plurality of pixel circuits arranged to form a matrix, each pixel circuit including a switching device through which pixel video data is written into said pixel circuit; a plurality of scan lines respectively provided for individual rows of said pixel circuits arranged on said effective pixel section to control the conduction states of said switching devices; a plurality of capacitor lines respectively arranged for the individual rows of said pixel circuits; a plurality of signal lines respectively arranged for individual columns of said pixel circuits to propagate said pixel video data a first driving circuit configured to selectively drive said scan lines and said capacitor lines; and a second driving circuit configured to drive said signal lines, the method comprising:

sending, in an operation to output a signal with a level according to a gradation expression to one of said signal lines, an input voltage having a level with a dynamic range insufficient for said gradation expression to said second driving circuit;

disabling a voltage boosting function for only a set of gradations determined in advance;

boosting said input voltage to an output voltage according to the level of said input voltage for gradations other than said set of gradations determined in advance; and detecting, by a monitor circuit, an electric potential found as a midpoint of detected electric potentials appearing on positive-polarity and negative-polarity monitor pixels provided besides said effective pixel section, and correcting the center value of a common voltage signal with a level changing at predetermined time intervals on the basis of said detected potential midpoint, wherein each of said pixel circuits arranged in said effective pixel section includes a display element having a first pixel electrode as well as a second pixel electrode, and a storage capacitor having a first electrode as well as a second electrode, in each of said pixel circuits, said first pixel electrode of said display element and said first electrode of said storage capacitor are connected to one terminal of said switching device;

in each of said pixel circuits, said second electrode of said storage capacitor is connected to said capacitor line provided for said individual row; and said common voltage with a level changing at time intervals determined in advance is supplied to said second pixel electrode of each of said display elements.

9. An electronic equipment comprising:

a display apparatus including:

an effective pixel section having a plurality of pixel circuits arranged to form a matrix, each pixel circuit including a switching device through which pixel video data is written into said pixel circuit;

a plurality of scan lines respectively provided for individual rows of said pixel circuits arranged on said effective pixel section to control the conduction states of said switching devices;

a plurality of capacitor lines respectively arranged for the individual rows of said pixel circuits;

a plurality of signal lines respectively arranged for columns of said pixel circuits to propagate said pixel video data;

a first driving circuit configured to selectively drive said scan lines and said capacitor lines;

a second driving circuit configured to drive said signal lines, wherein said second driving circuit includes a voltage driving circuit having a voltage boosting function for carrying out a voltage boosting operation to boost an input voltage having a level with a dynamic range insufficient for a gradation expression, said voltage driving circuit outputs a voltage obtained as a result of said voltage boosting operation or an unboosted voltage as a signal to one of said signal lines, and said voltage driving circuit has a select function for disabling said voltage boosting function for only a set of gradations determined in advance and implementing said voltage boosting function to boost said input voltage to an output voltage according to the level of said input voltage for gradations other than said set of gradations determined in advance;

a monitor circuit configured to detect an electric potential found as a midpoint of detected electric potentials appearing on positive-polarity and negative-polarity monitor pixels provided besides said effective pixel section, and corrects the center value of a common voltage signal with a level changing at predetermined time intervals on the basis of said detected potential midpoint, wherein each of said pixel circuits arranged in said effective pixel section includes a display element having a first pixel electrode as well as a second pixel electrode, and a storage capacitor having a first electrode as well as a second electrode, in each of said pixel circuits, said first pixel electrode of said display element and said first electrode of said storage capacitor are connected to one terminal of said switching device;

in each of said pixel circuits, said second electrode of said storage capacitor is connected to said capacitor line provided for said individual row; and said common voltage with a level changing at time intervals determined in advance is supplied to said second pixel electrode of each of said display elements.

* * * * *